US005975205A

United States Patent [19]

Carisella

[11] Patent Number: 5,975,205

[45] Date of Patent: Nov. 2, 1999

[54] GRAVEL PACK APPARATUS AND METHOD

[76] Inventor: James V. Carisella, P.O. Box 10498, New Orleans, La. 70181-0498

[21] Appl. No.: 08/941,413

[22] Filed: Sep. 30, 1997

[51] Int. Cl.[6] ..... E21B 43/04

[52] U.S. Cl. ..... 166/278; 166/51; 166/134; 166/212; 166/187

[58] Field of Search ..... 166/212, 51, 278, 166/134, 303, 187; 175/61

[56] References Cited

U.S. PATENT DOCUMENTS

| | | | |
|---|---|---|---|
| 3,901,318 | 8/1975 | Fortenberry . | |
| 4,401,158 | 8/1983 | Spencer . | |
| 4,627,488 | 12/1986 | Szarka . | |
| 4,733,723 | 3/1988 | Callegari, Sr. | 166/278 X |
| 4,856,590 | 8/1989 | Caillier . | |
| 4,858,690 | 8/1989 | Rebardi et al. | 166/278 |
| 4,860,831 | 8/1989 | Caillier . | |
| 5,033,549 | 7/1991 | Champeaux . | |
| 5,069,280 | 12/1991 | McKee . | |
| 5,115,860 | 5/1992 | Champeaux . | |
| 5,174,379 | 12/1992 | Whiteley . | |
| 5,219,025 | 6/1993 | Berger . | |
| 5,330,003 | 7/1994 | Bullick | 166/278 |
| 5,332,038 | 7/1994 | Tapp . | |
| 5,343,953 | 9/1994 | Patel . | |
| 5,377,749 | 1/1995 | Barbee . | |
| 5,413,176 | 5/1995 | Restarick . | |
| 5,609,204 | 3/1997 | Rebardi . | |
| 5,620,050 | 4/1997 | Barbee . | |

OTHER PUBLICATIONS

High Pressure Integrity, Inc.—New Orleans, Louisiana "I–HIP Casing Annulus Packers" 1993.

"Eclipse Series" "Packers/Plugs for Coiled Tubing" (1994).

Society of Petroleum Engineers—H.L. Restarick—1991 Paper No. 23130 "Thru–Tubing Sand Control Techniques Reduce Completion Costs".

*Primary Examiner*—Roger Schoeppel

*Attorney, Agent, or Firm*—Beirne, Maynard & Parsons, L.L.P.

[57] ABSTRACT

A thru-tubing gravel packing operation utilizing inflatable packing elements and a flow cross-over assembly which selectively opens flow ports for effecting steps in the gravel packing operation and which further provides concentric flow paths through the cross-over assembly for transmitting fluid pressure to valving means and the interior of the packing element or elements to move them to set and sealed condition, whereby the outer diameter of the inflatable element in the sealed condition may preferably expand to at least twice the outer diameter of such element in the initial or run-in condition, for the sequential setting thereof while also transmitting a variation in the pressured fluid to actuate a valve for circulation of the gravel packing fluid exterior of the assembly and for permitting return of fluids through the assembly without the gravel. When plural packing elements are incorporated, the device includes valving components which permit the setting of the lower or sump packer prior to the setting of the gravel pack packer as well as the opening of the gravel packing sleeve valve and a valving component within the gravel packing screen for circulation. The device is mechanically manipulatable after the setting operation for various steps in gravel packing of a subterranean well through tubing introduced through production tubing disposed through a Christmas tree.

30 Claims, 77 Drawing Sheets

S
CT
CTU
WU
BP
CTA
FL
W
C
PC
PP
DE
TC
TC'
100
CTA
GPP
AA
S
GPS
PI
PZ
TTS
SP

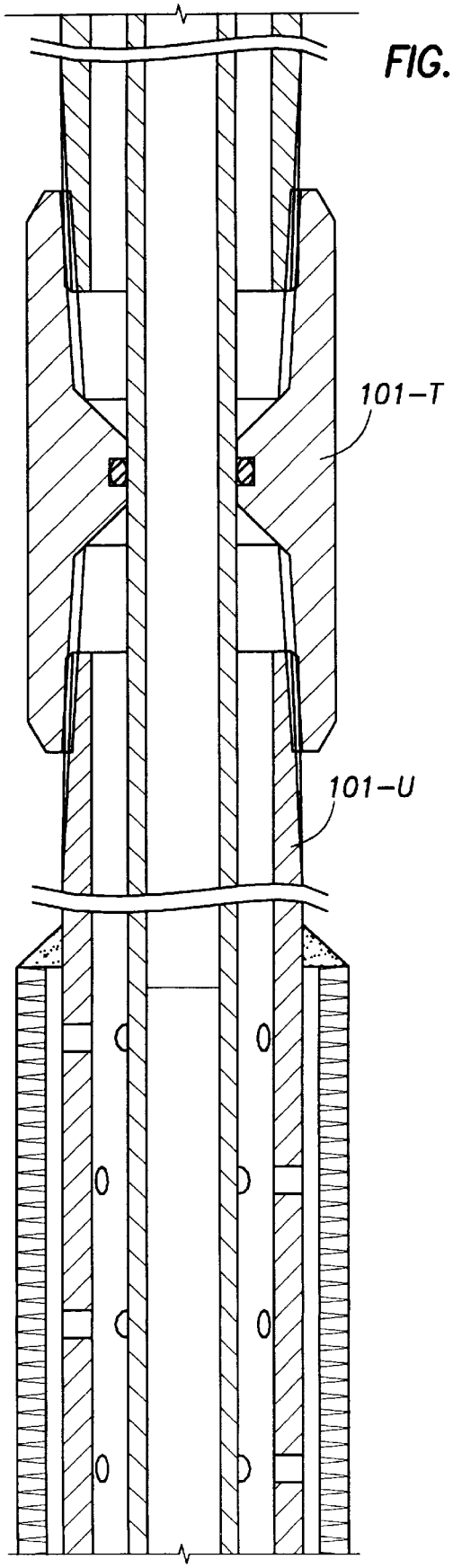
FIG.30
FIG.3P
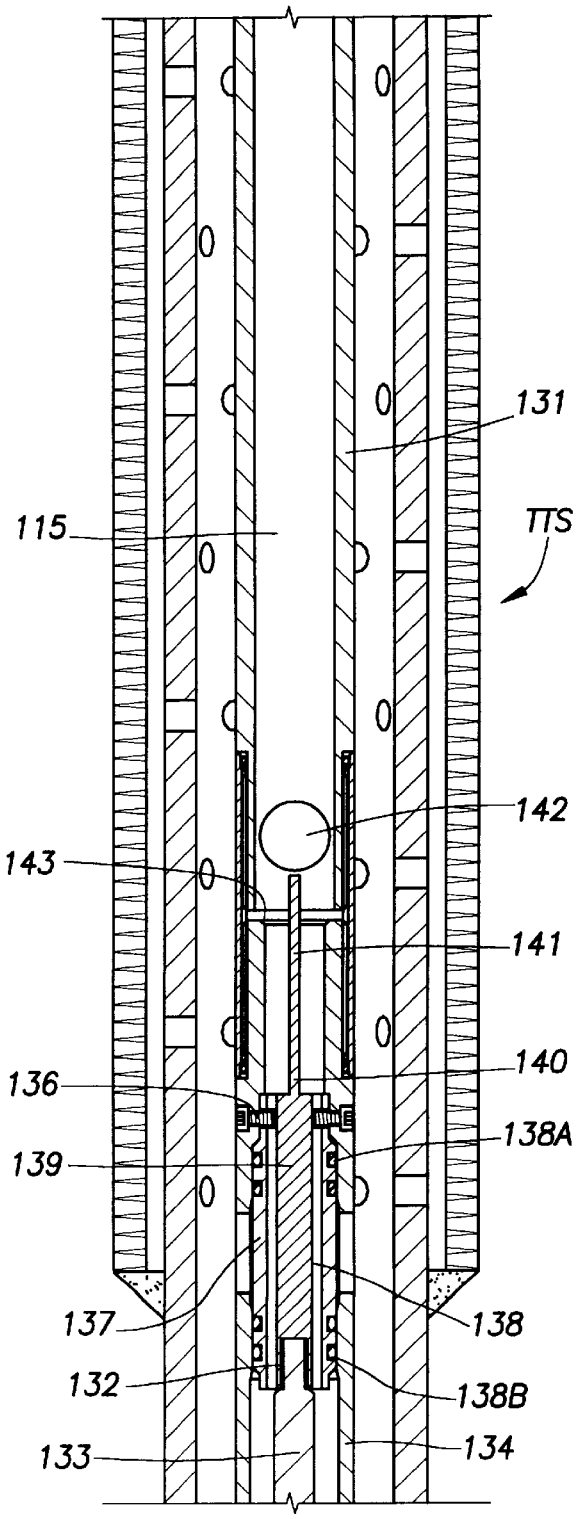

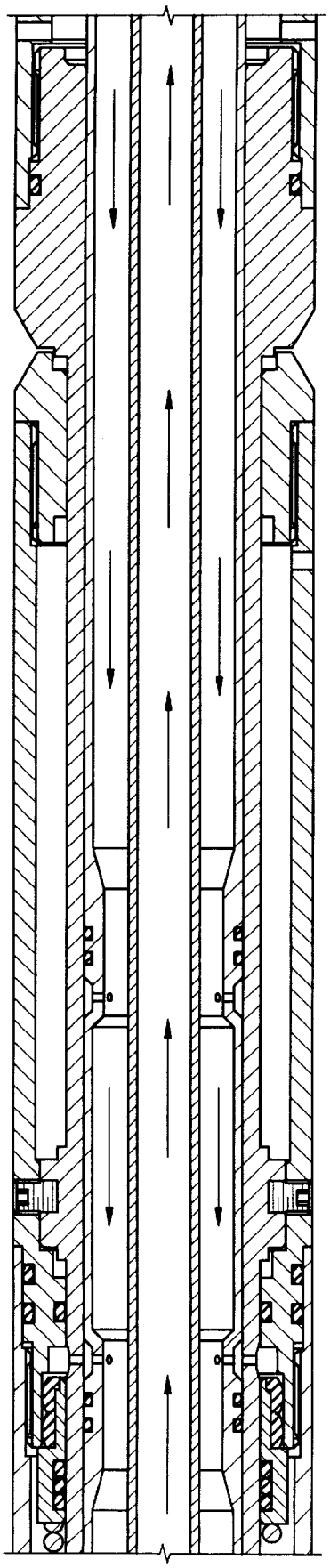
FIG.5E
FIG.5F
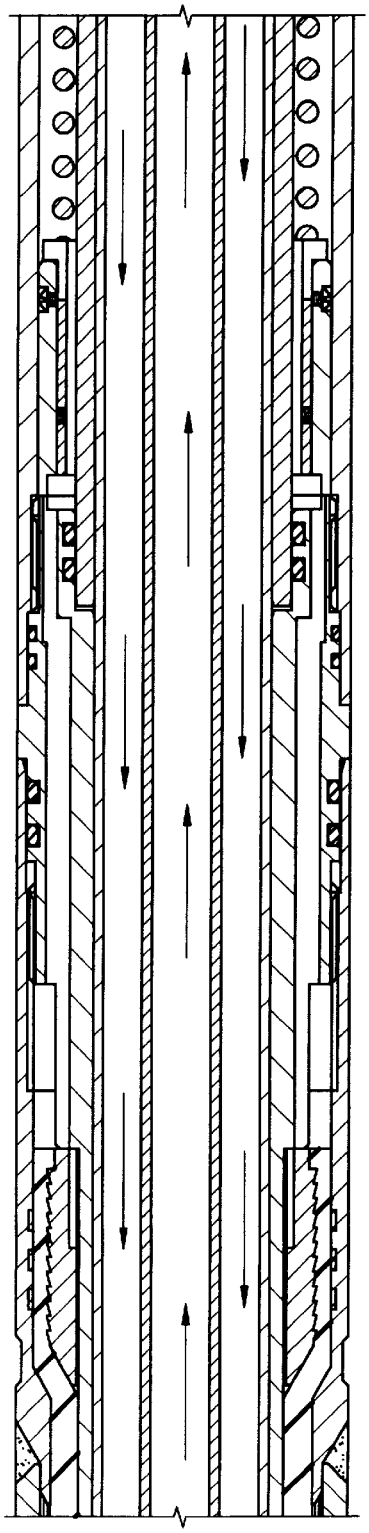

GRAVEL PACK APPARATUS AND METHOD

BACKGROUND OF THE INVENTION (1) Field of the Invention

The invention relates to a gravel packing apparatus and method for use in a subterranean well in a "thru-tubing" operation.

(2) Description of the Prior Art

Of considerable magnitude in the production of hydrocarbons, such as oil and gas, from a producing well is the problem of sand flow into the wellbore from unconsolidated formations. Production of sand with the flow of hydrocarbons will cause the wellbore to gradually fill-up with minute sand and silt particles until production perforations in the casing and, often times, the end of production tubing inserted therein, are covered, resulting in a significant reduction in fluid production. In many instances, sand production will cause the well to stop producing.

While such problem is frequently encountered in oil and gas wells, it will be appreciated that such problems are equally encounterable in water wells. Accordingly, it is contemplated that the invention has utility in abating this problem in water wells as well as oil and gas wells. Accordingly, by use of the term "subterranean well" herein, I mean to refer to and identify water, oil, gas, and other subterranean wells of similar nature. Accordingly, the use of the phrase "production zone" will refer to and mean a zone within any such well in which a fluid desired to be produced may be encountered, such as water, gas, oil, and/or mixtures thereof.

In addition to reduction of fluid production, flow of sand may also cause severe damage to equipment, such as pumps, chokes and the like. In flowing wells, fluid velocity may be sufficient to scavenge sand within the wellbore and produce it with the fluid hydrocarbon, resulting in holes being cut in the tubing and flow lines, as well as in valving components, such as the Christmas tree disposed at the top of the well through which production tubing and casing are communicated, connected or disposed.

When, referring to "Christmas tree" herein, I mean to refer to an assembly of valves and fittings which are attached to the upper most connection of the tubing head, used to control well production and which may be distinguished from a "wellhead" which includes all permanent equipment between the upper most portion of the surface casing and the tubing head adapter connection. A tubing head adapter adapts the upper most connection of a tubing head to the lower most valve of the Christmas tree.

One well known means of controlling flow of sand into the wellbore is the placement of gravel around the exterior of a slotted, perforated, or other similarly formed liner, isolation means, or screen. When used herein, all such references and constructions are the equivalent of the others and can be generally referred to as production or gravel pack screens. The selected construction of such components is not particularly significant to the present invention but the function of filtering out the sand produced with the oil or gas or water is common to all such constructions to thus prevent its entry into the wellbore and thence to the top of the well. It is important to size the gravel for proper containment of the sand. Additionally, the slotted liner, perforated pipe, or screen must be designed to prevent entry of the gravel or sand itself into the production tubing.

Most gravel pack assemblies incorporate two vertically spaced apart versions and sections of such "screens," with the lower section being commonly referred to as the "tell-tale" screen, and the second or higher screen assembly being referred to as the gravel pack screen. Two separate sections of screen bridge the perforated or production zone with the tell-tale screen being the first to receive the fluid returns interior of the apparatus during the gravel packing operation. As gravel is packed upwardly around the tell-tale screen and to the top of the gravel pack screen, an increase in fluid pumping pressure will be detected at the top of the well.

As described below, production of produced fluids in the zone will be conducted through the upper gravel pack packer, through the interior of the outer housing of the assembly remaining in the well after retrieval of the mandrel and cross-over tool components, thence through the opening in the lower end of the production conduit extending into the producing zone through the bore of a set production packer.

Although other fluids have been used, treated and filtered water with a desired concentration of chlorides plus a synthetic polymer or other shear thinning or viscosity controlling substance, is preferably used in most gravel packing processes during the packing and cleaning or flushing procedures. The water is treated to remove contaminants such as cement particles, scale, and other foreign material generally resulting from the circulation of fluid in the wellbore before recirculation into the well with additional gravel, or during any cleaning or flushing procedure.

Gravel packing may be effected as a portion of the initial completion operation or may be provided during a workover operation. Some present day workover operations contemplate the use of "thru-tubing" operations in which the production tubing remains in the well and the remedial or workover operation is effected through the production tubing by use of tubular conduits such as continuous coiled tubing, or the like. Such "thru tubing" tubular conduits may, of course, include a workover string of tubing made up of a series of tubing sections which are threaded or otherwise secured one to another and which are introduced into the well with the Christmas tree in place and through a selectively openable passageway through the Christmas tree and then concentrically disposed through the production tubing.

The present invention includes incorporation of expandable elastomeric packing elements which, because the operation will be performed "thru-tubing," preferably must be of a construction in which the sealing element of the inflatable packer is capable of expanding from the initial outer diameter during the running-in condition to the outer diameter when such packer is in the fully expanded condition of at least a ratio of two or more. Such packers are commercially available and are identified as the Model 373 Inflatable Packer made available by High Pressure Integrity, Inc., of New Orleans, La. The configuration of such packers is illustrated in Product Publication entitled "I-HIP Inflatable Tools" dated 1993, of High Pressure Integrity, Inc. New Orleans, La.

In U.S. Pat. No. 3,901,318, there is shown and disclosed a one trip gravel packing operation incorporating a fluid flow cross-over assembly which is moved to various positions by tubing manipulation. This patent contemplates traditional gravel packing operations and does not utilize an inflatable packer element, nor is the cross-over assembly utilized to provide a passageway to set the packer or to thereafter provide a passageway for introduction of the gravel and carrier fluid in the well nor to manipulate valvings by application of pressure subsequent to the setting of the packer. Moreover, tubing rotation is required during certain steps in the packer setting operation, as well as disengagement of the work string when it is desired to leave the gravel pack components in the well. Thus, where coiled tubing is to be the "thru tubing" component, the '318 tool cannot be used.

Likewise, U.S. Pat. No. 4,401,158, discloses the use of a similar device in concert with packing elements for multi-zone gravel packing and perforating of a well.

U.S. Pat. No. 4,627,488, discloses an isolation gravel packing system utilizing conventional mechanically set packers having slips and a cross-over tool disposed within the interior of the device for conventional isolation gravel packing with the device carried on a conventional work string into the well.

U.S. Pat. No. 4,856,590, utilizes coiled tubing in a thru-tubing operation, but utilizes a pre-packed screen apparatus.

U.S. Pat. No. 4,860,361, incorporates a coiled tubing string that does not require utilization of a cross-over assembly or multiple packers.

U.S. Pat. No. 5,219,025, incorporates a cross-over assembly to facilitate pumping of a gravel slurry in a wellbore and is of limited construction with respect to the configuration of the cross-over assembly.

U.S. Pat. No. 5,069,280, shows a variation of gravel packing incorporating a gravel packer which provides sequential locking and sealing of the packer in the well and includes a releasing mechanism for mechanically disconnecting it from the packer.

U.S. Pat. No. 5,174,379, discloses a single trip gravel packing and perforating operation typical of the prior art in such combination.

U.S. Pat. No. 5,332,038, discloses a gravel packing system incorporating a combination packer and setting tool for the packer which is mechanically set. U.S. Pat. No. 5,343,953, discloses a thru-tubing recirculating device incorporating a cross-over assembly and a gravel packing screen.

U.S. Pat. No. 5,377,749, teaches the introduction of coiled tubing through a wellhead and the utilization of a mechanically set packer with a flow control cross-over assembly for providing a fluid flow path for gravel packing only. The packer disclosed in this patent is of extremely restricted expansion and requires mechanical manipulation of the tubing string for the setting.

U.S. Pat. No. 5,413,176, is directed to a device for repairing a gravel packing screen already in place, and incorporates a mechanically set packing device.

U.S. Pat. No. 5,609,204, discloses a gravel packing device incorporating a cross-over assembly and a mechanically set packer with a washpipe stabbed into a seal bore bridging the production screen.

U.S. Pat. No. 5,620,050, discloses a method for setting a hydraulic packer used in a gravel packing operation on remedial coiled tubing disposed through a wellhead. The packer is set hydraulically. This patent discloses hydraulic actuation of a conventional non-elastomeric expansible packer which incorporates slips for purposes of anchoring the packer against the inner wall of the well. Moreover, this patent does not use a flow control cross-over assembly with concentrically disposed flow passageways therethrough that can be used to both set the packer and open certain valves to circulate the gravel and carrier fluid.

Promotional literature entitled "Eclipse Series Packers/Plugs for Coiled Tubing" discloses the use of a conventional non-inflatable packer with slips and a cross-over assembly in which a passageway in the cross-over assembly is utilized to transmit pressure to mechanically move the slips and the conventional packer into set position. Only one packer is utilized and the cross-over assembly cannot be used to provide setting of plural packers because one of the concentric passageways through the cross-over assembly permits fluid flow therethrough in only one direction, i.e., to the top of the well, for returns.

Electric line gravel packing is an alternative to the thru-tubing concept, and is typified in U.S. Pat. No. 5,033,549. Likewise, U.S. Pat. No. 5,115,860 discloses a similar method of implementing a thru-tubing gravel packing operation.

Finally, Society of Petroleum Engineers Paper No. 23130 entitled "Thru-Tubing Sand Control Techniques Reduce Completion Costs," presented at Offshore Europe Conference held in Aberdeen, Scotland, Sep. 3–6, 1991, generally discloses commercially available gravel packing components and tools as well as various types of perforated tubing, screens, and slotted liners, which may be incorporated into the present invention.

SUMMARY OF THE INVENTION

The present invention provides a gravel packing apparatus and method which is intended to be utilized on a tubular conduit which is introduced through another conduit into the well. The well may be cased, or open hole, and when it is open hole, the inner wall within its bore constitutes the area which is sealingly engaged with the inflatable packer elements as described herein. The tubular conduit may be coiled tubing, a workover string made up of threaded sections, or any other tubular conduit of known or similar construction. The apparatus incorporates elastomeric inflatable element means which provide a gravel pack packer and, if a second such packer is utilized, provides a sump packer therebelow. It is not necessary for two packers to be run on the same conduit in the apparatus, and if desired, the sump packer may be of the inflatable variety and previously set in the well or may be a bridge plug, retrievable packer or sump packer run in and set by wire line, electric line, work string, or the like, and may be mechanically or hydraulically set or otherwise actuated in known manner. The sump packer may be provided with an open bore which may be used to transmit produced fines in low velocity production fluids through the bore and into a rat hole, which serves to collect and contain the fines away from interference with or bridging of the production flow and inside the gravel pack screen and/or in any position of the production fluid passageway through the assembly and the tubular conduit or production tubing.

When the preferred inflatable packer elements are utilized in the present invention, they are required to provide expansion to the fully expanded condition for sealing against the well wall or casing to at least twice the diameter of the element as it is in its running or run-in condition. This is highly desirable in thru-tubing operations described herein to permit the packer to travel freely through the Christmas tree and the production tubing on the tubular conduit, such as coiled tubing, and then be able to expand sufficiently outwardly to the given wall of the well which could have an inner diameter considerably greater than that of the production tubing inner diameter. Through experimentation and testing, I have discovered that this expansion ratio of at least two-to-one is sufficient to assure operational integrity in what is referred to as "thru-tubing" operations.

The present invention also contemplates use of a fluid flow cross-over assembly in which concentric pathways therethrough may be utilized to inflate the inflatable packer element means as well as to provide pressure to valving means on a control mandrel to communicate the interior of the washpipe with the well annulus through the tell-tale screen to permit circulation of the clean fluid subsequent to deposition of gravel carried in the fluid exterior of the screen as well as to open a valve in the housing above the gravel pack screen to permit gravel in the carrier fluid to be deposited exterior of the screens.

When a gravel pack packer and a sump packer are carried on the tubular conduit, the flow control cross-over assembly permits one of the concentric tubular passageways therethrough to transmit inflation fluid pressure to one of the packers while the other of the concentric passageways within the cross-over assembly will transmit inflation fluid pressure to the other of the packer assemblies. Valving means are provided for the packers such that the lower of the packers is set prior to the upper of the packers and the valve within the screen assembly is not opened until each of the packers are completely set.

The pressure through the cross-over assembly during the packer setting operation will also open the fluid passageway between the mandrel and the housing of the apparatus to permit the gravel packing carrier fluid with the gravel to pass through the cross-over assembly and into the well after shifting of the apparatus by the coil tubing to telescopically expand the mandrel relative to the outer housing to move the apparatus to the gravel packing position. Additional and subsequent manipulation of the tubing will further telescopically expand the mandrel relative to the housing to permit alignment of ports for cleaning of the well annulus and the interior of the tubing subsequent to the gravel packing operation by normal circulation or reverse circulation.

The invention also contemplates use of the apparatus without a washpipe to provide a one trip gravel packing squeeze operation. Moreover, the apparatus may be easily converted to remove the flow control cross-over assembly to provide an alternate apparatus and method of one trip gravel packing of the well.

DESCRIPTION OF THE PREFERRED EMBODIMENTS

Figure 1:
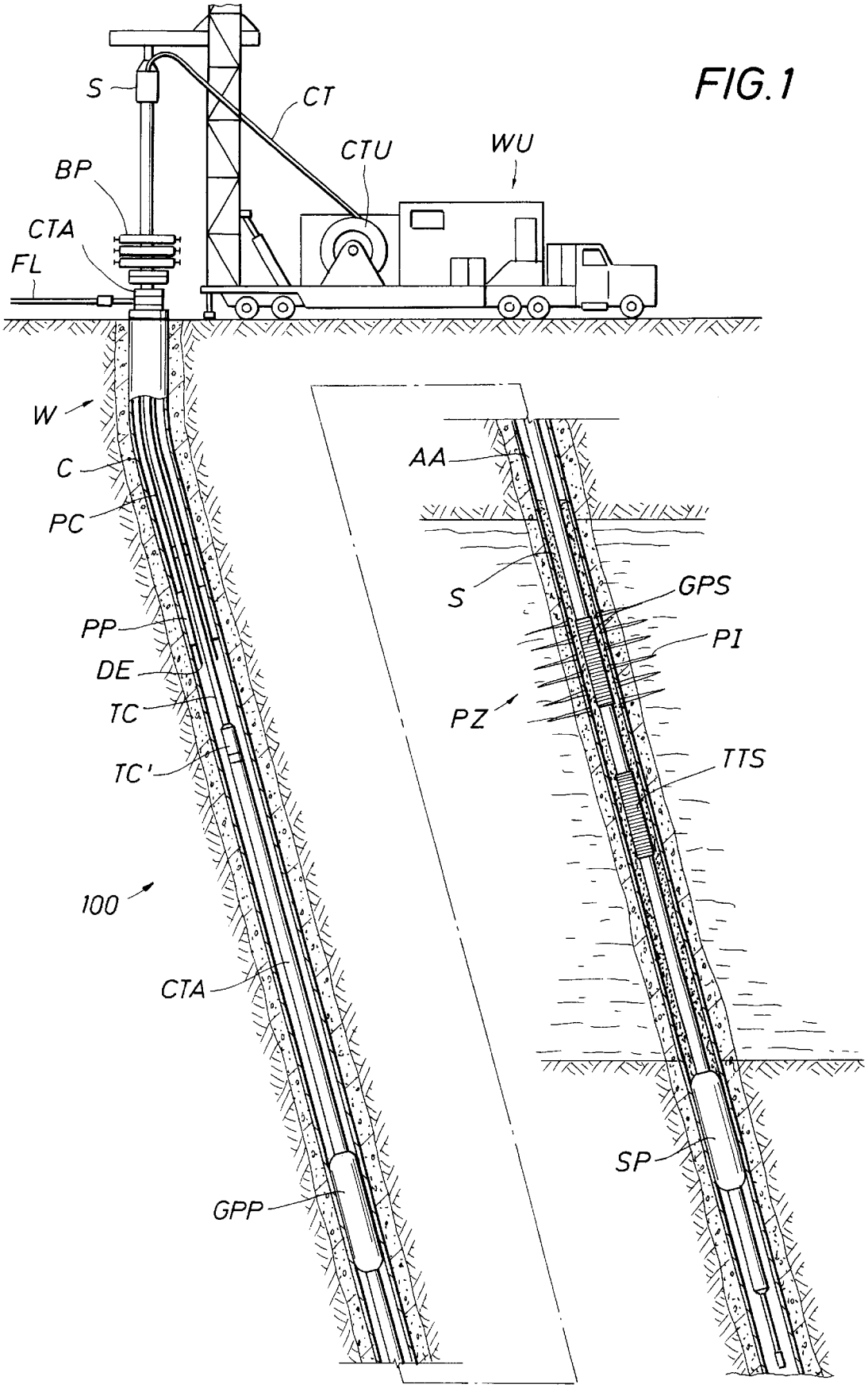
FIG. 1 is a longitudinal schematic, partial sectional view of the apparatus of the present invention and its related components after setting of the elastomeric inflatable elements to expanded condition and subsequent to the gravel packing operation.

Now with reference to FIG. 1, there is shown in vertically disposed partial sectional schematic illustration, the preferred apparatus 100 of the present invention. A workover unit WU is operationally positioned immediate the well W with the unit WU containing a coiled tubing unit CTU including a length of continuous coiled tubing CT, which is the preferred tubular conduit.

The workover unit WU includes a swivel joint assembly S through which the coil tubing CT is inserted. The workover unit WU also includes a blowout preventer stack BP which is engaged above a Christmas tree assembly CTA prior to introduction of the coiled tubing CT and includes a controlled passageway therethrough through which the coil tubing CT is disposed through the Christmas tree assembly CTA. The Christmas tree assembly CTA also receives a flow line FL for transmission of the production fluids.

As shown, the well W includes an inner wall which, as illustrated in the preferred embodiments, is cased with casing C, such that the casing C defines the inner wall of the well W. A production conduit PC with its distal end DE is disposed through the casing C and defines within it a fluid passageway FP communicating through the Christmas tree assembly CTA and the flowline FL. The open distal end DE of the production tubing PT extends through a production packer PP which isolates the annular area of the well W at such point between the exterior of the production conduit PC and the inner wall of the well W defined by the casing C. As shown in FIG. 1, the tubular conduit TC, i.e., the coiled tubing, extends into the well W and out of the distal end DE of the production conduit PC, and carries thereon a tubular connector $TC^1$.

The apparatus 100 is shown in FIG. 1 on the tubular conduit TC and disposed within a production zone PZ having an annular area AA. The apparatus 100 contains a first expandable elastomeric inflatable element means, or gravel pack packer GPP, below a flow control cross-over tool assembly CTA which has concentric flow passageways for transmitting hydraulic fluid pressure for the setting of the gravel pack packer GPP and a sump packer SP (if used), and also provides fluid passageways for introduction of gravel in a carrier fluid for the gravel packing of the well.

FIG. 1 also schematically illustrates portions of the apparatus 100 in schematic format as shown with the particle isolation means being illustrated as a screen of conventional construction having members defined as a gravel pack screen GPS and a tell-tale screen TTS therebelow. As shown, sized particulate matter, or gravel pack sand S, is shown disposed within the annular area AA to block larger particulate matter within the production zone PZ from being carried with the produced fluids through a perforated interval PI through the casing C into the annular area AA, and thence interior of the tubing PC to the top of the well.

Figure 2:
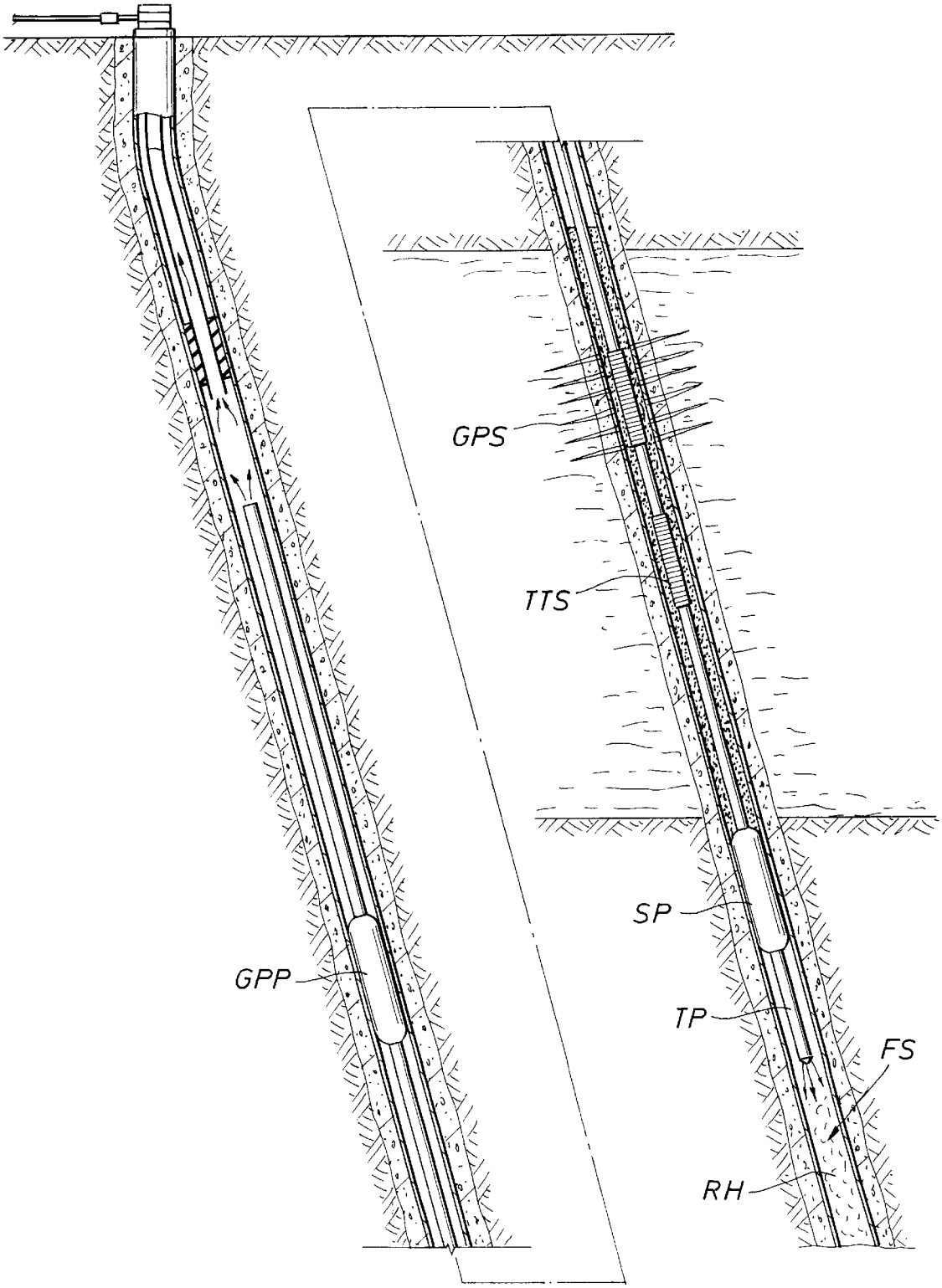
FIG. 2 is a view similar to that of FIG. 1, schematically showing the preferred apparatus of the present invention subsequent to retrieval of the control mandrel, flow control cross-over assembly and washpipe components out of the well with produced fluids being produced through the production tubing to the top of the well, as shown.

Now referring to FIG. 2, the preferred apparatus 100 is schematically shown as it is left within the well W subsequent to the gravel packing operation as described herein. The workover assembly and blow out preventer stack have been removed, leaving only the Christmas tree and the production tubing PT to the flow line FL in place at the top surface of the earth.

Figure 3A:
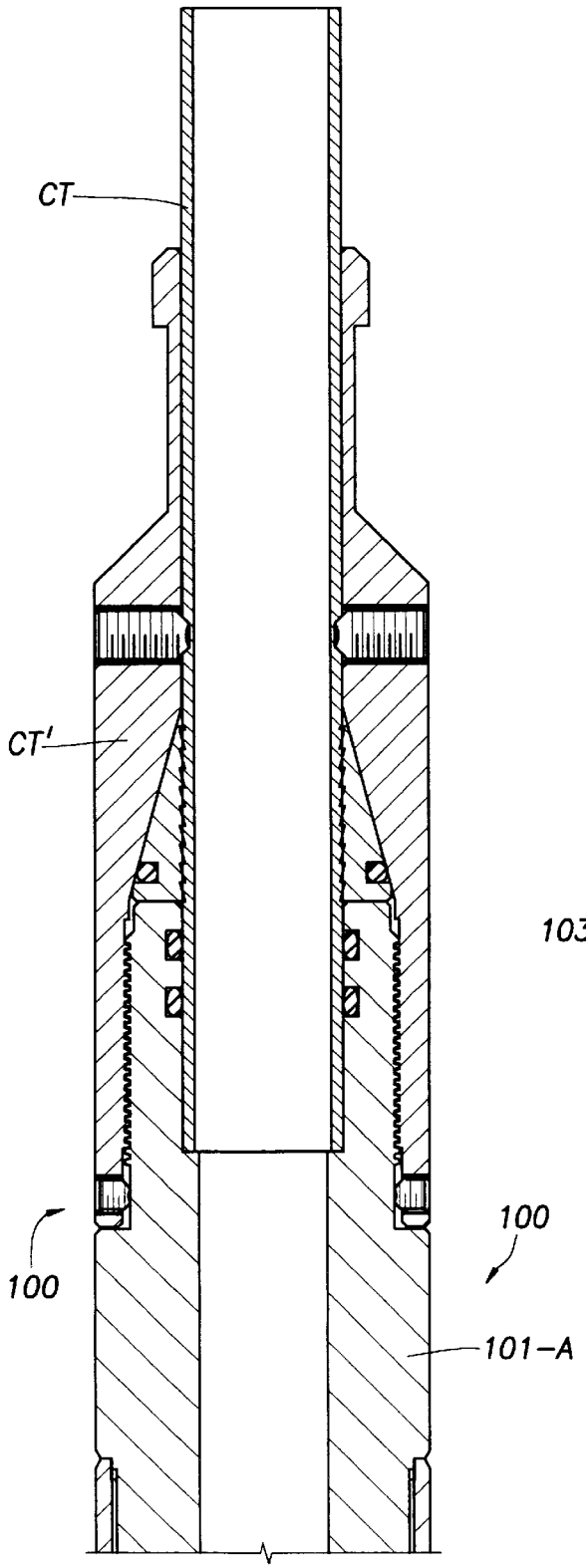
FIGS. 3A–3X constitute, together, a longitudinal cross-sectional view of a preferred embodiment of the present invention shown in run-in position. The arrows indicate the flow path of the inflation and valve actuating fluids through each of the concentric flow paths defined through the flow control cross-over assembly during setting of the packers and the opening of gravel packing valve on the housing and the return flow valve within the screen assembly.
Figure 3B:
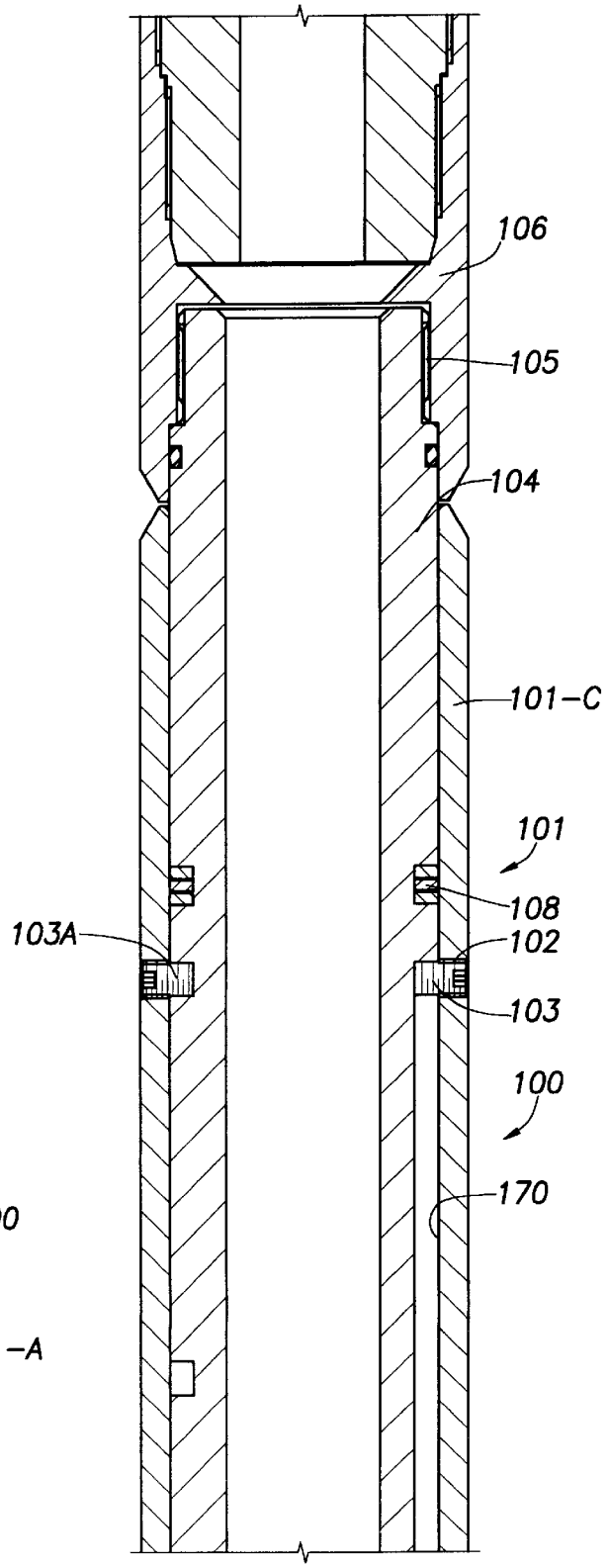
Figure 3C:
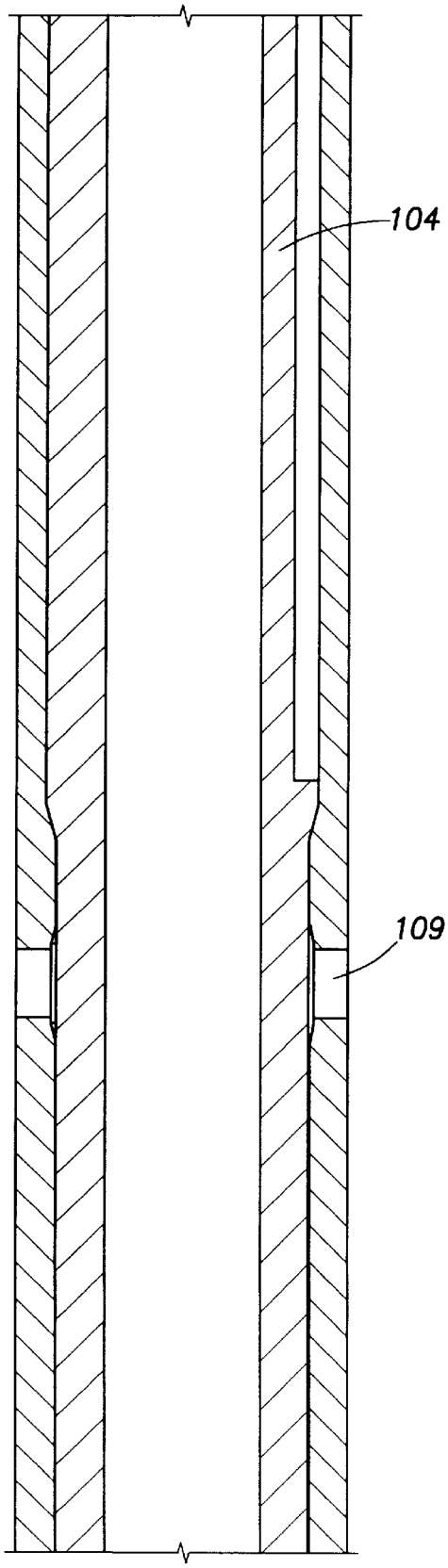
Figure 3D:
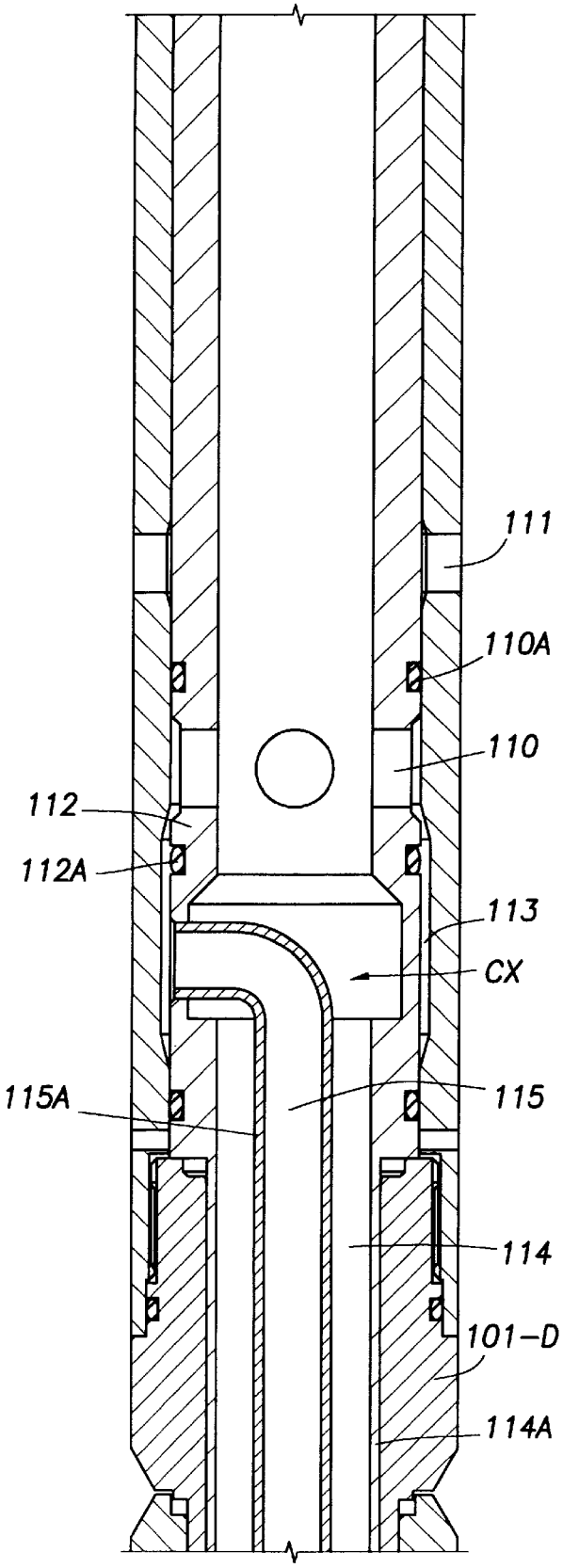
Figure 3E:
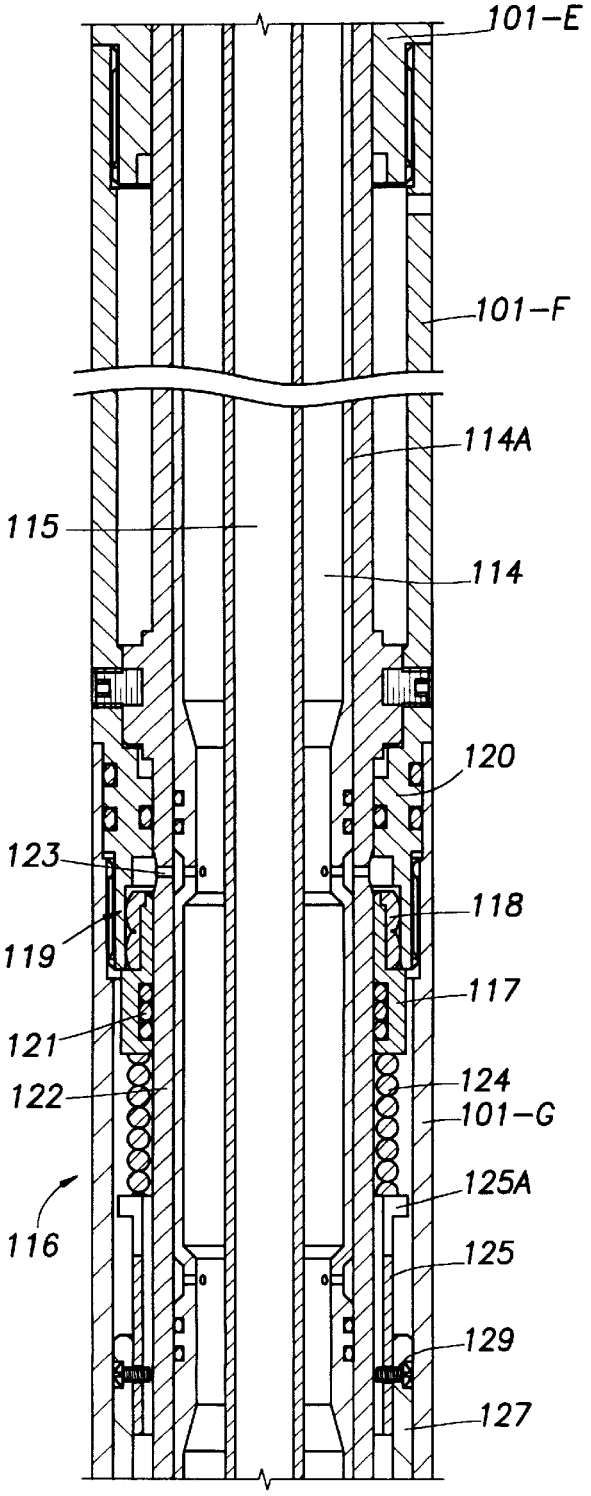
Figure 3F:
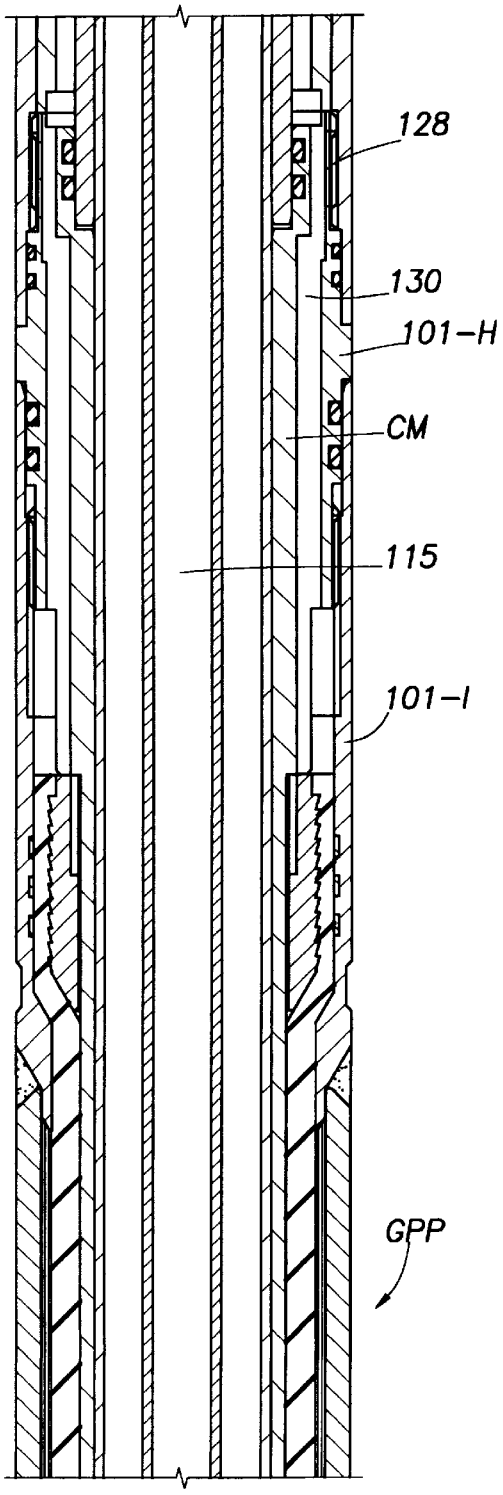
Figure 3G:
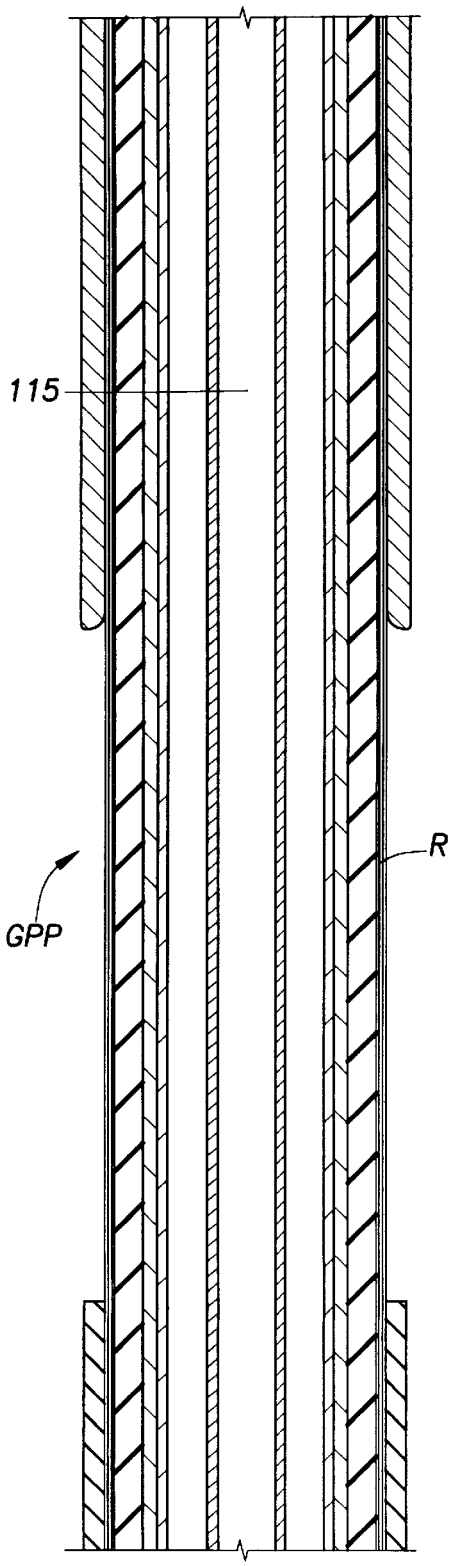
Figure 3H:
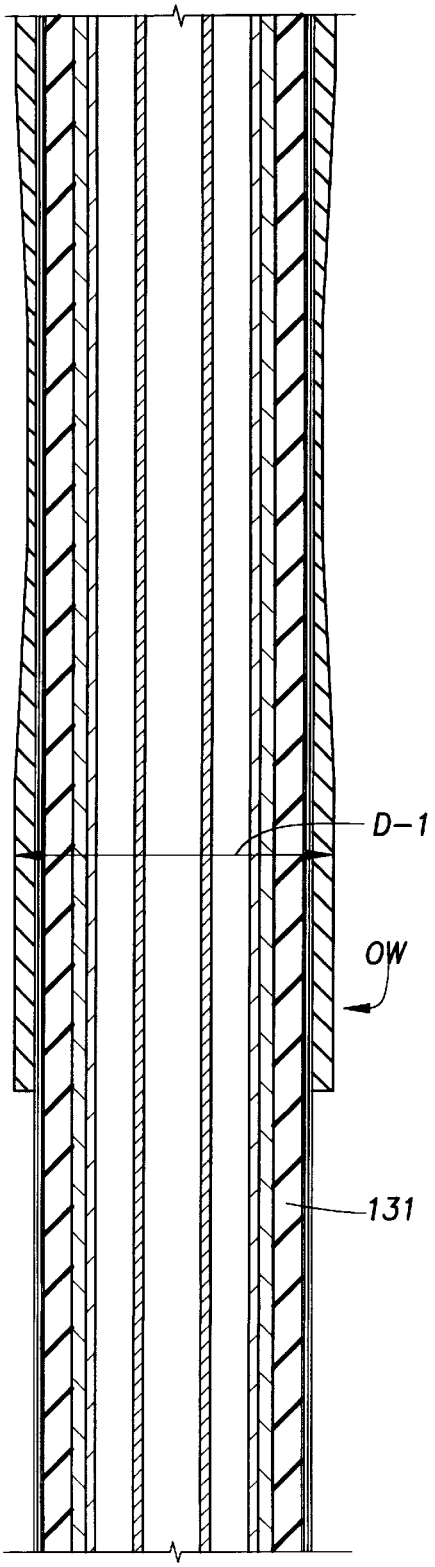
Figure 3I:
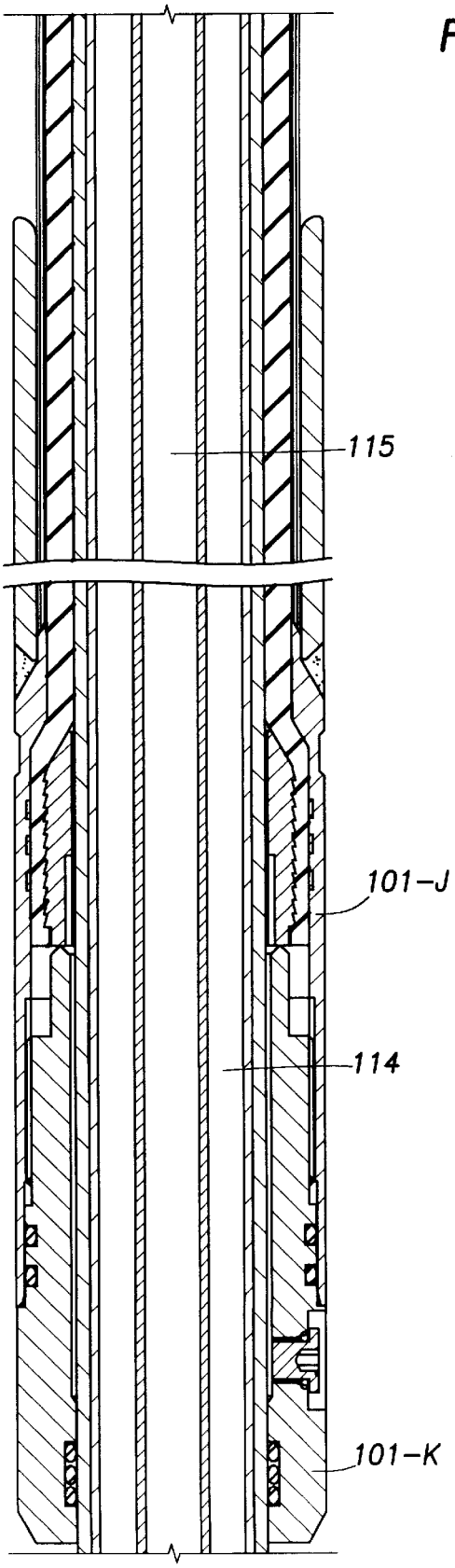
Figure 3J:
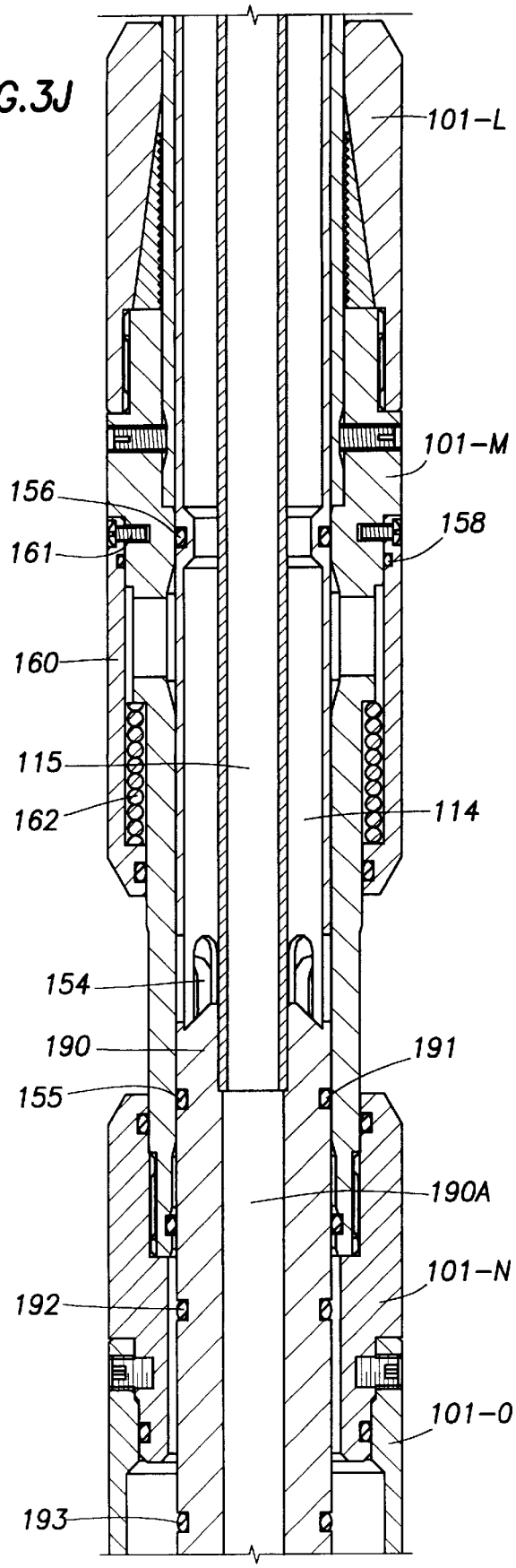
Figure 3K:
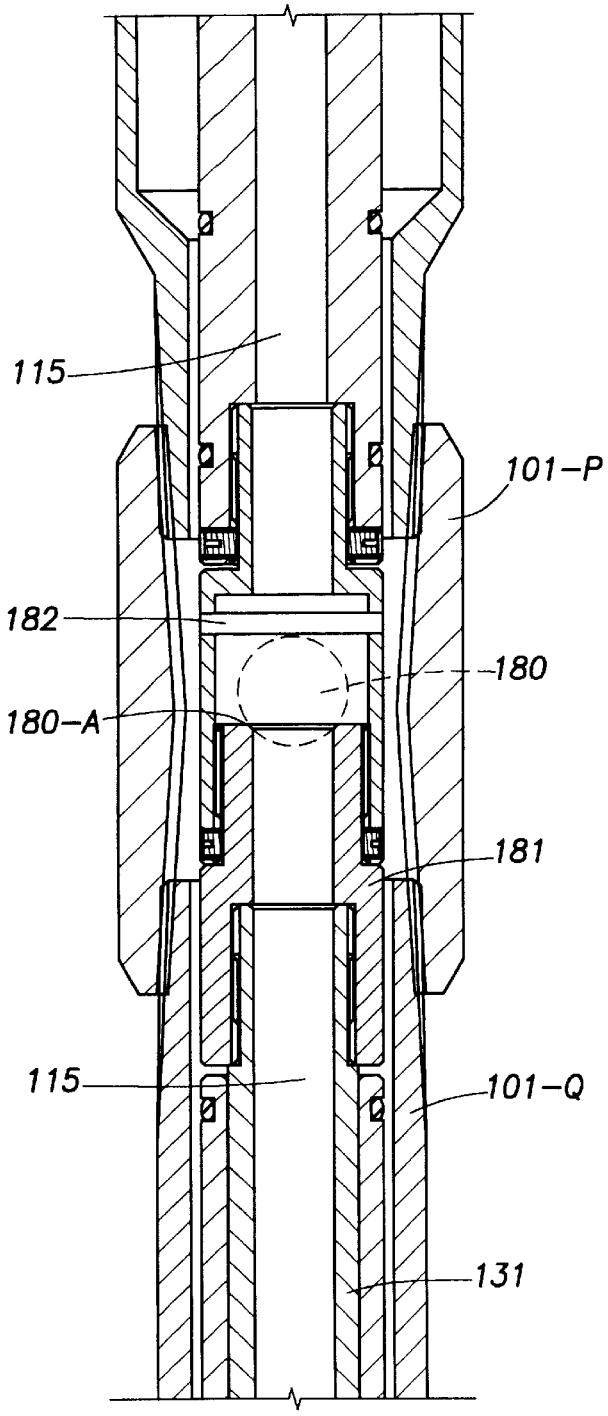
Figure 3L:
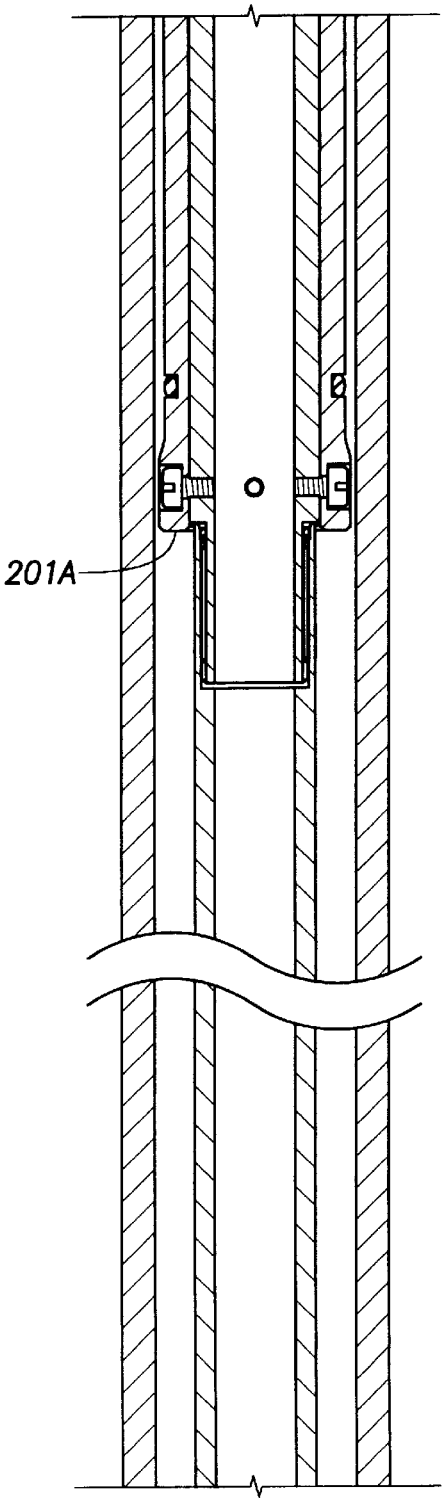
Figure 3M:
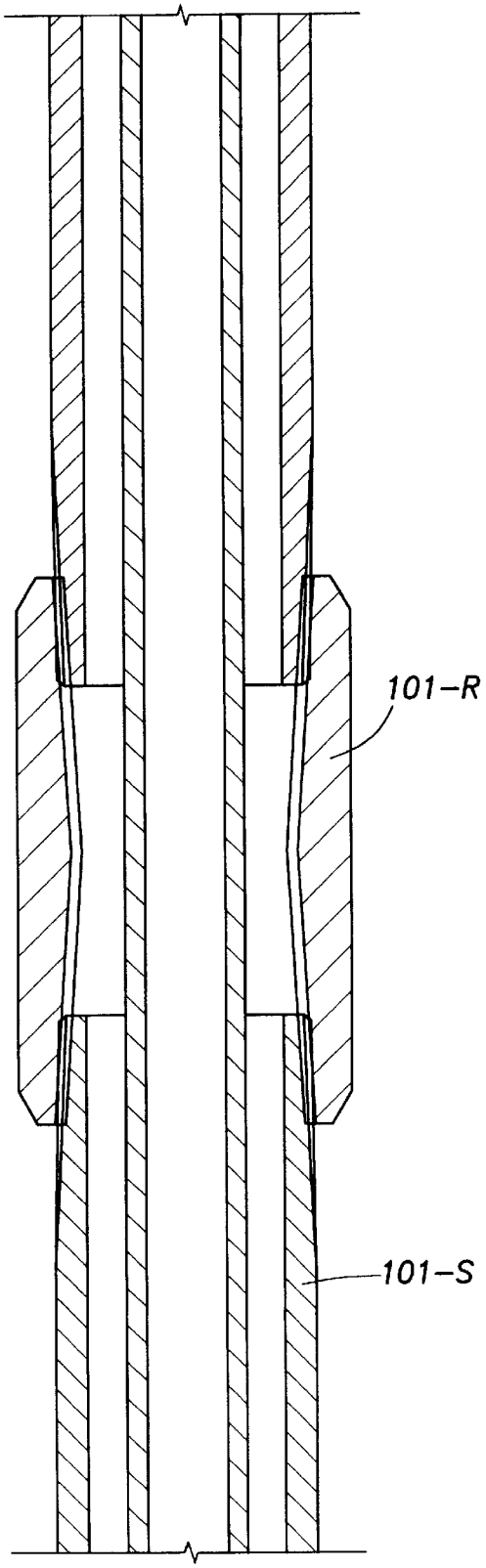
Figure 3N:
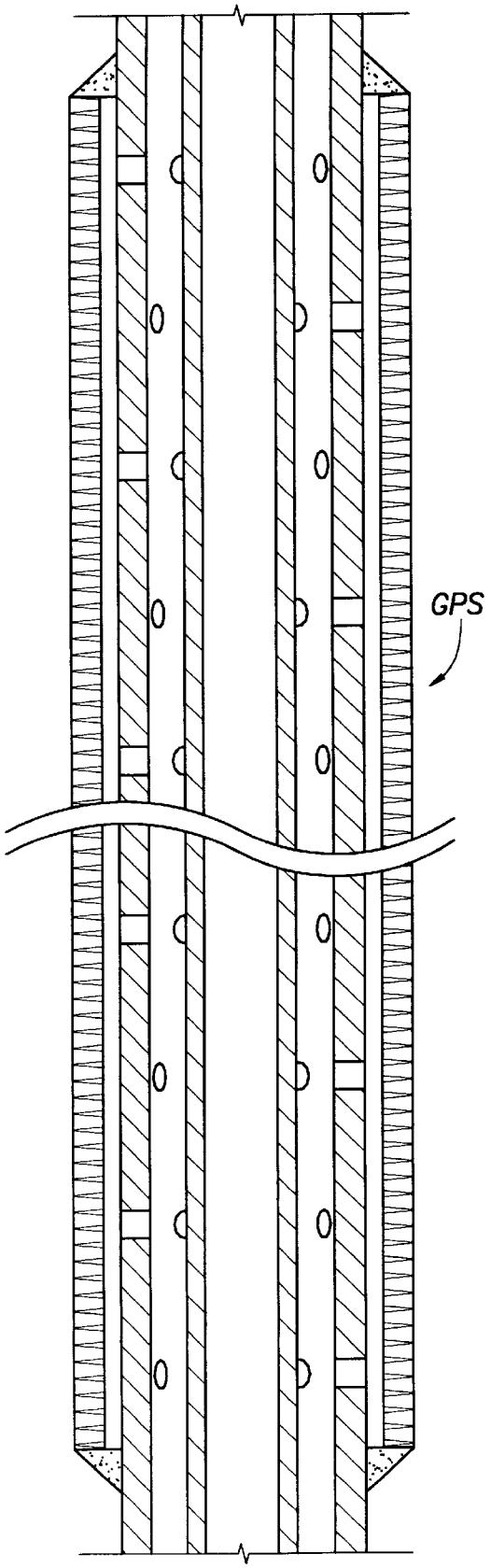
Figure 3Q:
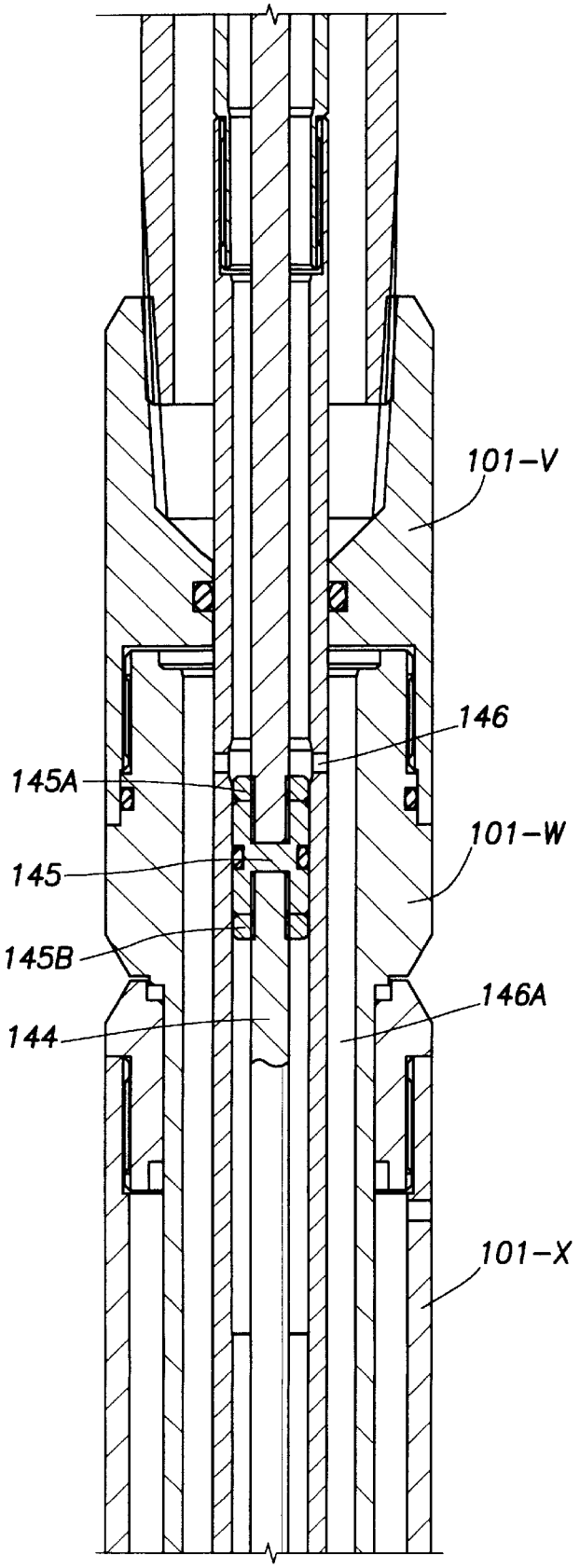
Figure 3R:
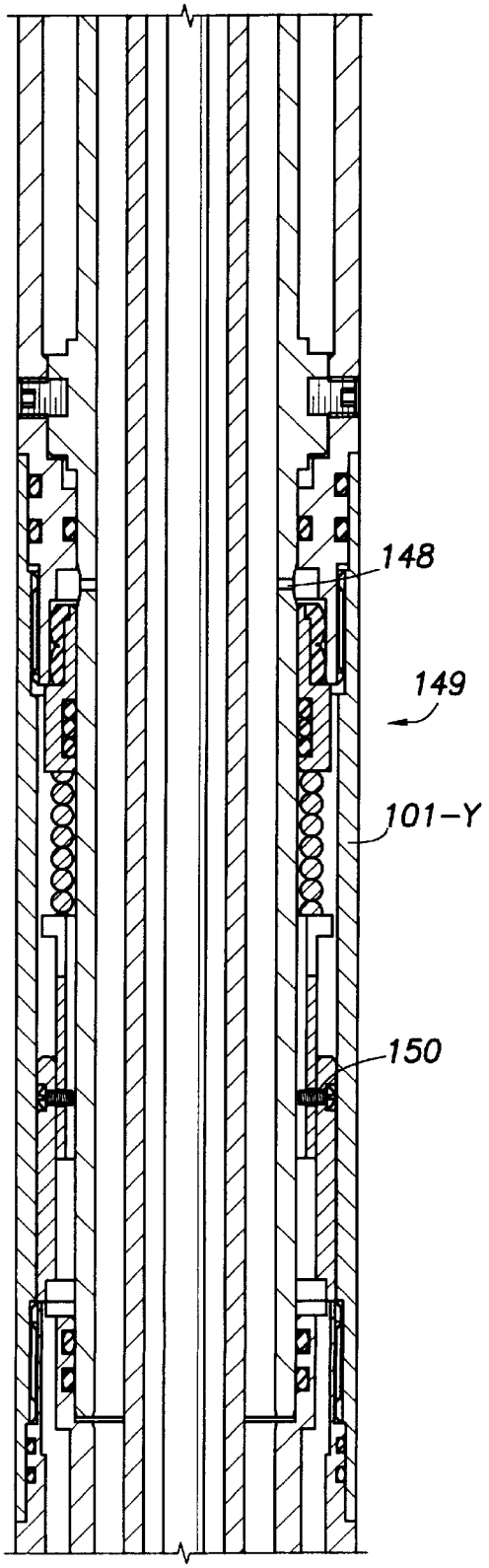
Figure 3S:
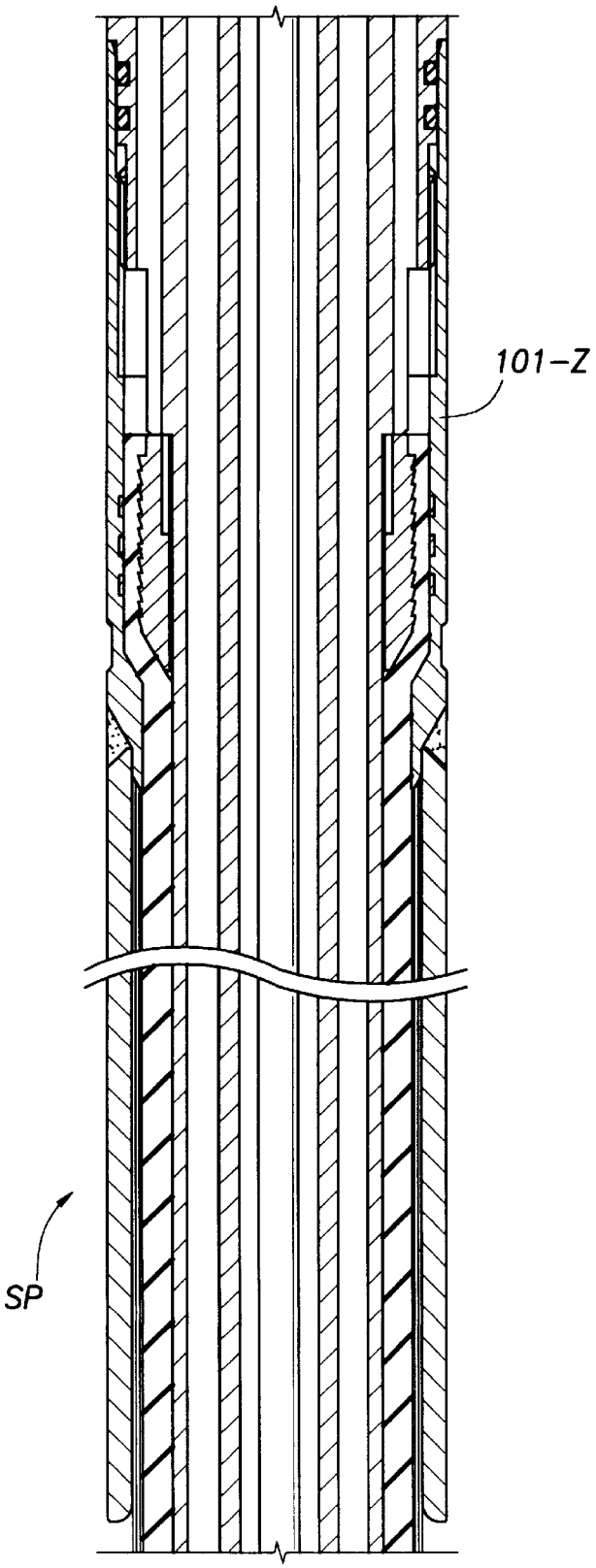
Figure 3T:
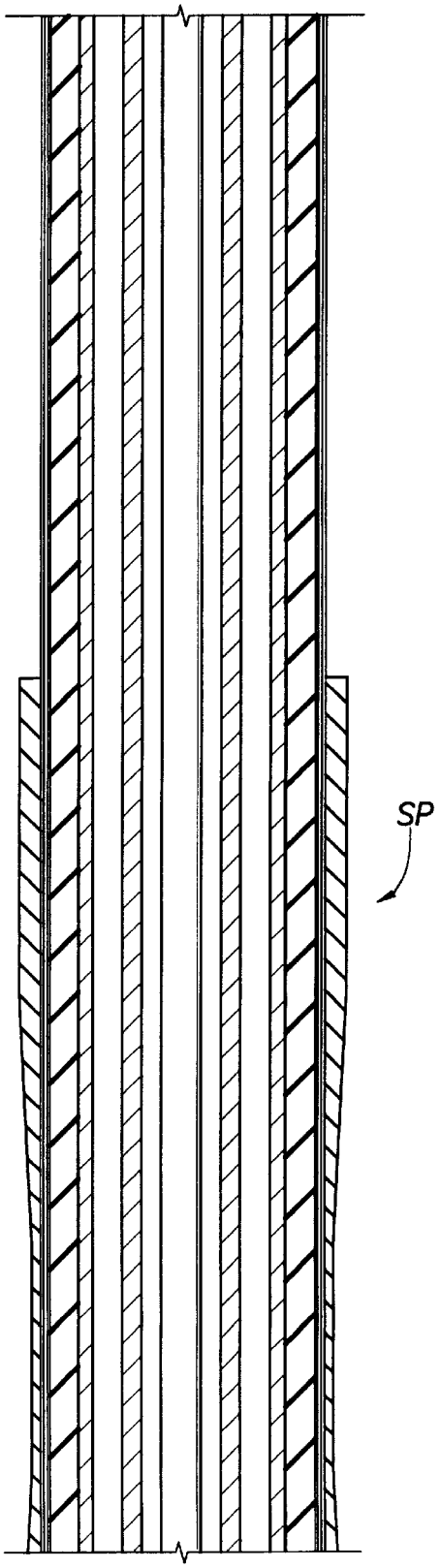
Figure 3U:
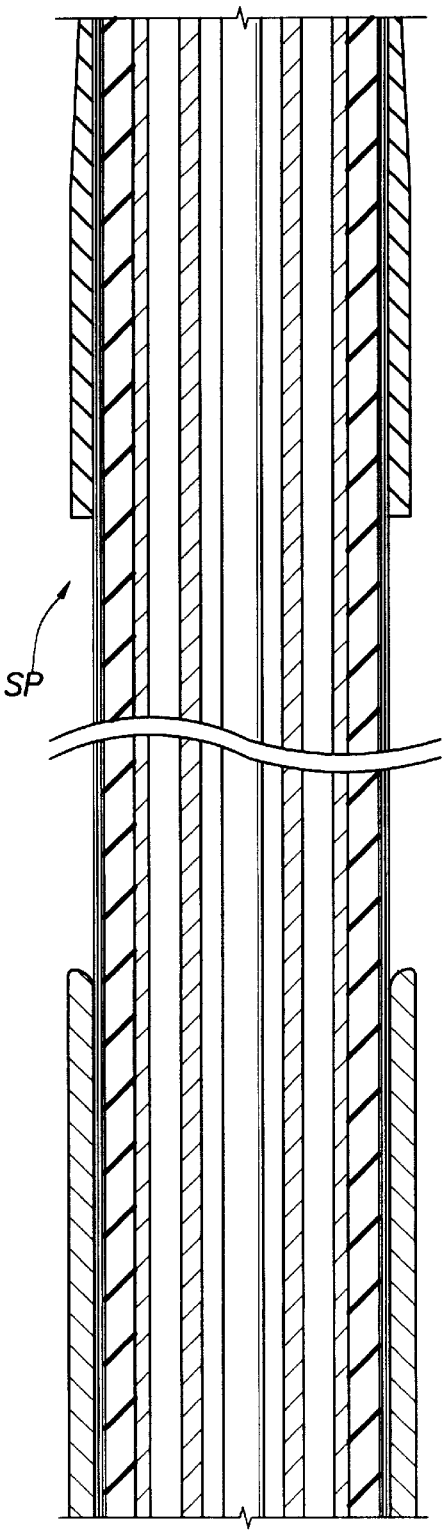
Figure 3V:
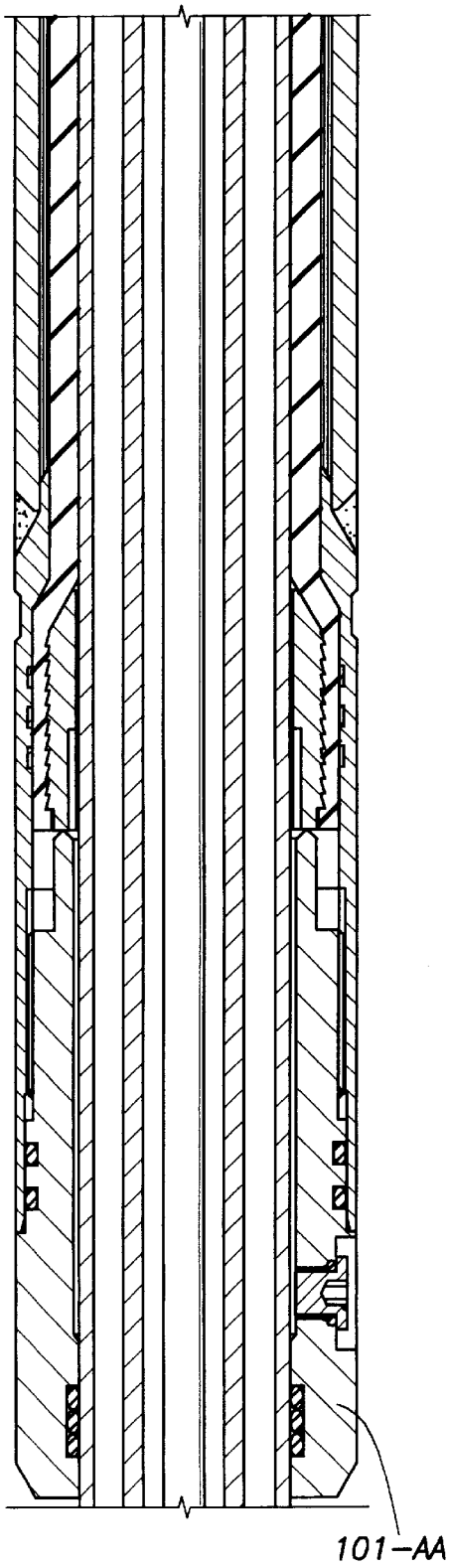
Figure 3W:
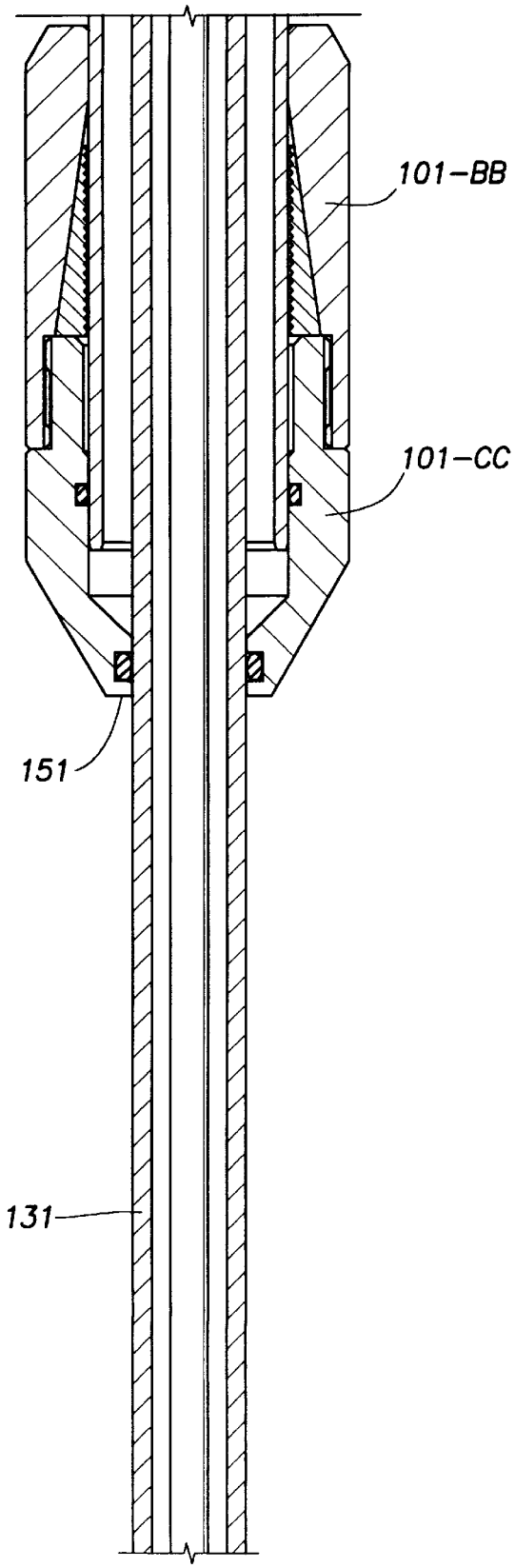
Figure 3X:
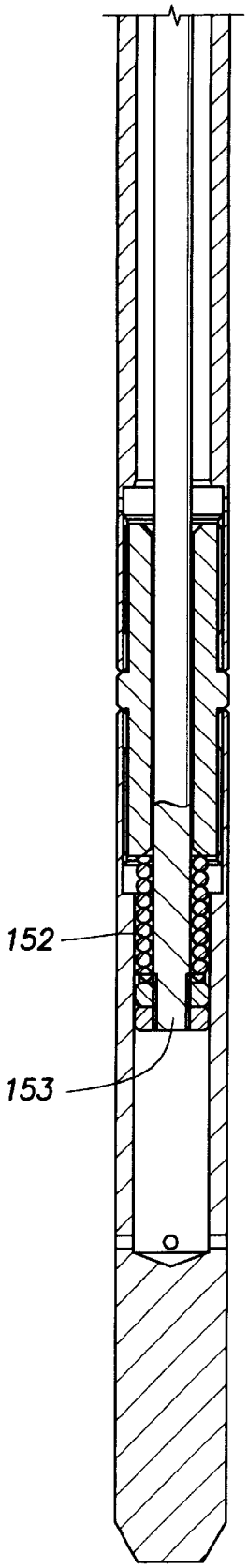

Now referring to FIGS. 3A–3X, the coil tubing CT is secured to the apparatus 100 by a coil tubing connector $CT^1$ of conventional construction. The apparatus 100 is shown having an outer cylindrical housing 101 having interengaged component members 101-C through 101-CC. Housing component 101C has a plurality of bores 102 for receipt of a series of shear screws 103 disposed therethrough and respectively extending into a series of thin grooves 170 defined on a control mandrel 104 extended therein. Disposed 180° offset therefrom is a shear pin 103A which initially, but selectively secures the outer housing 101 and the mandrel 104 in run-in position. The control mandrel 104 is secured by threads 105 to a top sub 106 which, in turn, is secured to a member 101-A and to the coiled tubing connector $CT^1$ at threads 107.

The control mandrel 104 also receives a series of collapsed retainer rings 108 disposed therein which are shown in FIG. 3A in compressed and collapsed position but, as described below, are selectively expandable to retain the control mandrel 104 in a second or extended position relative to the outer cylindrical housing 101 when the housing 101 and mandrel 104 are telescopically extended to a first position (FIGS. 4A–4X) in response to pick up of the coiled tubing CT, for purposes described below.

The outer cylindrical housing member 101-C also includes a series of circumferentially extending reverse circulation ports 109 (FIG. 3C) which, when aligned with ports 110 in the flow control cross-over assembly CX carried on the control mandrel 104 provide a reverse circulation passageway through the apparatus 100 for cleaning of the interior of the apparatus 100 and the coiled tubing CT, as well as the annular area of the well above the set gravel pack packer GPP.

Figure 4A:
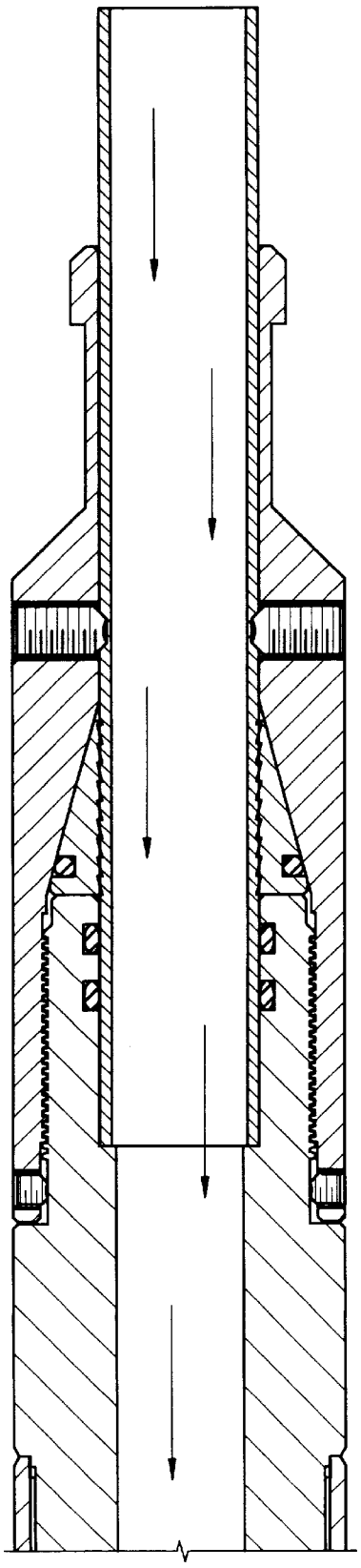
FIGS. 4A–4X are views similar to those of FIGS. 3A–3X, showing the inter-relationship of the various component parts of the apparatus of the present invention subsequent to the setting of the expandable packing elements and the opening of the valve components.
Figure 4B:
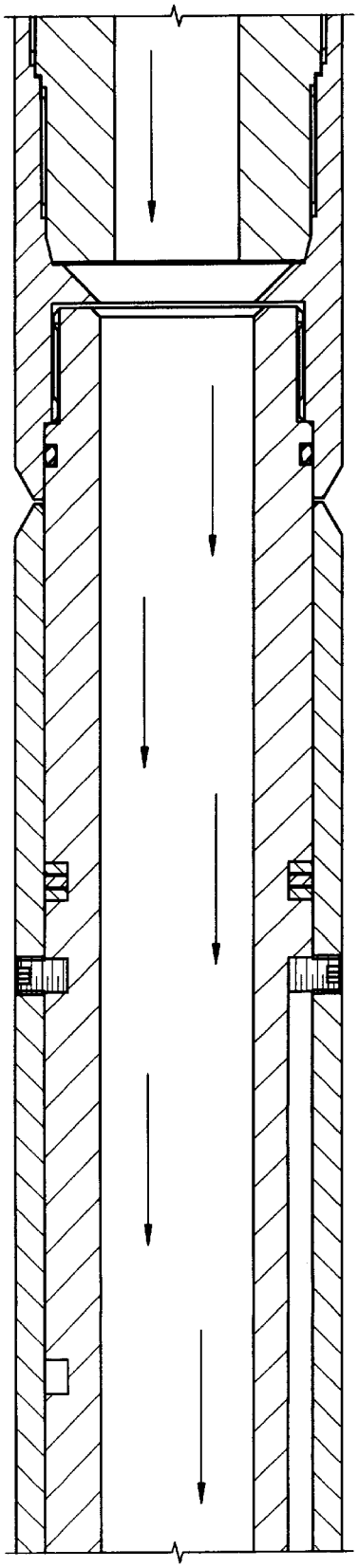
Figure 4C:
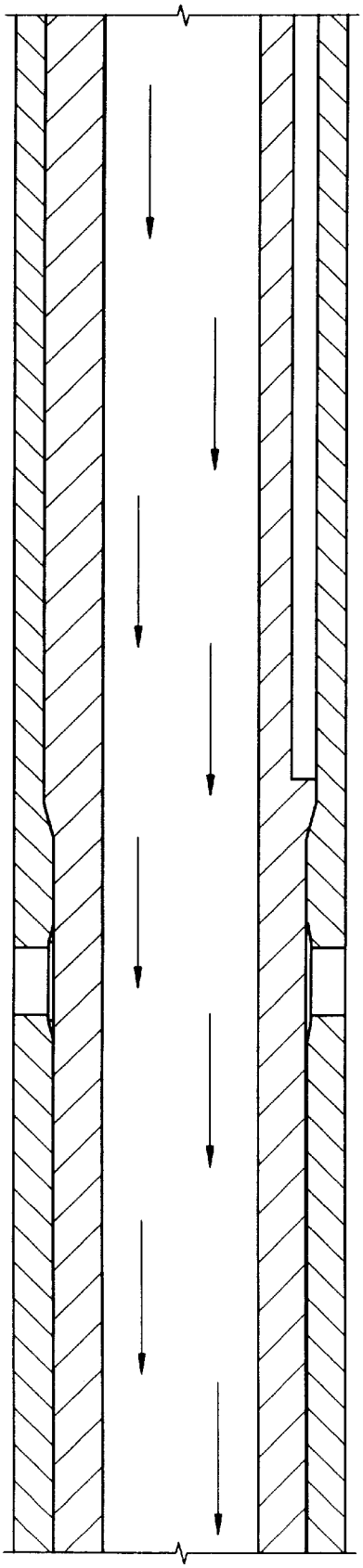
Figure 4D:
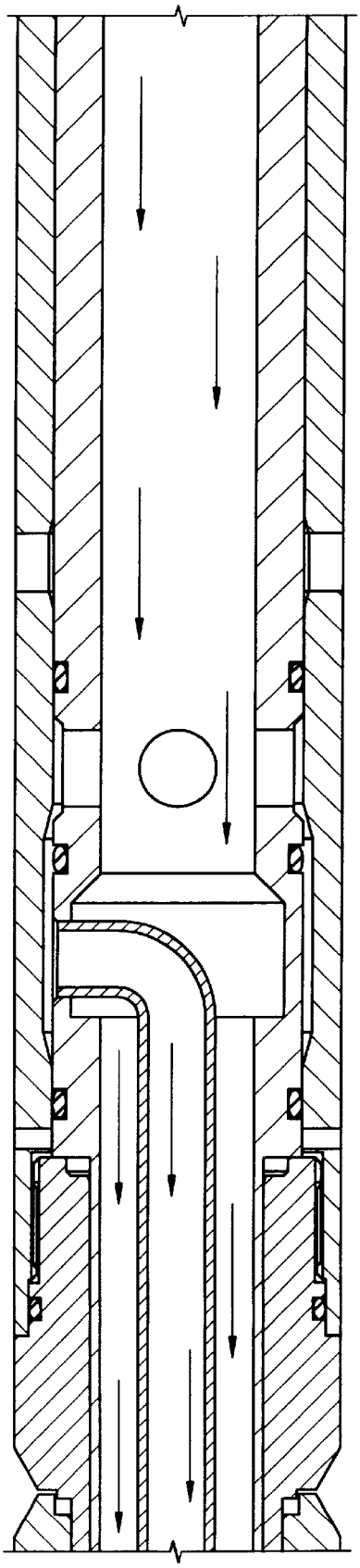
Figure 4E:
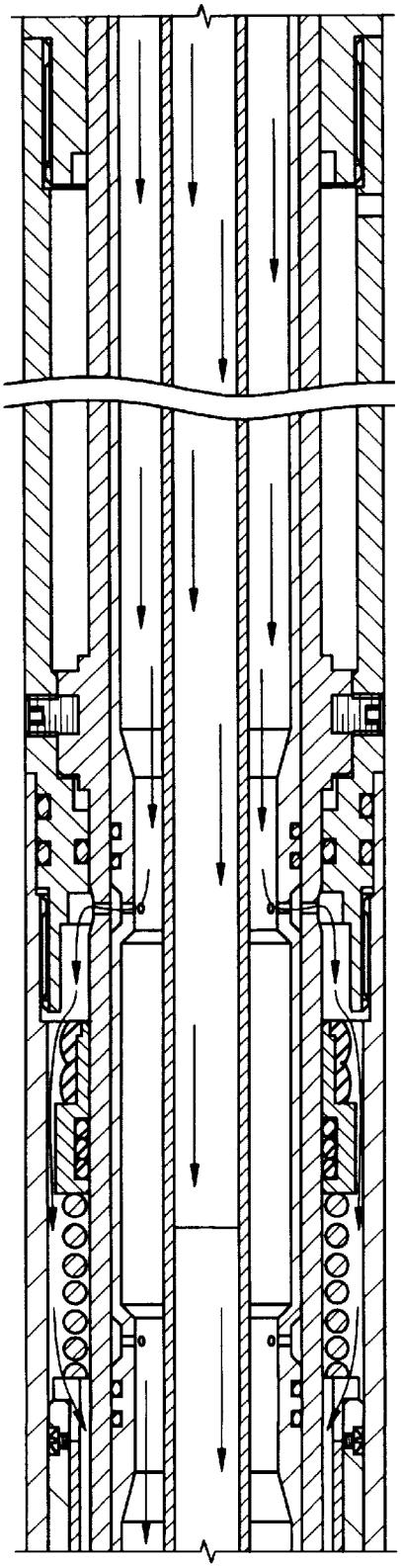
Figure 4F:
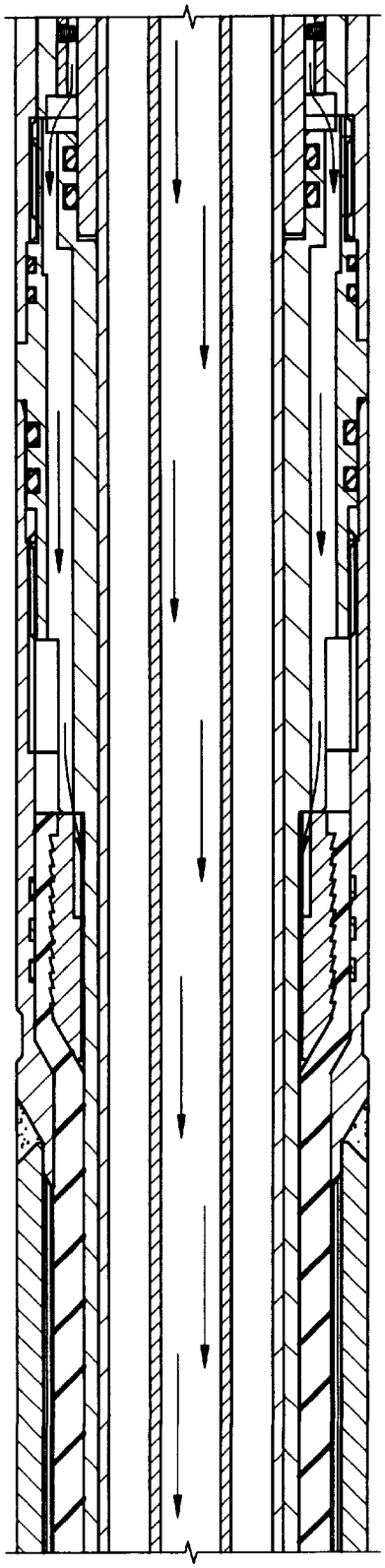
Figure 4G:
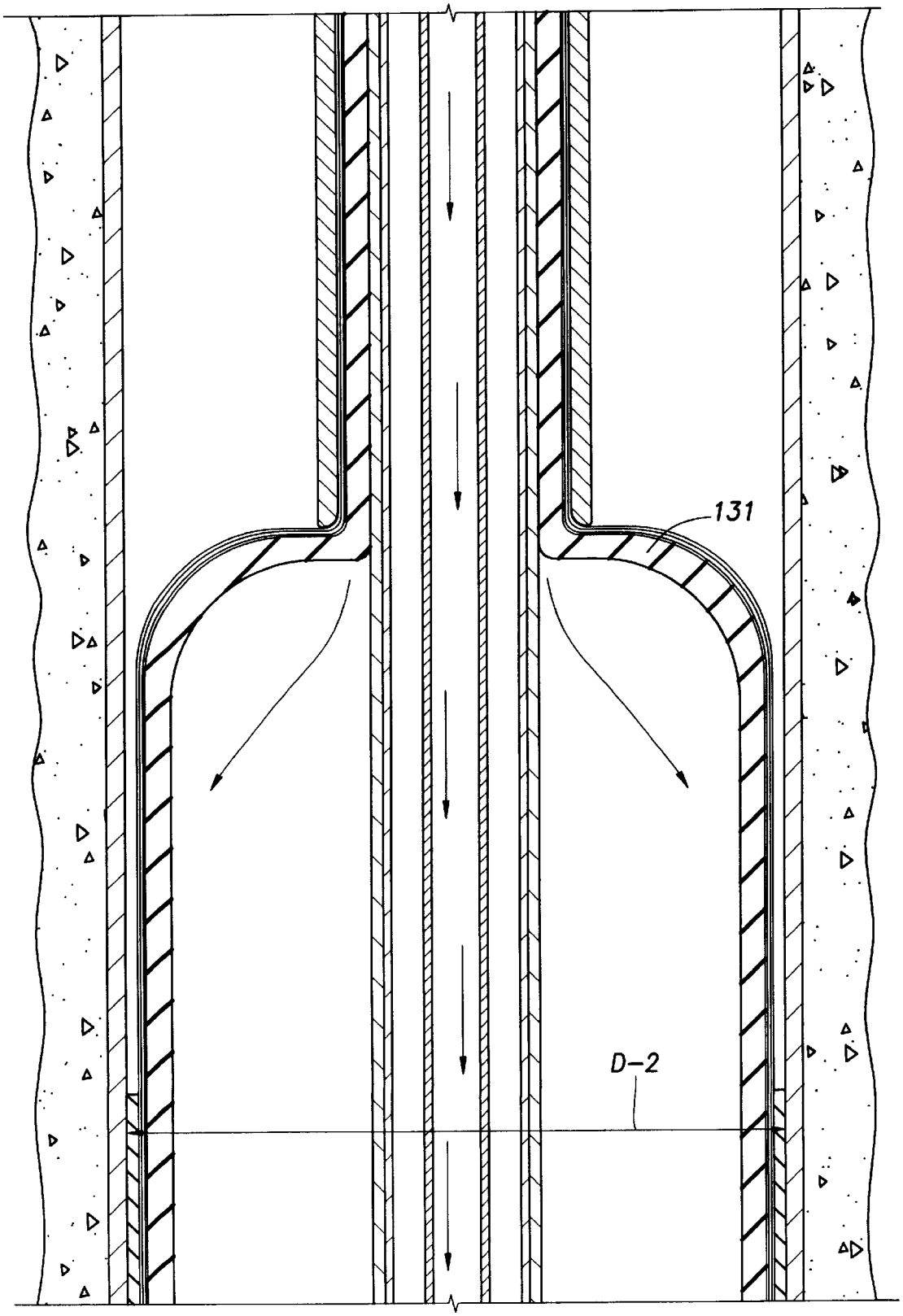
Figure 4H:
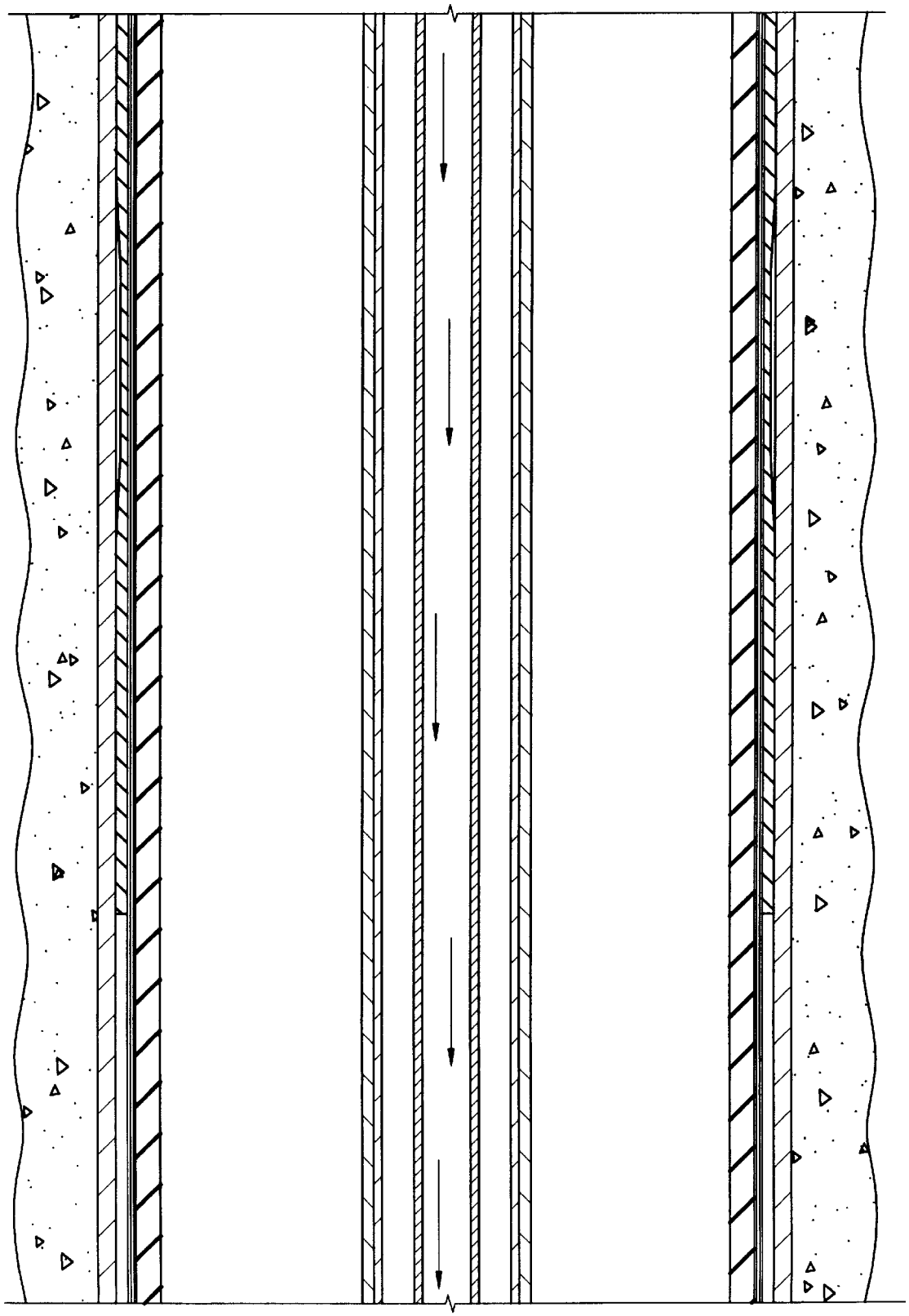
Figure 41:
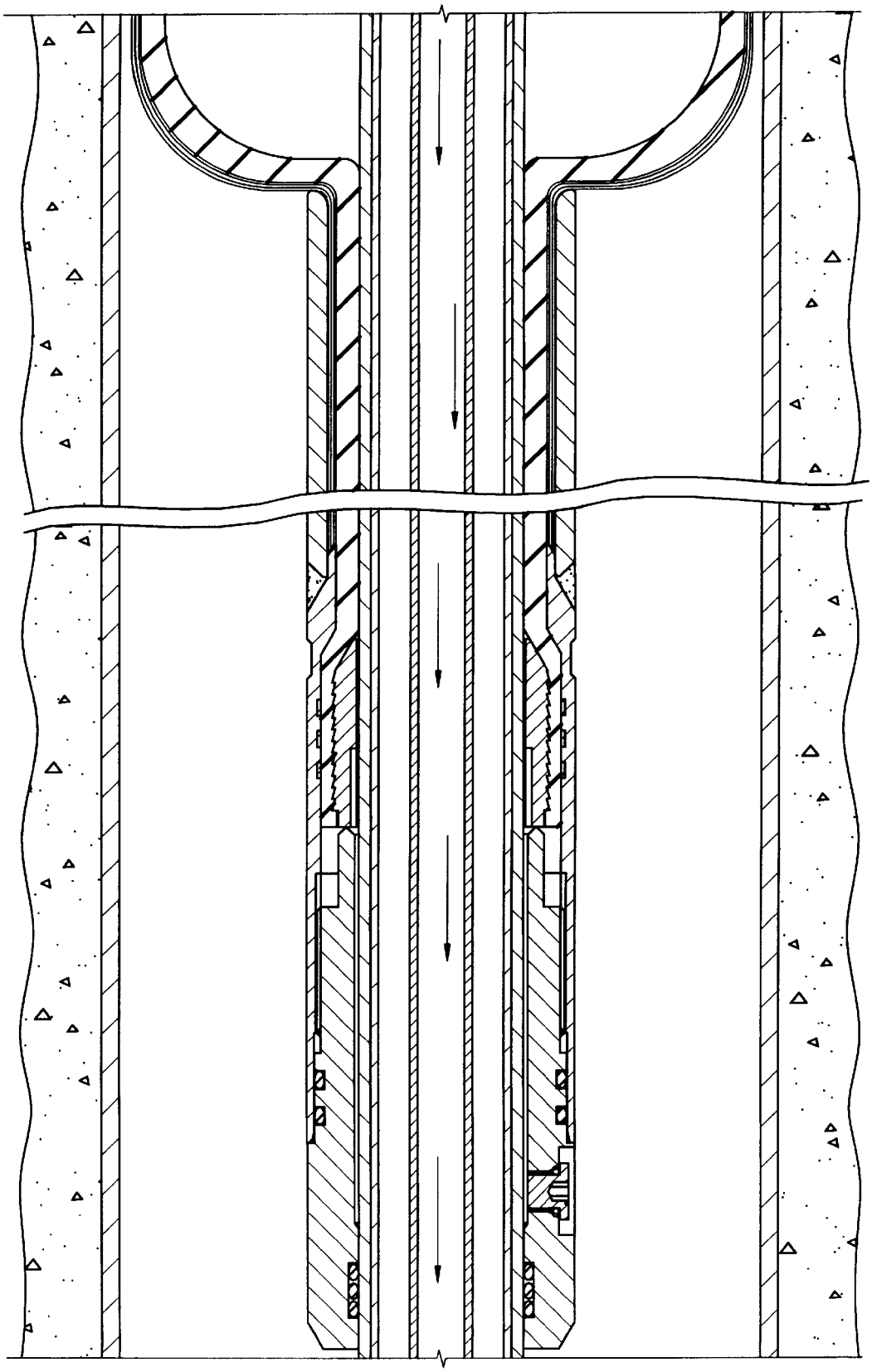
Figure 4J:
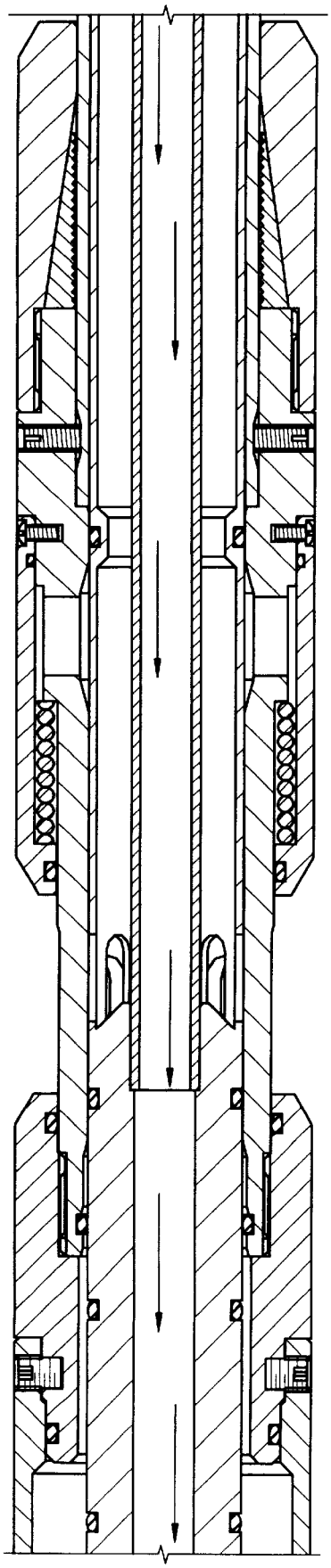
Figure 4K:
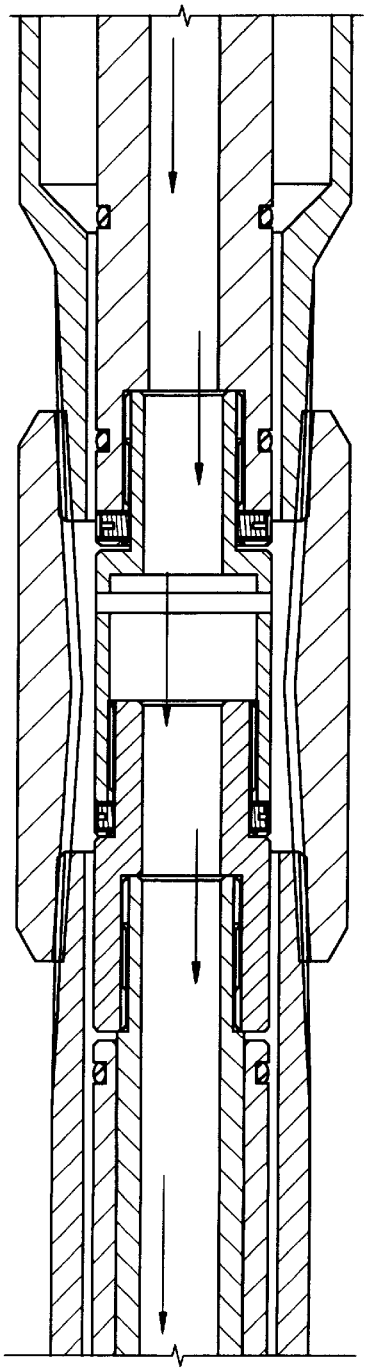
Figure 4L:
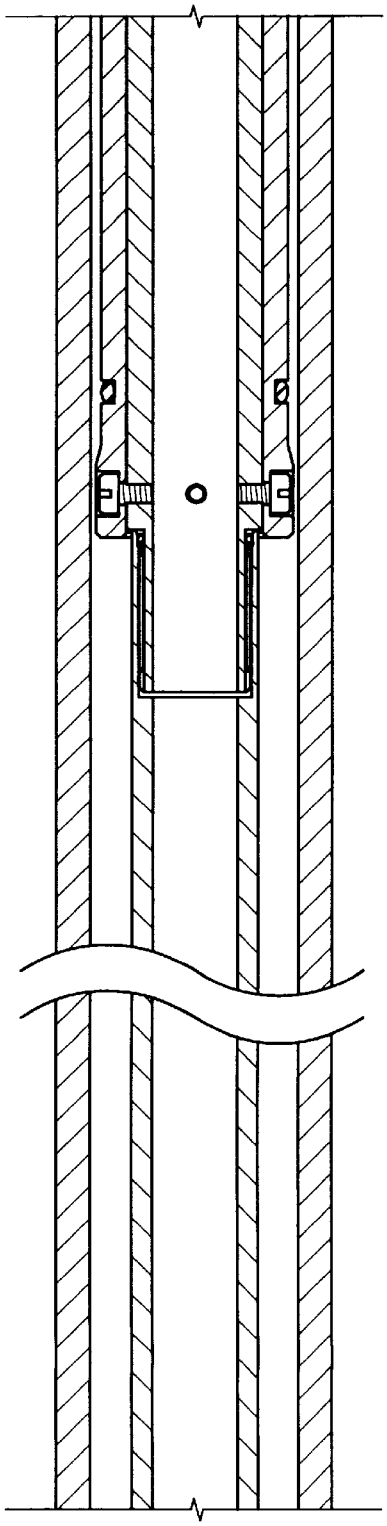
Figure 4M:
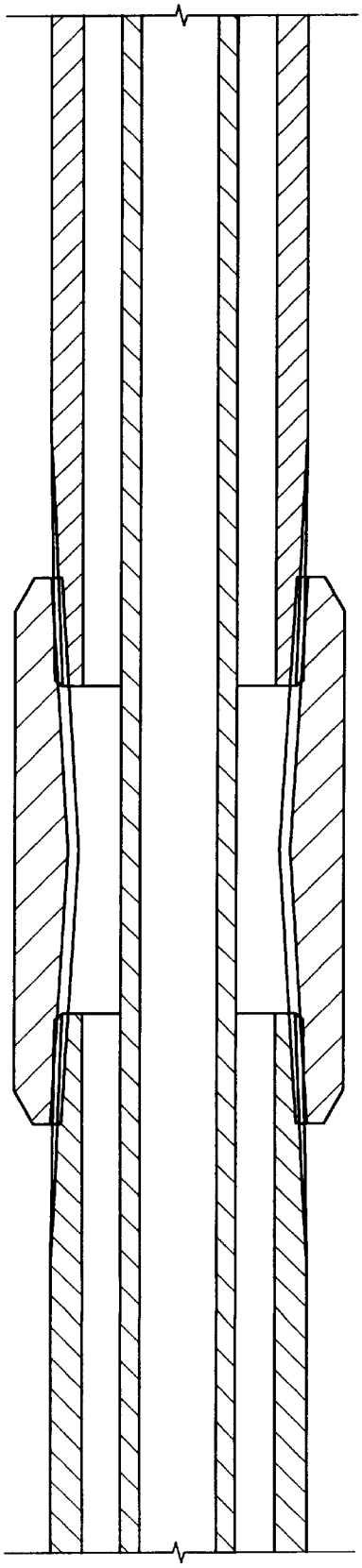
Figure 4N:
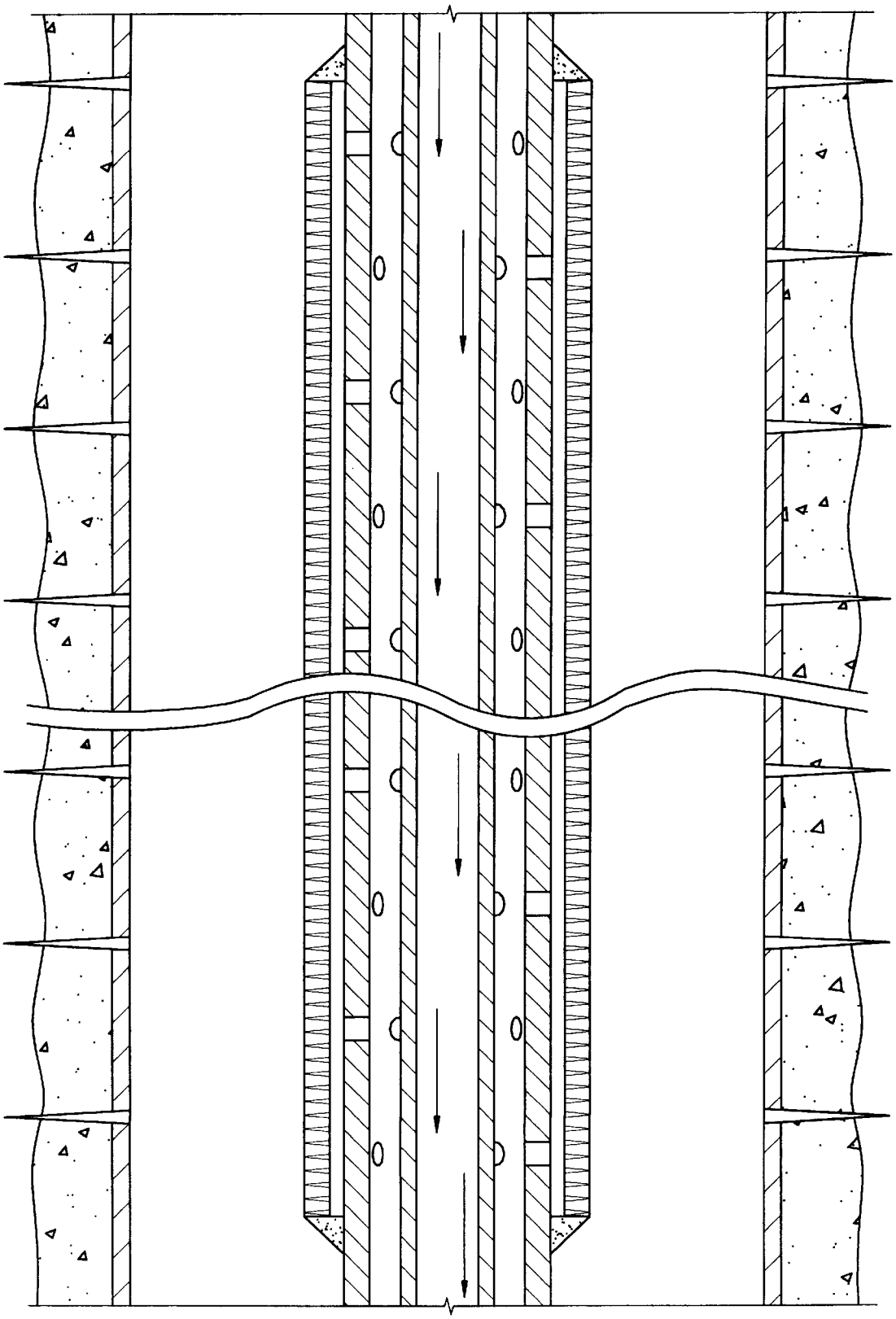
Figure 40:
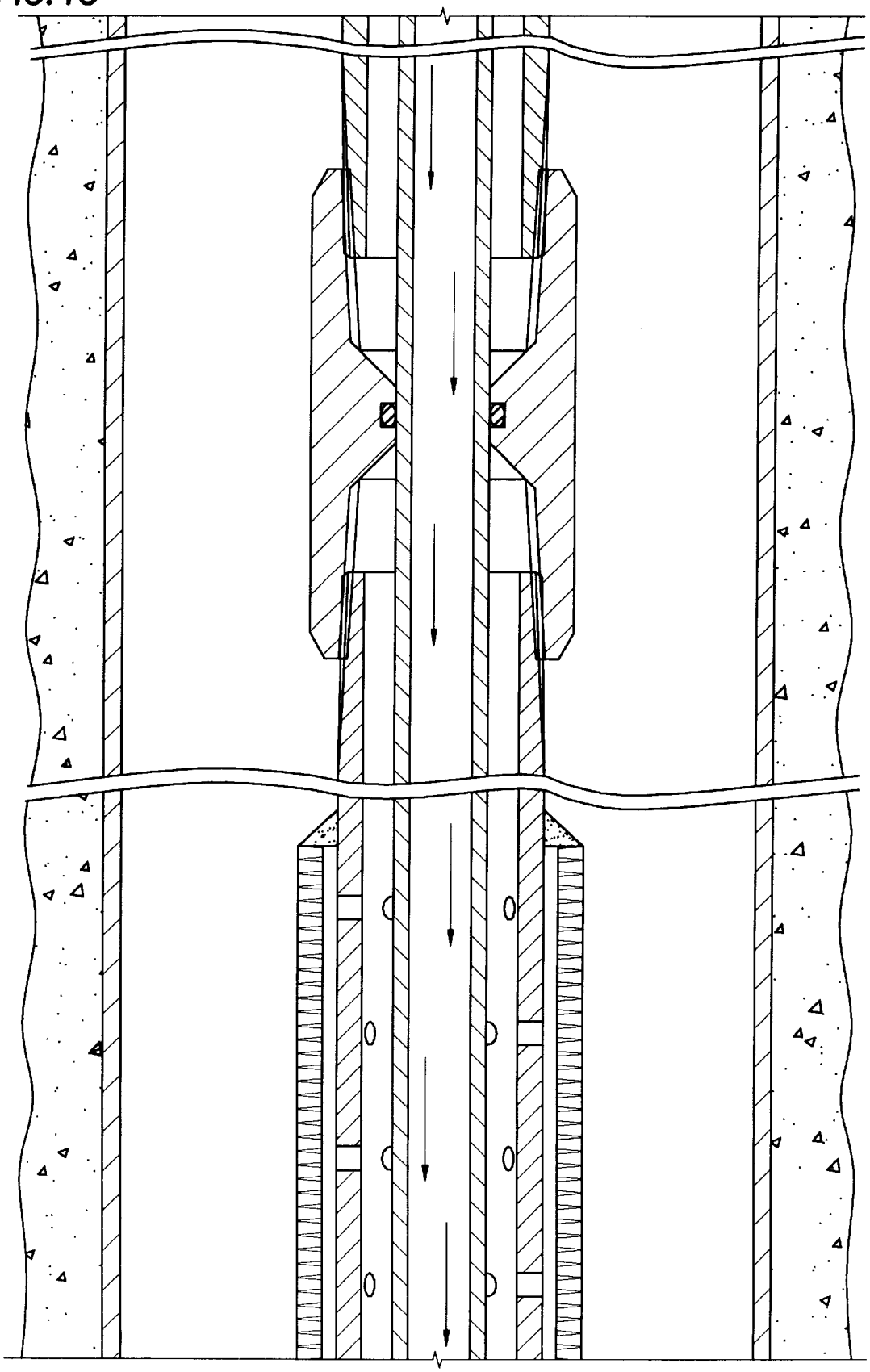
Figure 4P:
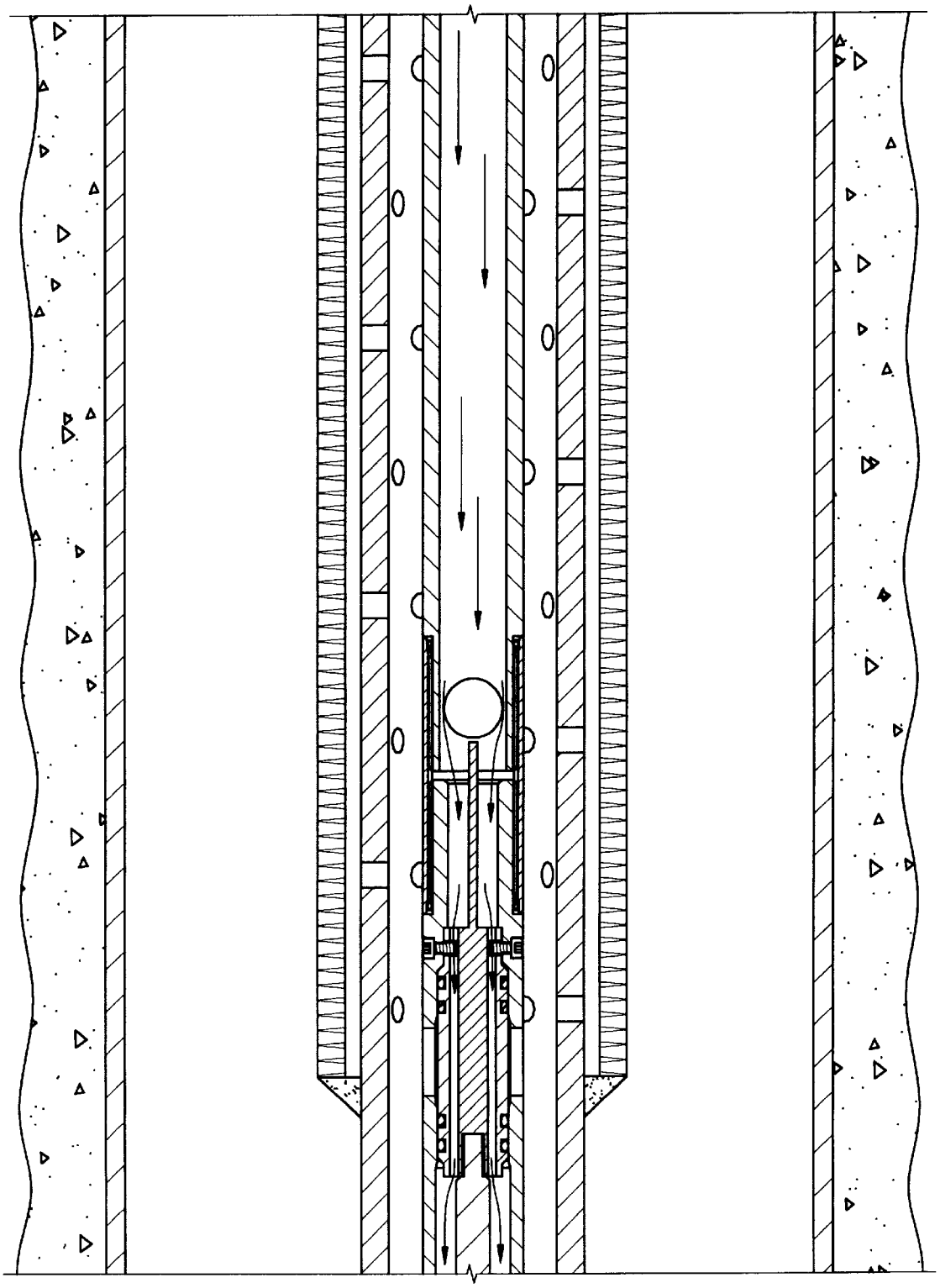
Figure 4Q:
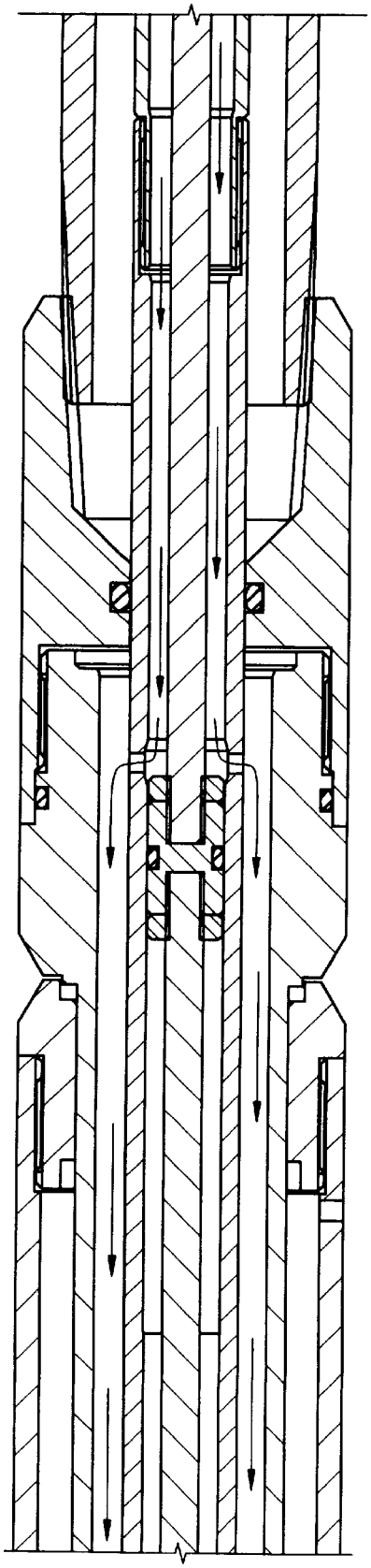
Figure 4R:
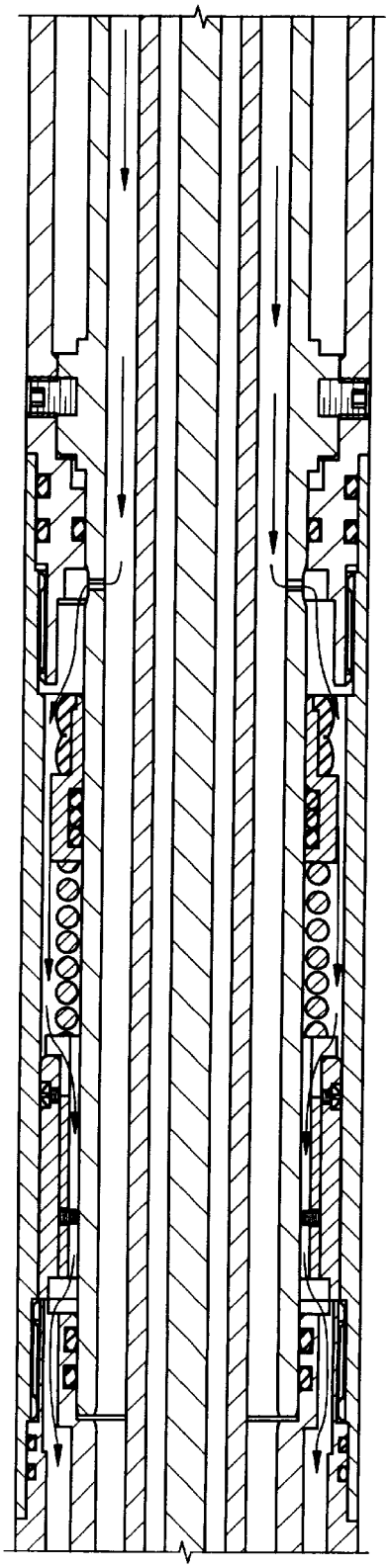
Figure 4S:
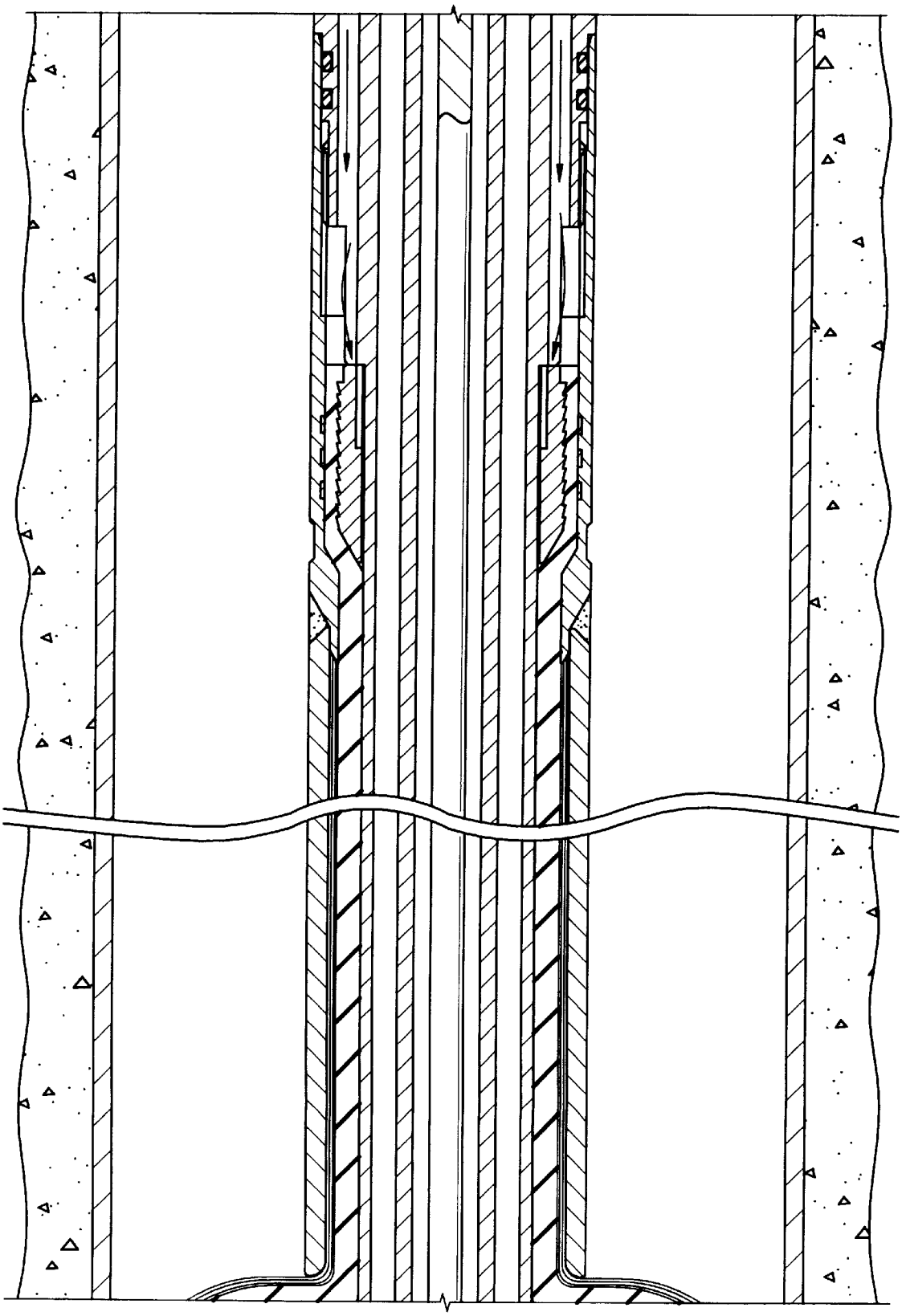
Figure 4T:
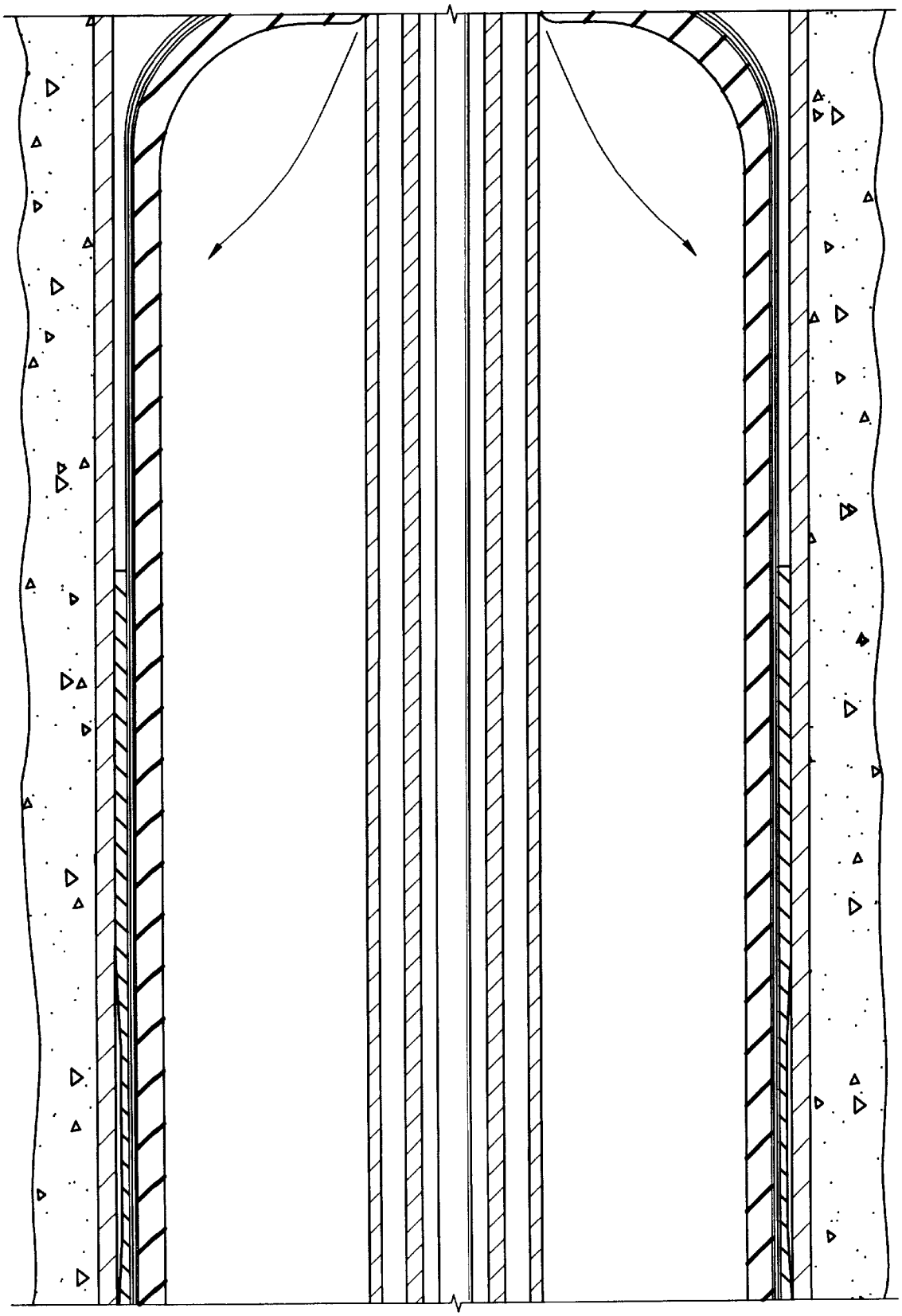
Figure 4U:
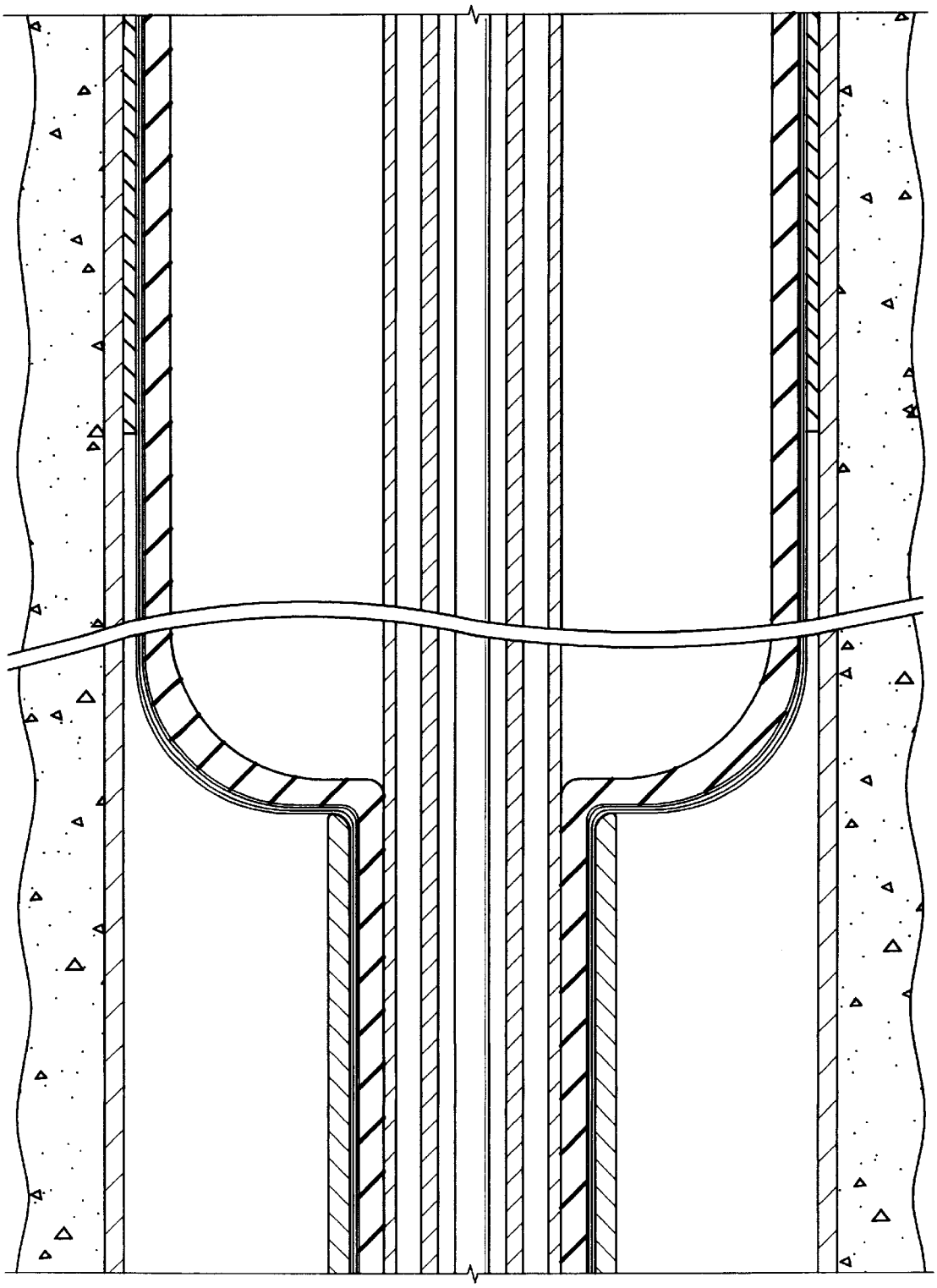
Figure 4V:
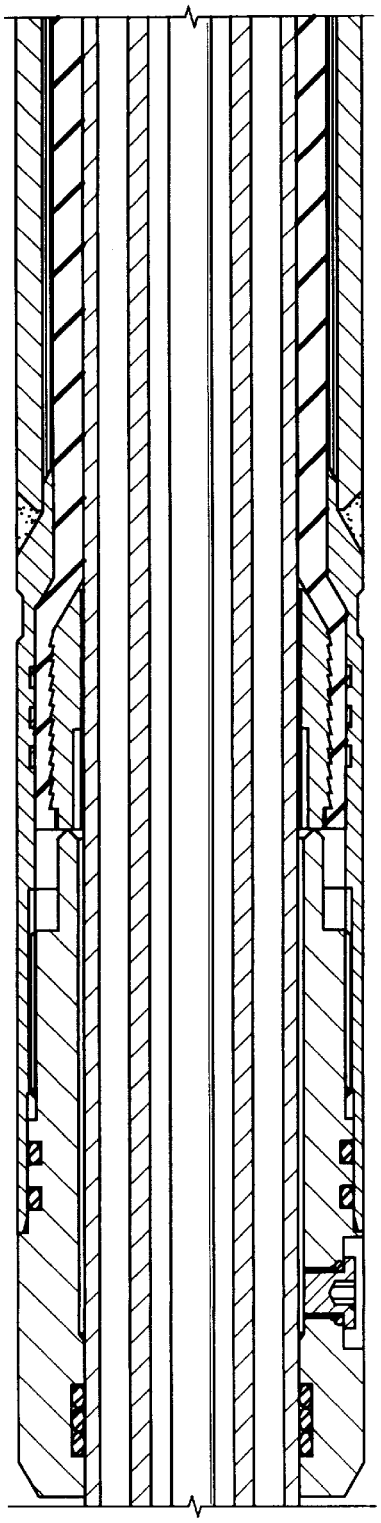
Figure 4W:
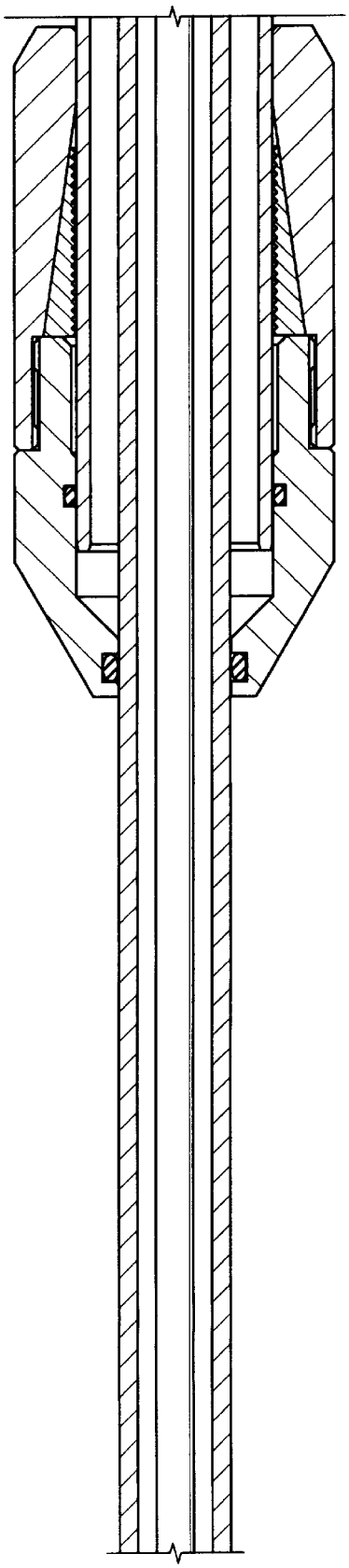
Figure 4X:
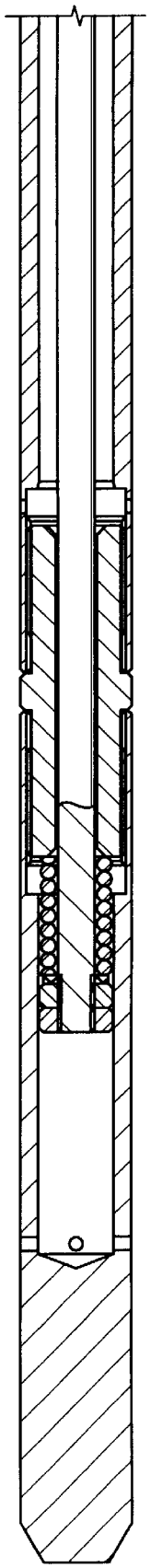

The outer cylindrical housing 101 further includes a second series of circumferentially extending fluid ports 111 which, when aligned with the ports 110 on the flow control cross-over assembly CX provide for returns of clean fluid to the top of the well W. As shown in the run in position in FIGS. 3A–3X, a circumferentially extending elastomeric O-ring seal element 110A is disposed on the control mandrel 104 and seals against the inner wall of the outer cylindrical housing 101 to prevent fluid communication therebetween at that point. The control mandrel 102 also includes an O-ring seal housing portion 112 for receipt of an O-ring 112A therein which, in the position shown, does not seal relative to the outer cylindrical housing 101 because of a fluid flow pathway 113 profiled laterally in relation to the flow control cross-over assembly CX through the outer housing 101 there across. However, when the apparatus 100 is moved to the position as shown in FIGS. 4A–4X, and the position shown in FIGS. 5A–5X, the seal 112A will act in concert with the seal 110A to provide the top opening to a passageway 115 through the cross-over assembly CX for return of fluids to the surface.

The cross-over assembly CX is defined as a tubular member of the control mandrel 102 having concentric passageways 114 and 115 defined therein as provided by outer tubular member 114A and inner tubular wall member 115A. The cross-over assembly CX as described extends longitudinally downwardly within the apparatus 100 on the control mandrel 104 and within the outer housing 101 through a first valving means 116 for transmitting inflation fluid pressure within the coiled tubing CT through the passageway 114 for setting of the inflatable packer identified as a gravel pack packer GPP, and continues downwardly within the outer housing 101 across the gravel port 157 and associated valving assembly. While the outer concentric passageway 114 is blocked by a diverter 190, the inner concentric passageway 115 continues downwardly through a passage 138 in a sleeve 137 (FIG. 3P) of the piston rod assembly 133 interior of the tell-tale screen TTS, thence to the second valving means 149 (FIG. 3R) for actuation of the lower or sump packer SP.

Now referring to FIGS. 3E and 3F, the first valving means 116 includes a poppet assembly 117 having at one end thereof a defined integral elastomeric seal member 118 which, when the poppet is in the closed position during running in of the apparatus 100 and before activation thereof to set the gravel pack packer GPP, seals against a companion bore wall 119 on an outer housing member 120. The poppet 117 also has a series of elastomeric O-ring seal elements 121 which seal against the inner wall of a control mandrel sleeve member 122 having multiple flow ports 123 circumferentially disposed therein communicating with the flow passageway 114 in the housing 114A through the flow control cross-over assembly CX. The upper end of a poppet spring assemblage 124 is in contact with the lowermost end of the poppet 117 for urging the seal member 118 into sealed relationship relative to seal bore 119, with the lowermost end of the poppet spring 124 being biased against a sliding pedestal member 125 having a series of fluted slits 125A therein.

The pedestal member 125 is secured by shear screws 129 to a companion outer housing sleeve member 127 carried within the housing member 101-G which, in turn, is secured by threads 128 to the outer housing member 101-H. The shear screws 129 are disposed between the members 125 and 127 to retain the valving means 116 in closed position, as shown. The passageway 130 defined between the members 122 in the valving means 116 and the outer component parts of the housing 101 thereacross provide a passageway for transmission of fluid pressure to a control mandrel CM in the inflatable gravel pack packer GPP to move same from the initial position as shown in FIGS. 3A–3X to the expanded condition shown in FIGS. 4A–4X.

The inflatable gravel pack packer GPP has an outer wall OW (FIG. 3A) having an outer diameter D-1 when it is in the initial retracted and run-in condition, as shown in FIGS. 3A–3X, and when in the expanded condition as shown in FIGS. 4A–4X and 5A–5S, will have an outer diameter D-2 (FIG. 4G) at least twice that of the outer diameter D-1.

The gravel pack packer GPP has a series of exposed rib elements R (FIG. 3G) thereon which assist in setting or anchoring the gravel pack packer GPP and maintaining it in set position as shown in FIGS. 4A–4X. The gravel pack packer GPP continues below the exposed ribs with an inflatable element 131 thereon (FIGS. 3H and 4G).

As described previously in the SUMMARY OF THE INVENTION, it is not necessary that the apparatus 100 include a sump packer SP thereon, but if such sump packer SP is so provided, it is defined by a second inflatable elastomeric packer and is set prior to the gravel pack packer GPP by inflation fluid pressure which is carried through the apparatus 100 within the cross-over assembly CX and in communication with the inner concentric tubing flowpath 115 through the first valving means 116 and interior of the gravel pack packer GPP.

In the event that a sump packer SP is not utilized or incorporated into the apparatus 100 as shown, the passageway 115 may be blocked by provision of a ball 180 which may seal against a companion seat 180A on a ball sleeve housing 181 on the control mandrel 104 or by use of similar means at some point within the passageway 115. (See FIG. 3K). A bar 182 bridges across the interior of member 181 to provide a cage against upward travel of the ball 180.

The passageway 115 for the setting of the sump packer SP is defined below the inflatable element 130 within a washpipe 131 which is an extension of tubing defining the passageway 115 within the inflatable element 130 and is secured to the tubing 115A defining the cross-over passageway 115 within the cross-over assembly CX. The washpipe 131 is secured at threads 132 to the top of a piston rod assembly 133, which, in turn, includes a cylindrical housing 134 with flow ports 135 disposed therethrough for receipt of the gravel carrier fluid during return of such fluid subsequent to depositing of the gravel exterior of the tell-tale screen TTS, and gravel pack screen GPS as described hereafter. A series of shearable screw members 136 are received within the housing 134 and extend to selectively engage a piston sleeve member 139 disposed within the housing 134. The piston sleeve member 139 has a series of seal elements 138A and 138B which straddle the ports 135 when the shear screws 136 are engaged to maintain the sleeve 137 in closed or run-in position.

It will be appreciated that the shear value of the pins or screws 136 will be higher than those in the valving means 149 and the valving means 116 associated with the gravel pack packer GPP, to assure that same permit pressure transmission to completely set the packers before the ports 135 or the ports 157 are opened.

The piston sleeve 137 also has defined therethrough a plurality of longitudinally extending fluid passageways 138 which are in communication with the passageway 115 through the cross-over tool CX for continued transmission of fluid pressure within the piston rod assembly 133 through the housing 134.

The sleeve 137 also receives the lowermost end 140 of a solid wire or rod component 141 which prevents a floating check ball 142 carried within the washpipe 131 from sealing against a ball seat 143 defined at the upper most end of the piston rod housing 134 during the packer setting operation.

Figure 5A:
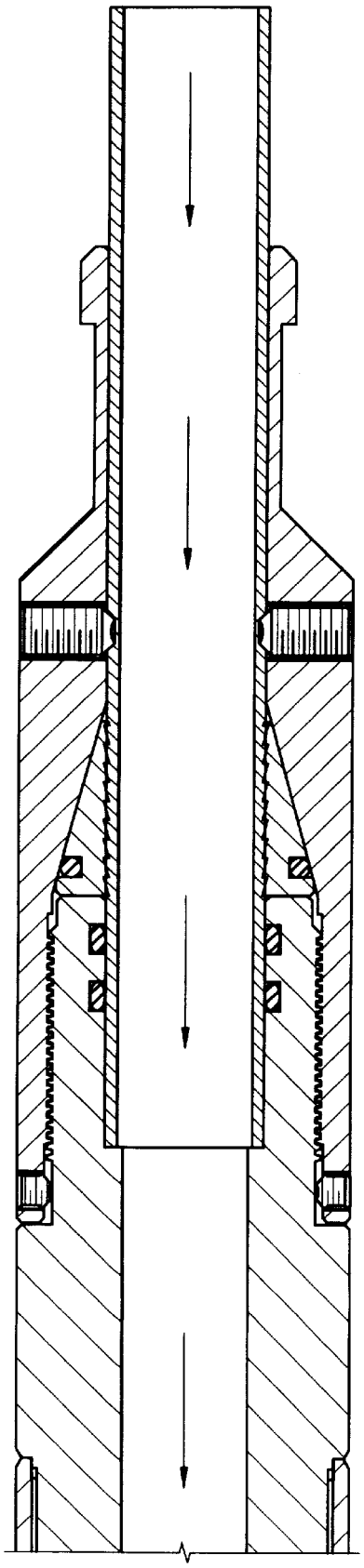
FIGS. 5A–5S show the apparatus shifted to a first telescopically expanded position for gravel packing. The arrows show the flow path of gravel in a carrier fluid being carried through the cross-over assembly for deposition below the gravel pack packer exterior of the screen with returns through another of the concentric flow passageways through the flow control cross-over assembly and then outwardly of the device to the top of the well.
Figure 5B:
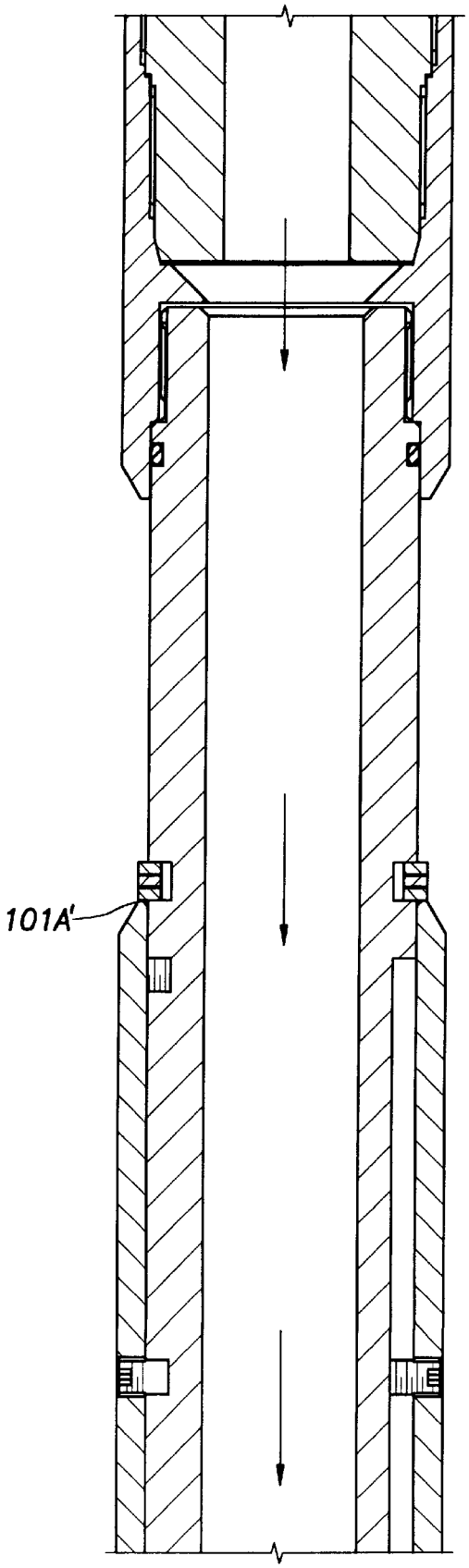
Figure 5C:
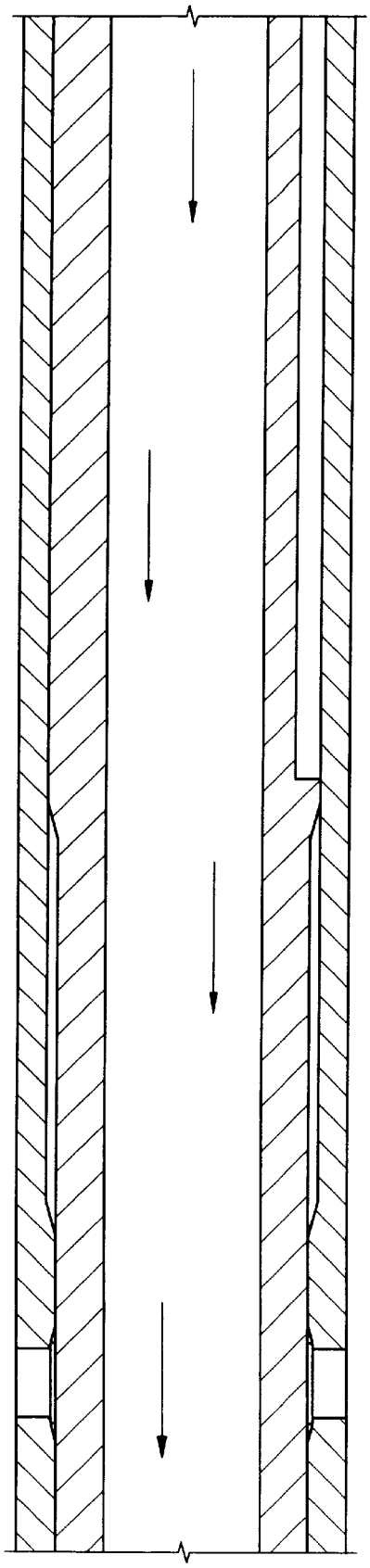
Figure 5D:
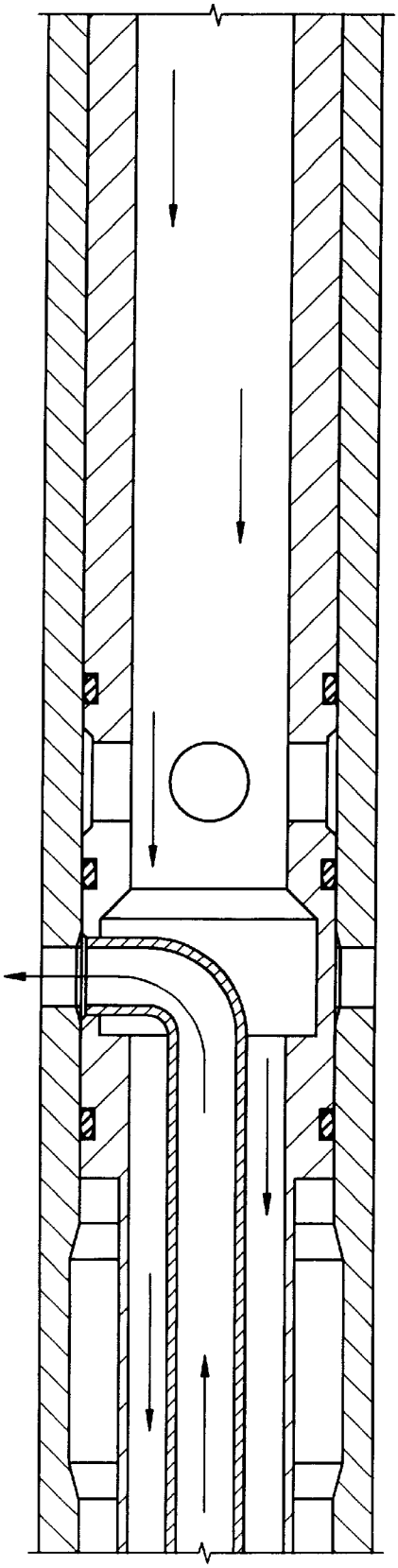
Figure 5G:
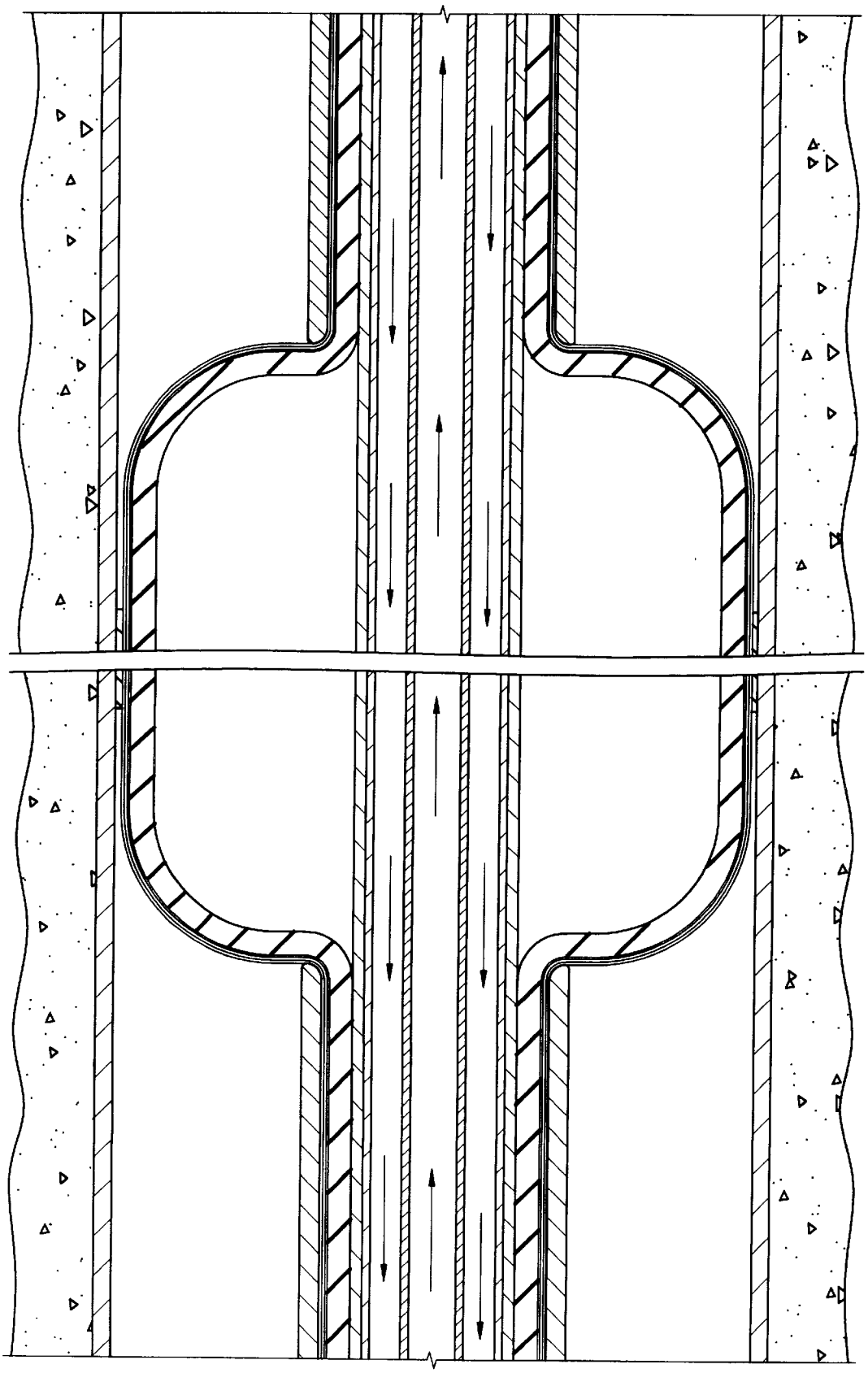
Figure 5H:
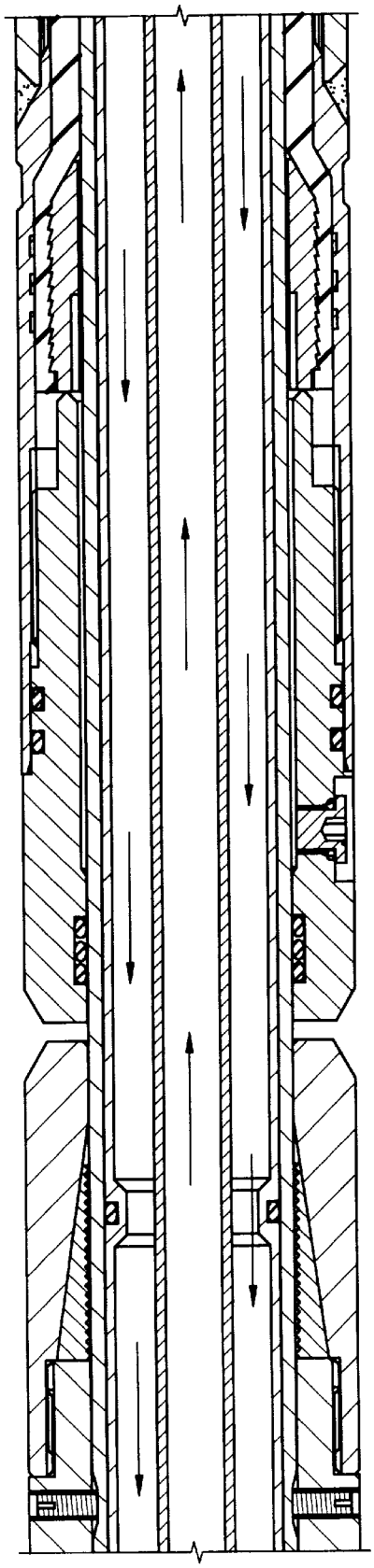
Figure 5I:
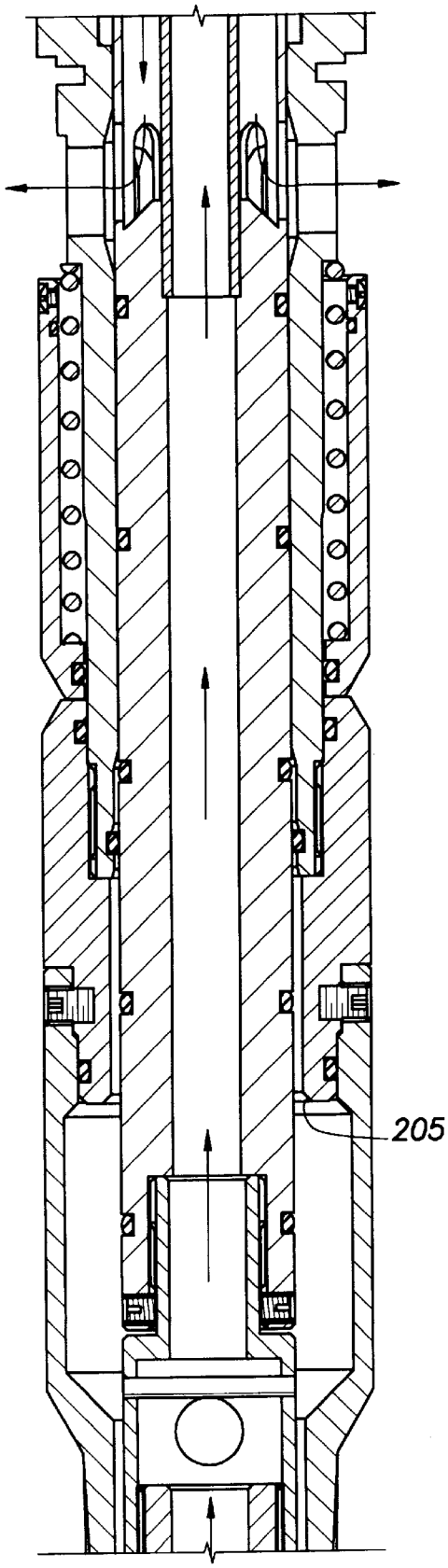
Figure 5J:
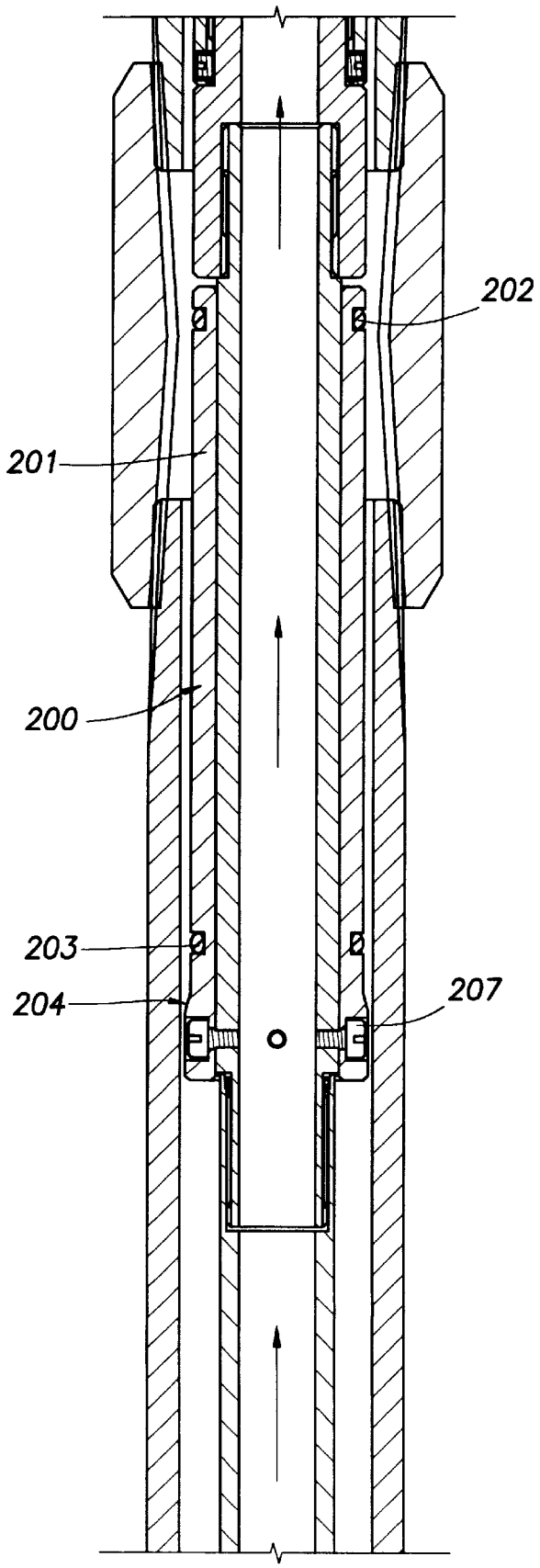
Figure 5K:
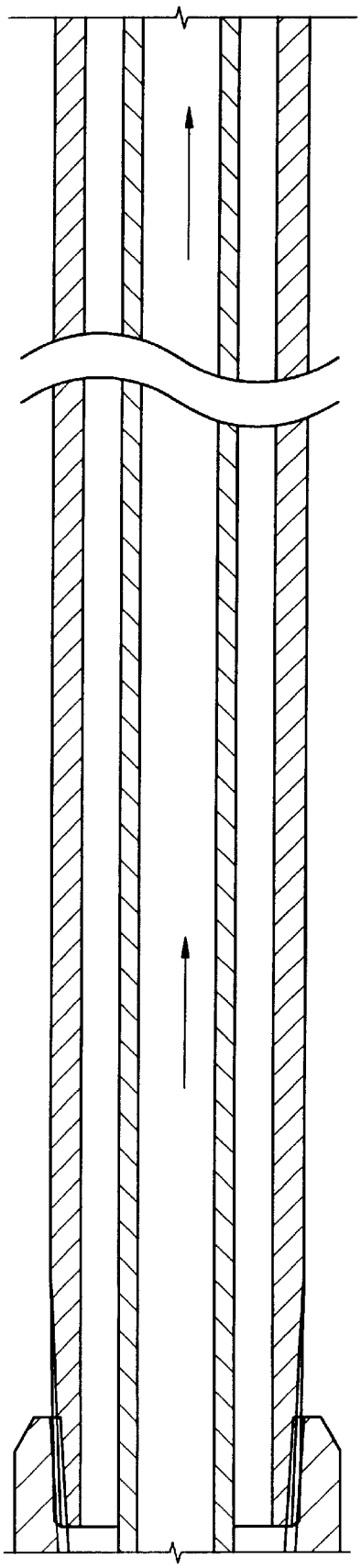
Figure 5L:
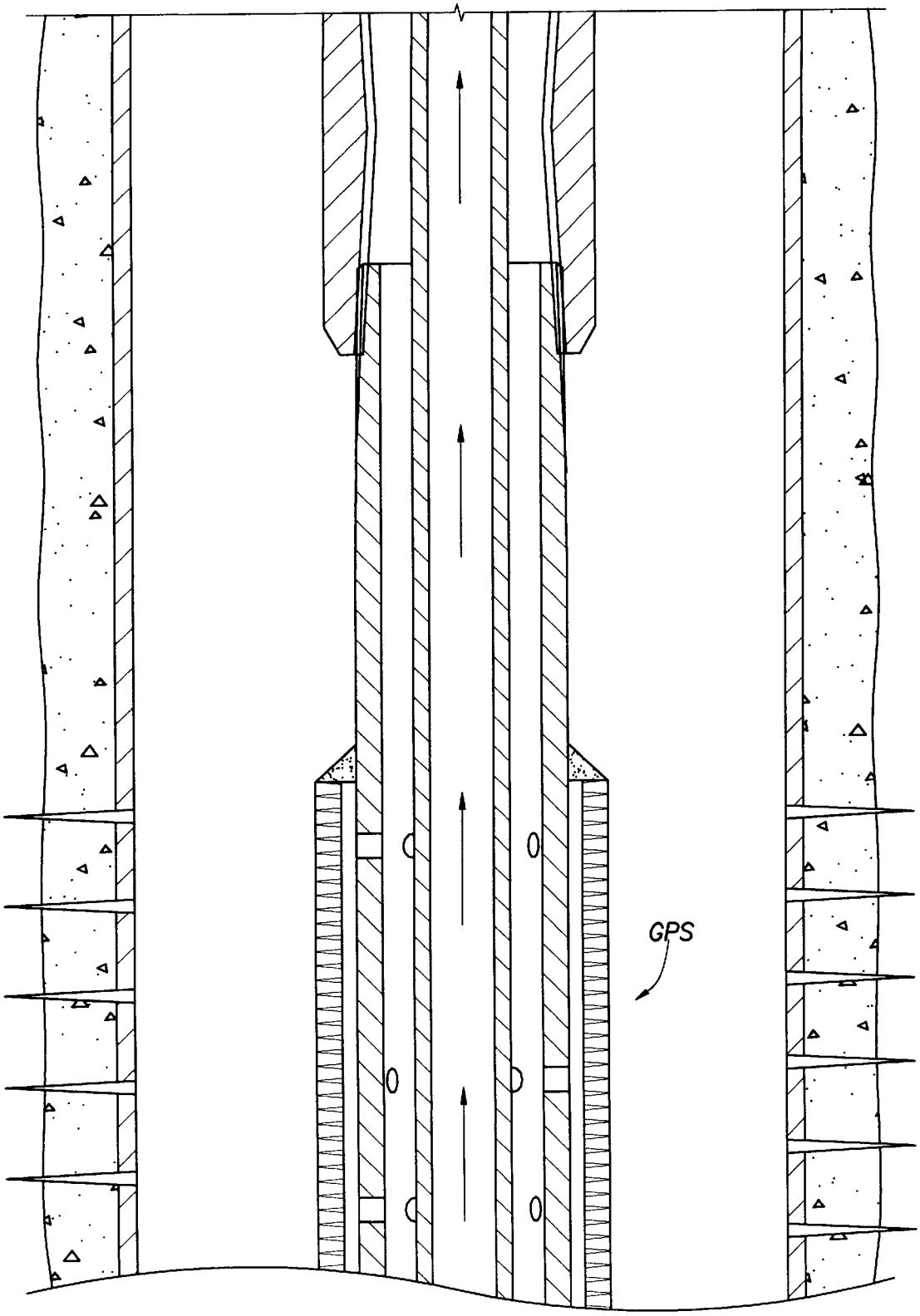
Figure 5M:
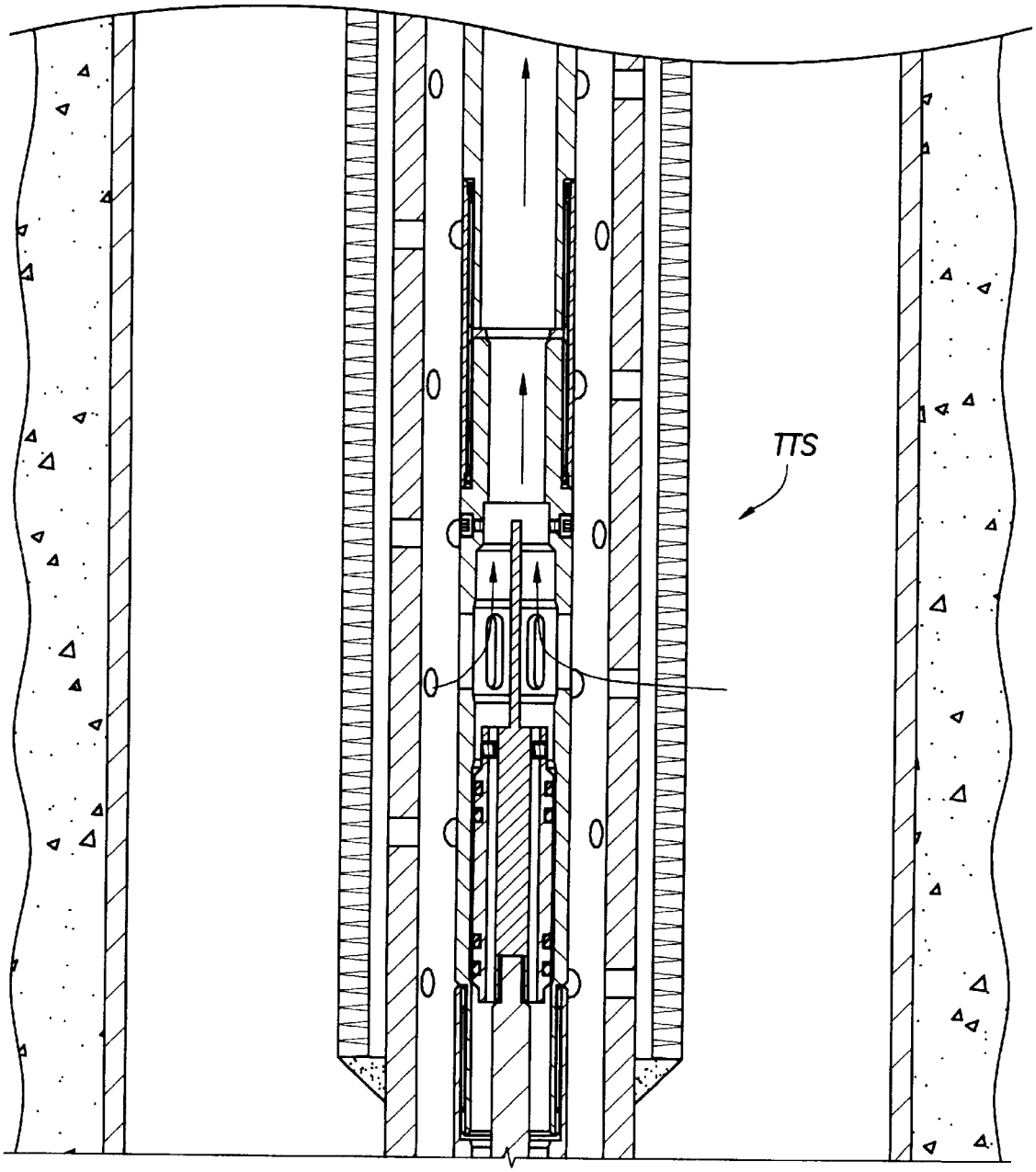
Figure 5N:
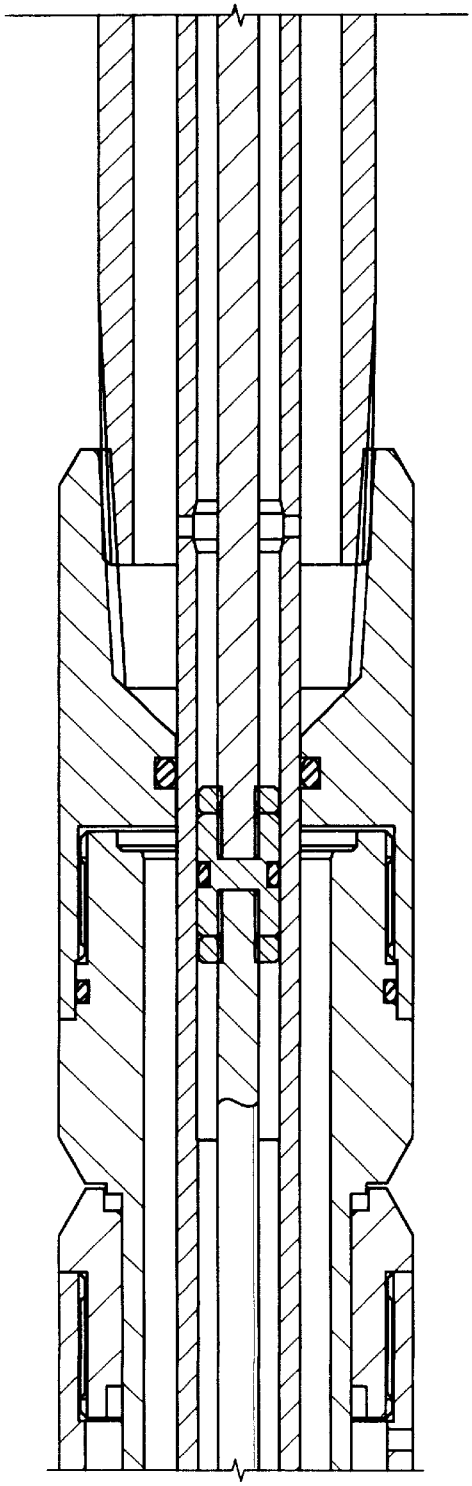
Figure 5O:
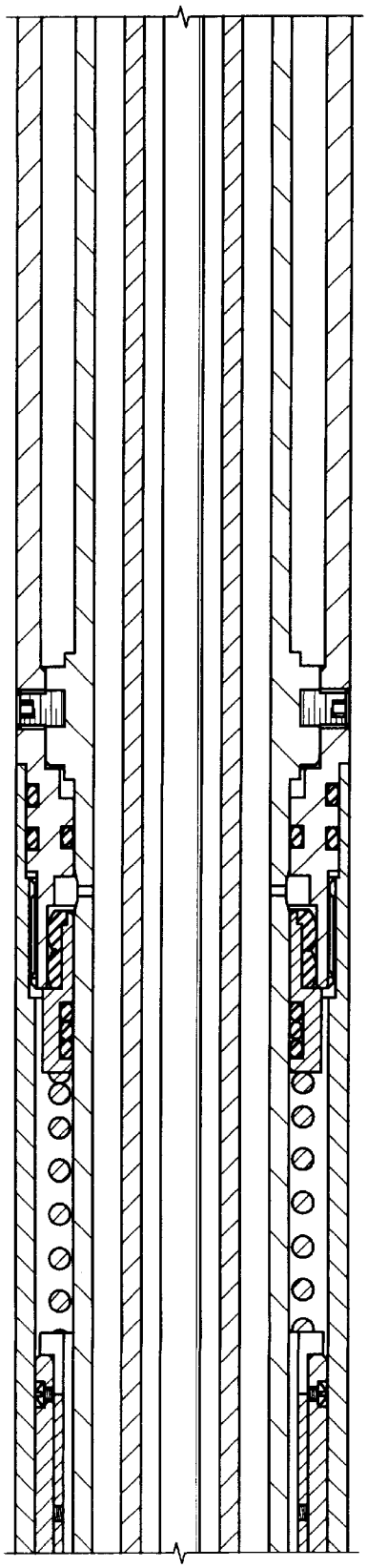
Figure 5P:
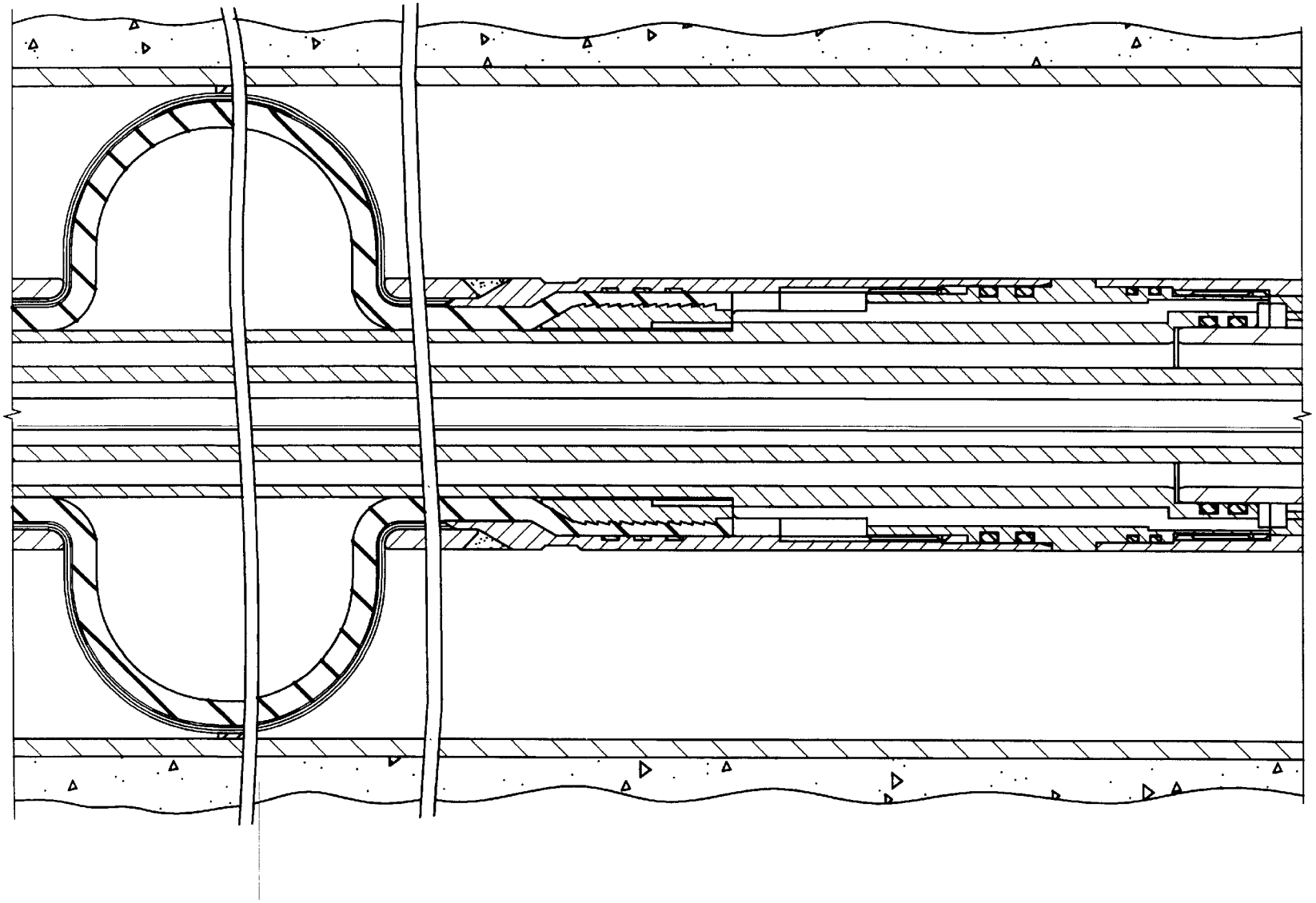
Figure 5Q:
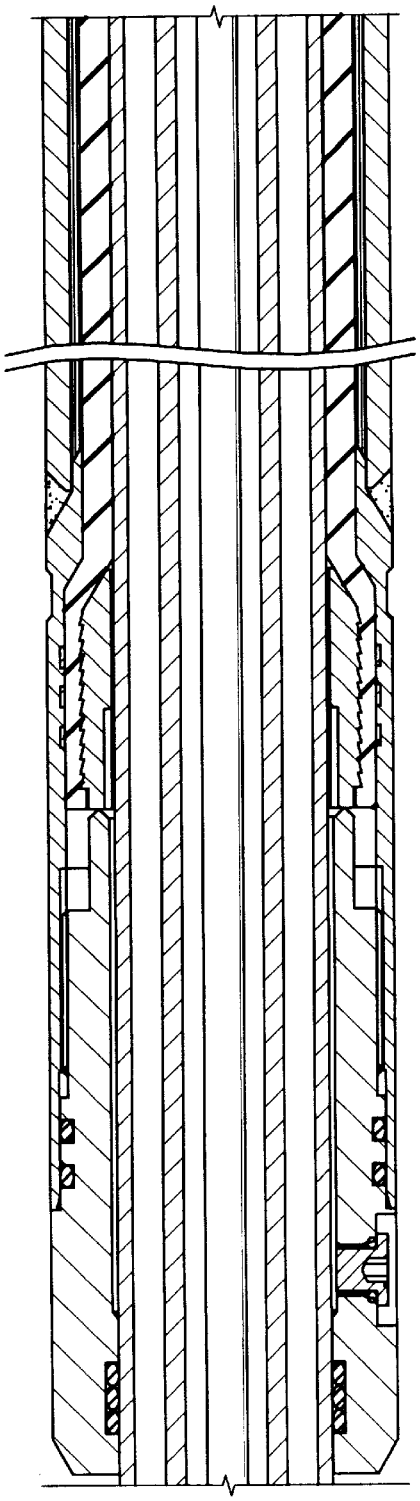
Figure 5R:
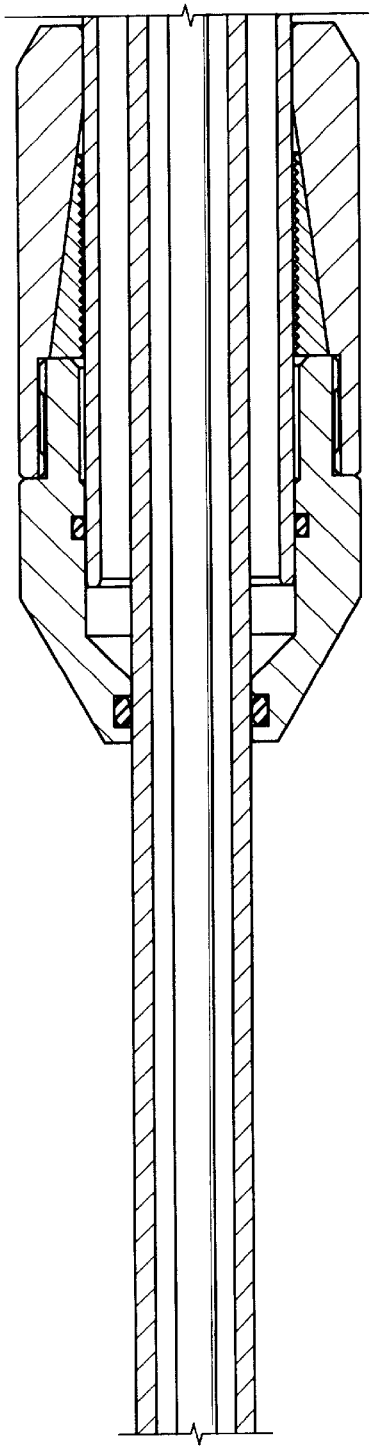

The piston rod assembly 133 also includes a piston rod mandrel 144 carrying thereon a seal piston member 145 with lock nuts 145A and 145B disposed on each side thereof. During inflation of the sump packer SP, the differential pressure caused by such inflation pressure will create a tensile load on the piston rod assembly 133 and the seal piston member 145 to create a tensile load which, in turn, is transmitted to the shear screws 136 causing shearing of the screws 136 so that relative longitudinal movement occurs between the piston rod housing 134 and the piston rod mandrel 144 such that the ports 135 are opened and the rod 141 is completely moved within the housing 134 to permit the ball 142 to selectively seal against the companion seat 143, as shown in FIG. 5M. The check ball 142 is caged against upward movement by provision of the isolation bar 182.

The passageway 138 within the sleeve 136 which communicates with the concentric passageway 115 in the flow control cross-over assembly within the sleeve 136 continues within the housing 134 of the piston rod assembly 133 and passes exteriorly of the housing 134 by means of provision of ports 146 into a passageway 146A defined between the exterior of the housing 134 and the interior of a second or lower valving means 149 inner housing member 101—which, in turn, has a series of companion ports 148 for transmission of pressure and fluid to the second or lower valving means 149, of like construction as the first valving means 116.

In order for proper actuation of the apparatus 100 to occur when a lower or sump packer SP is provided, it is necessary to set such packer SP prior to the setting of the gravel pack packer GPP. Therefore, it will be appreciated that the tinsile load through the shear screws 150 (FIG. 3R) provided in the second or lower valving means 149 will be less than that provided by the shear screws 129 in the first valving means 116 as well as that provided in the shear screws 136 in the piston rod assembly 133, such that a first increase in tubing pressure through the coiled tubing CT will be transmitted to the shear screws 150 and such screws 150 will shear, causing actuation and opening of the poppet assembly through the valving means 149.

After the lower or sump packer SP is set, pressure will continue to be increased within the coiled tubing CT and the apparatus 100 such that the shear screws 129 in the first valving means 116 are the next to be sheared, causing actuation and opening of the poppet 117 therein and the setting of the gravel pack packer GPP. After the setting of the gravel pack packer GPP, continued increase in fluid pressure within the apparatus 100 will cause shearing of the shear screws 136 to open the return ports 135. Further increase in pressure will cause shearing of the pins 161 holding the sleeve 160 closed across the gravel pack ports 157, thus opening them to the flow passageway 114 in the concentric cross-over tool CX.

The washpipe 131 extends lowerly through the interior of the sump pack SP and extends out of the lowermost outer end 151 of the outer housing 101 of the apparatus 100. A normally compressed and biased spring element 152 is carried around the lowermost end 153 of the piston rod mandrel 144 and within the housing member 131. When pressure is applied to the shear screws 136 after the setting of the sump packer SP and the gravel pack packer GPP, and upon severance of the screws 136, the compressed bias defined through the spring 152 assures sufficient travel of the piston rod Mandrel 144 to prevent obstruction of fluid flow through the ports 135 to permit the apparatus 100 to move to the complete circulating position, as shown in FIGS. 5A–5X.

The flow control cross-over assembly CX also provides a series of gravel packing ports 154 (FIG. 3J) which are closed relative to the outer housing 101 by means of straddling O-ring seal elements 155 and 156 extending across a companion gravel packing port 157 disposed through the outer housing 101 which, in turn, prior to manipulation of the coiled tubing CT from the run-in and packer setting position shown in FIGS. 3A–3X is bridged by companion O-ring seal elements 158 and 159 carried at each end of a sliding seal assemblage 160 held in port straddling position by means of a series of shear pins 161. The sliding sleeve 160 is biased against the shear screws 161 by means of the compression defined through a spring member 162 housed between the interior of the sliding sleeve 160 and the exterior of the housing member 101 there across.

Now referring to FIGS. 3J and 3K, the cross-over assembly CX has defined thereon lowerly of the ports 154 an elongated cylindrical diverter sleeve 190 having a flow passageway 190A therethrough to permit communication of the return fluids from the circulation pack upwardly to the top of the well W through the cross-over assembly passageway 115 with which it is always in communication. The sleeve has a series of elastomeric O-ring seal elements 191, 192 and 193 carried circumferentially and exteriorly therearound such that when the apparatus 100 of the present invention is shifted to the reverse circulation position shown in FIGS. 6A–6T to circulate and clean out the interior of the coiled tubing CT, the coiled tubing CT is picked up, shifting the diverter sleeve 190 upwardly relative to the outer housing 101 to bridge the O-ring seal elements 191 and 192 across the flow port 157 to thereby isolate the ports 154 so that trapped sand is not bled off into the cross-over tool CT above the gravel pack packer GPP. Accordingly, pressure within the apparatus 100 when in this position will be balanced.

The apparatus 100 also features the incorporation of an isolation sleeve mechanism 200 (FIG. 5J) which is carried on the cross-over assembly CX for permanently sealingly bridging across the gravel pack flow port 157 when the control mandrel cross-over assembly CX of the apparatus 100 is retrieved to the top of the well on the coiled tubing subsequent to the gravel packing operation. The sleeve assembly 200 includes an outer elongated cylindrical housing 201 having first and second O-ring seal members 202 and 203 circumferentially disposed at upper and lower ends thereof. A circumferentially extending outwardly beveled shoulder 204 extends around the lower most end of the sleeve 201 below the lower O-ring element 203 for no-go engagement with a companion profiled shoulder 205 on the outer housing member 101-N. A normally expanded but selectively collapsible retaining ring element member 206 is housed within a companion bore 205A on the outer housing member 101-N. A shear pin 207 is disposed within the sleeve housing 201 to secure the sleeve housing 201, selectively, to the washpipe member 131. Accordingly, when it is desired to retrieve the cross-over tool assembly and the washpipe out of the well W on the coiled tubing CT, the coiled tubing CT is picked up to shear the screws 103 carried in the grooves 170. When shoulders 204 and 205 interengage, upon additional upward movement of the coiled tubing CT, relative longitudinal movement between the sleeve 201 and the washpipe 131 will ultimately result in such force being transmitted to the shear pin 206 until it shears, thus permitting continued upward travel of the cross-over tool CX and washpipe 131. The interengagement of the shoulders 204 and 205 will retain the isolation sleeve 201 such that it bridgingly and sealingly stabilizes across the port 157 with O-ring seal elements 202 and 203 preventing fluid communication thereacross. The lower end of the sleeve 201 passing upwardly, slightly, will enable the expandable retaining ring 206 to collapse slightly inwardly to shouldered engagement around the lower circumferential end 201A of the sleeve member 201. In such position, the isolation sleeve assembly 200 may not move upwardly or downwardly within the assembly, assuring permanent closure of the ports 157.

Prior to the apparatus 100 being is placed in the position as shown in FIGS. 4A–4X, and subsequent to the setting of the packers and the opening of the return ports 135, pressure may be applied through the coiled tubing CT and the apparatus 100 to communicate the ports 154 and 157 to thereafter permit sand and the carrier fluid to be transmitted through the outer passageway 114 of the concentric passageway through the cross-over tool CX, whereby the increase in fluid pressure will be applied against the shear screws 161 and the bias defined in the spring 162 will be applied against the sleeve 160 to shift the sleeve 160 downwardly, moving the O-ring seal element 156 to the unsealed position to align the ports 157 and 154. Now, the coiled tubing CT, the passageway 114 and the annular area of the well W below the gravel pack packer GPP will be in fluid communication, such that the carrier fluid with the sand may continue downwardly for deposit around the tell-tale screen TTS and the gravel pack screen GPS thereabove, with the gravel being deposited in such annual area exterior of the respective screens TTS and GPS, with fluid returns without such gravel being carried interiorly through the port 135.

It will now be appreciated that a feature of the present invention is the utilization of a cross-over flow control assembly CX having concentric passageways 114 and 115 which are utilized not only to set the respective packers (or, in the event that a sump pack SP is not utilized, the passageway 115 being blocked, as described earlier) as well as to provide a fluid pressure flow passageway to manipulate a valving mechanism to permit communication of the carrier fluid containing the gravel to be transmitted through the apparatus 100 to the annular area exterior of the apparatus 100 below the gravel pack packer GPP and the inner wall of the well W therebelow. Additionally, such passageway 114 through the cross-over assembly CX is also utilized during the setting of such packer mechanisms to also open closed ports through the apparatus to permit circulation returns to the top of the well through the coiled tubing.

The termination of the inflation cycle for the sump packer SP occurs when the sliding piston 139 is manipulated to open the ports 135. When the piston sleeve 137 slides down and ports 135 open, the ball 142 falls down onto the seat 143. An increase in pressure in the coiled tubing CT is applied to first shear the screws 129 in the valve assembly 116 to set the gravel pack packer GPP, as described earlier. Thereafter, pressure is further increased to overcome the shear strength of the screws 161 which will allow the sleeve 160 to slide down and open the gravel pack ports 157. Upon this occurrence, the inflation cycle of the gravel pack packer GPP has been completed. The opening of the ports 157 will lower the pressure in the passageway 114 and the coiled tubing CT. When the pressure in the coiled tubing CT so decreases, then the fluid within the interior of the inflatable packer GPP pushes and slams the sleeve 117 closed and the inflation pressure is thus sealed within the packer GPP, because the fluid pressure inside the inflatable packer GPP is higher than the pressure in the coiled tubing CT and within the flow passageway 114.

Now referring to FIGS. 4A–4X, the apparatus 100 is shown in position after inflation of the gravel pack packer GPP and the sump packer SP and the opening of the gravel pack valves and return ports, to create the circulation path downwardly through the apparatus, with upward returns, as indicated by the arrows.

Figure 5S:
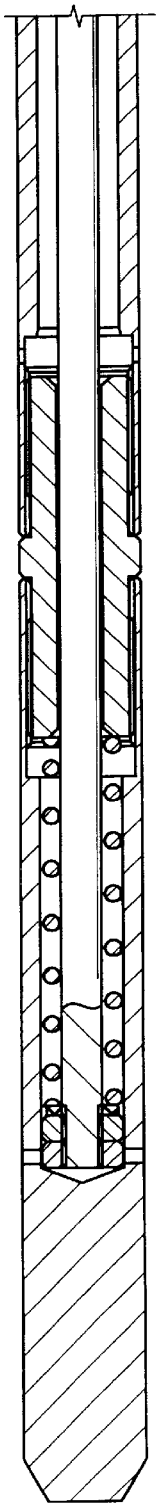

Moving to FIGS. 5A–5S, the coiled tubing CT is picked up at the top of the well to shear the screws 103A disposed between the control mandrel 104 and the outer cylindrical housing 101. Offset 180° from the screws 103A, the control mandrel 104 has a series of thin grooves 170 disposed therein for limiting movement of the control mandrel 104 relative to the outer housing 101 as the apparatus is manipulated from the position shown in FIGS. 3A–3X to the position shown in FIGS. 4A–4X. A shear pin 103 is disposed within the outer housing 101 and protrudes into the grooves 170 so that the pin 103 travels relative thereto until the coiled tubing CT is picked up to shear the pin 103 to release the control mandrel 104 from the housing 101 for retrieval of the cross-over assembly CX and the mandrel 104 from the well W after completion of the gravel packing operation.

The Gravel Packing Operation

After the valve and port opening operation with the setting of the packers, the apparatus 100 is now ready for initiation of the gravel packing operation. Accordingly, the coiled tubing CT is picked up at the top of the well to shear the screw 103A to effect relative telescopically expanding first movement of the control mandrel 104 relative to the outer cylindrical housing 101. The collapsed retaining rings 108 move upwardly and out of the top end of the outer cylindrical housing 101, and expansion of the rings is no longer resisted. The coil tubing CT is slacked off until the radially expanded rings 108 rest upon the upper most end 101A (FIG. 5B) of the outer cylindrical housing member 101-A. Now, the mandrel 104 and the cross-over assembly CX have been re-oriented relative to the outer housing 101 to align the ports 110 and the passageway 115. The gravel packing fluid and gravel now may be transmitted through the coil tubing CT to the exterior of the apparatus 100, as shown, and returns to the top of the well. The fluid travels downwardly within the apparatus 100 through the passageway 114 in the cross-over assembly CX with returns through the concentric passageway 115 in the cross-over assembly CX and the port 110 in the outer housing 101.

It will be appreciated by those skilled in the art that during the gravel packing operation, as described above, a phenomenon or condition called a "sandout" will be experienced which occurs when the top of the gravel column in the well annulus is slightly over or above the gravel pack screen GPS. In order for the pumped fluid in the coiled tubing CT to go into the either the perforations or down through the gravel pack into the tail tell screen TTS and back to the top of the well, a substantial pressure drop will be experienced which is translated into an increase in pressure at the top of the well within the coiled tubing CT. This occurrence confirms that the gravel packing of the well annulus below the gravel pack packer GPP is above the gravel pack packer screen GPS, and pumping is terminated. Furthermore, it will also be appreciated that once pumping is terminated, the resulting static condition or lack of fluid flow should be permitted for a very short time interval, i.e., a matter of 15–30 seconds, or the like. The gravel packing fluid must be agitated by reactivating pumping in order to keep the sand moving within the fluid in order to avoid bridging. Accordingly, the coiled tubing CT is picked up at the top of the well to initiate reverse circulation.

Reverse Circulation

Once the gravel packing operation has been completed, as described above, it will be appreciated that extra gravel will be contained within the fluid in the coiled tubing CT and the apparatus 100. Unless the gravel is removed from the interior of the coiled tubing CT, the coiled tubing CT may become bridged with such compacted particulate matter.

Figure 6A:
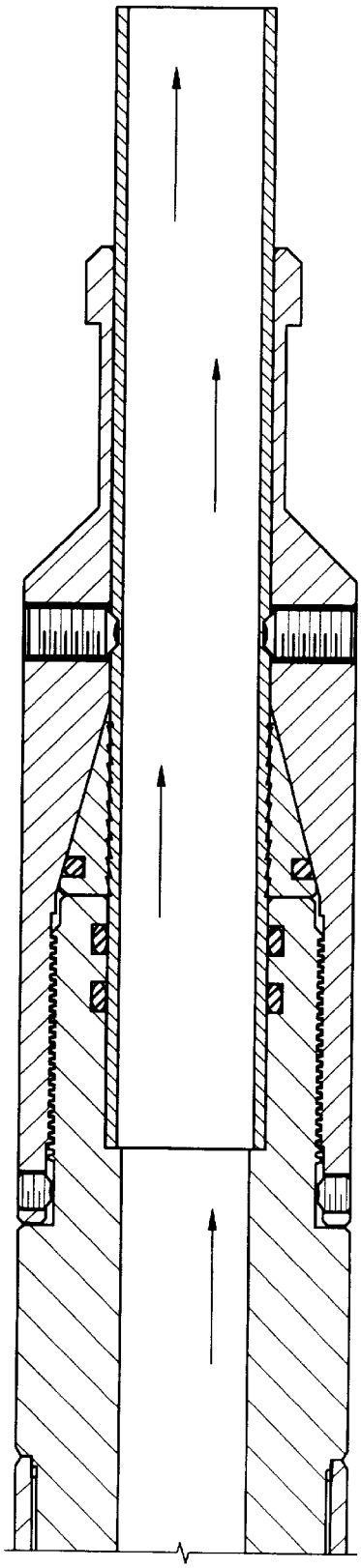
FIGS. 6A–6T are views similar to those of FIGS. 3A–3X, 4A–4X, showing the apparatus of the present invention telescopically shifted to a third position to permit reverse circulation and cleaning of the well above the gravel pack packer subsequent to the gravel packing operation.
Figure 6B:
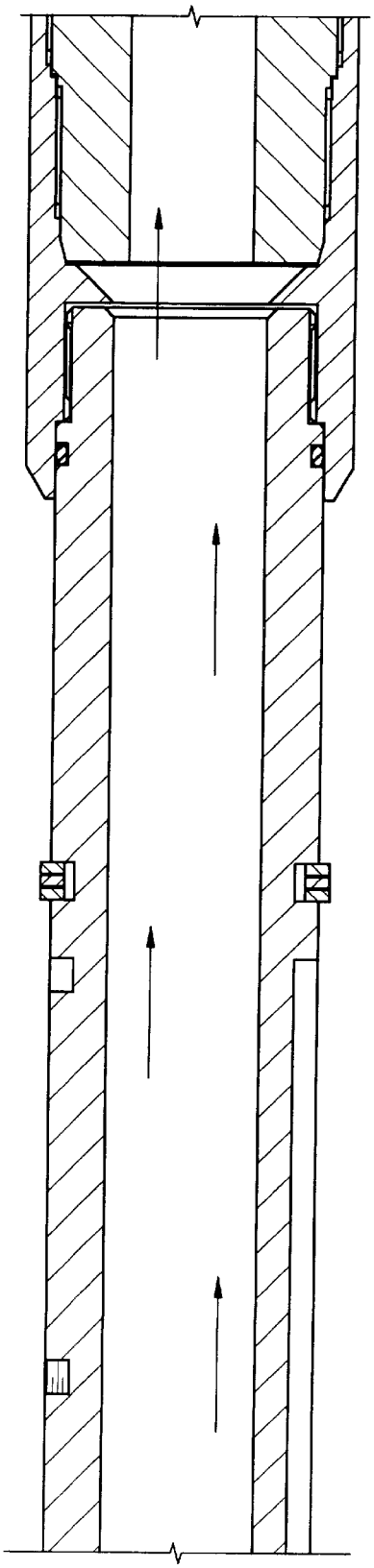
Figure 6C:
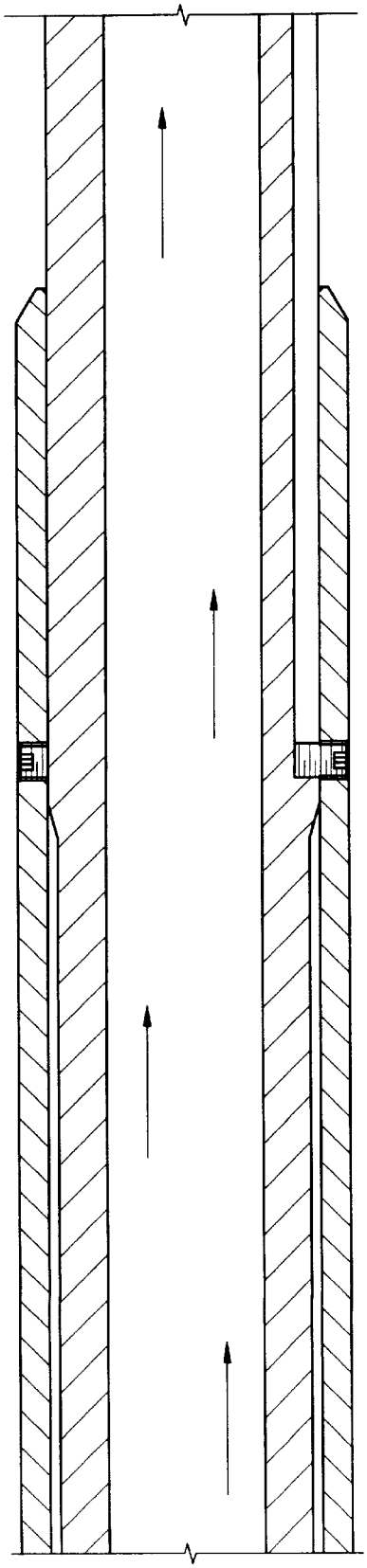
Figure 6D:
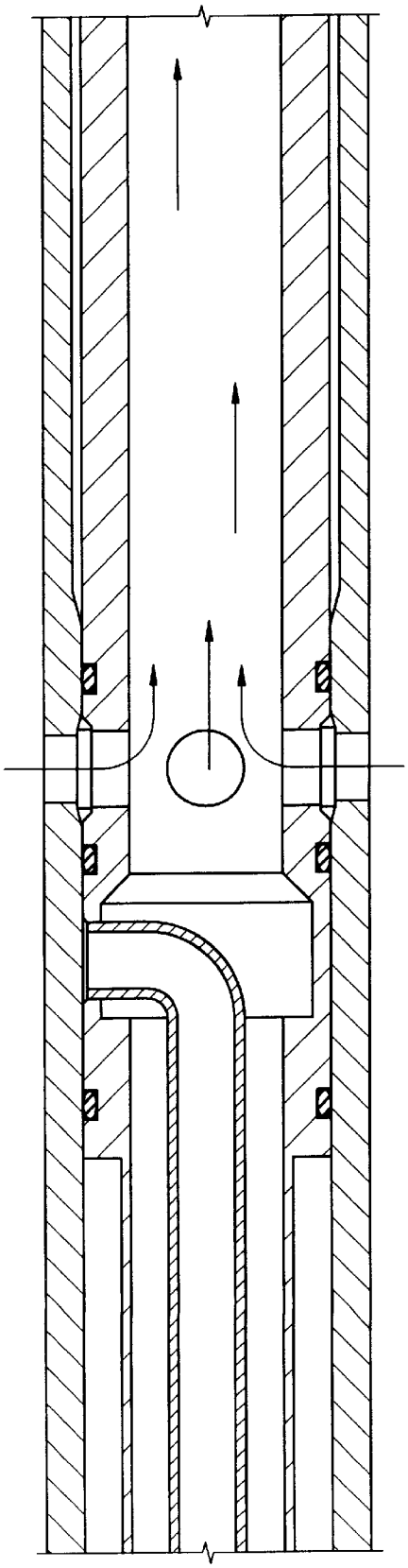
Figure 6E:
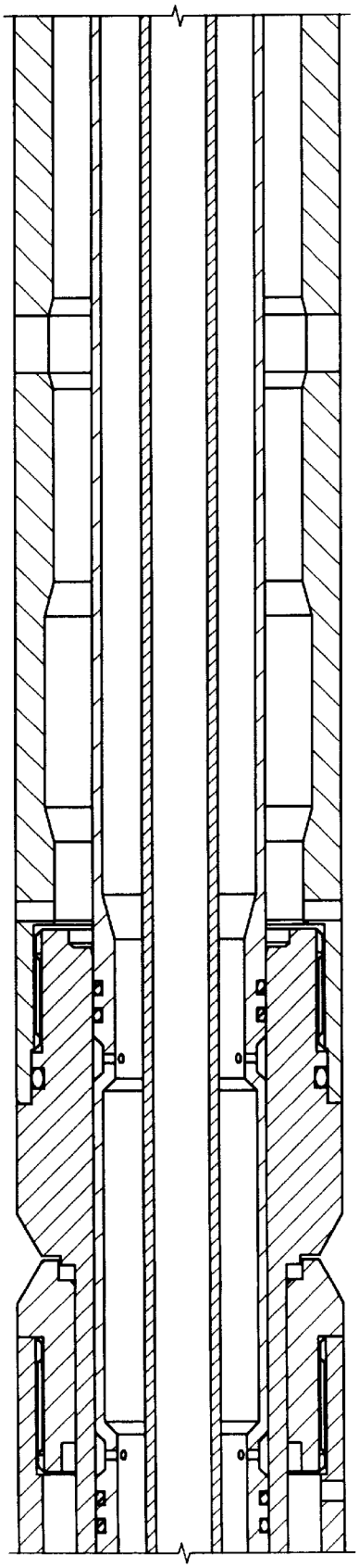
Figure 6F:
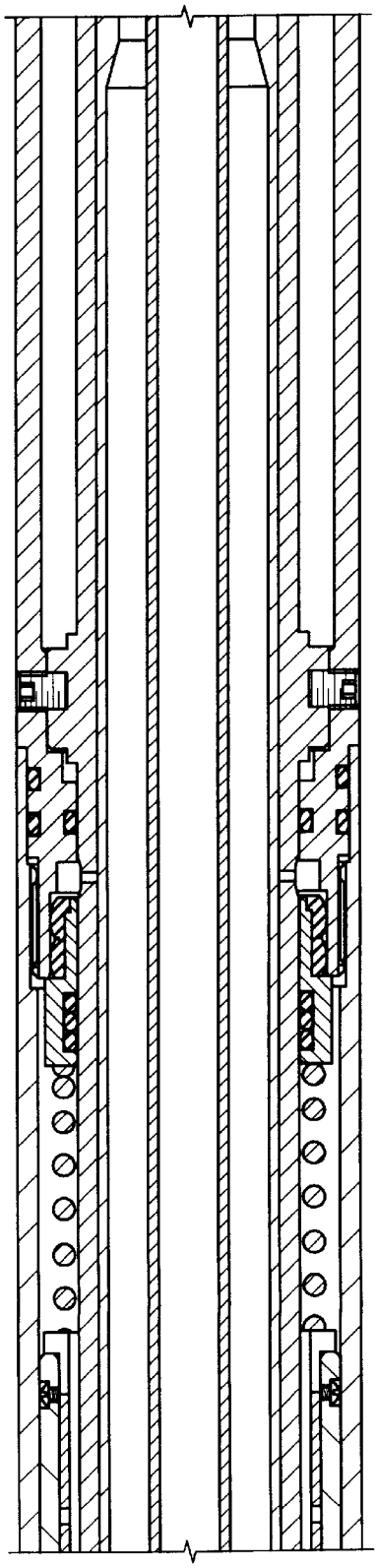
Figure 6G:
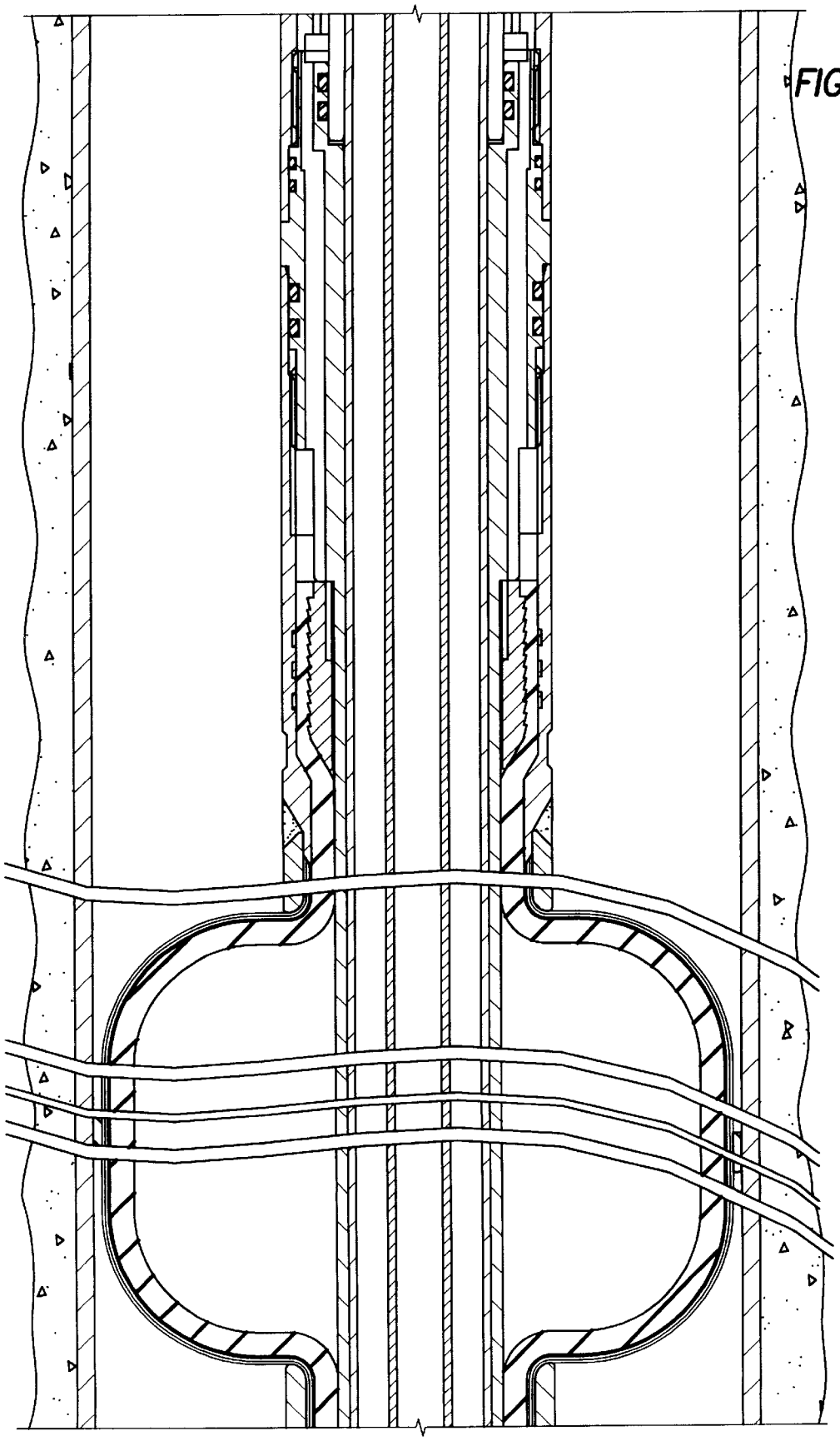
Figure 6H:
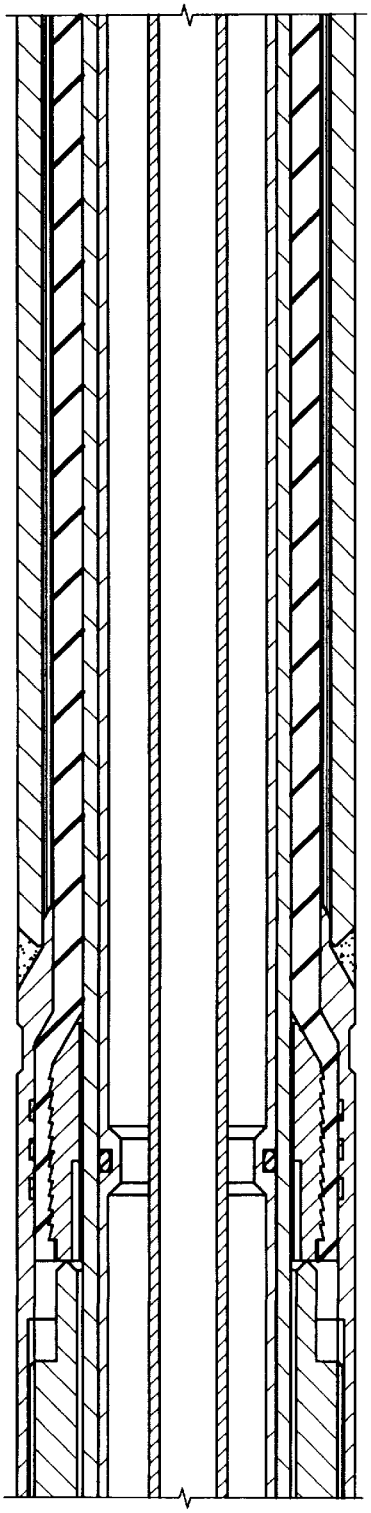
Figure 6I:
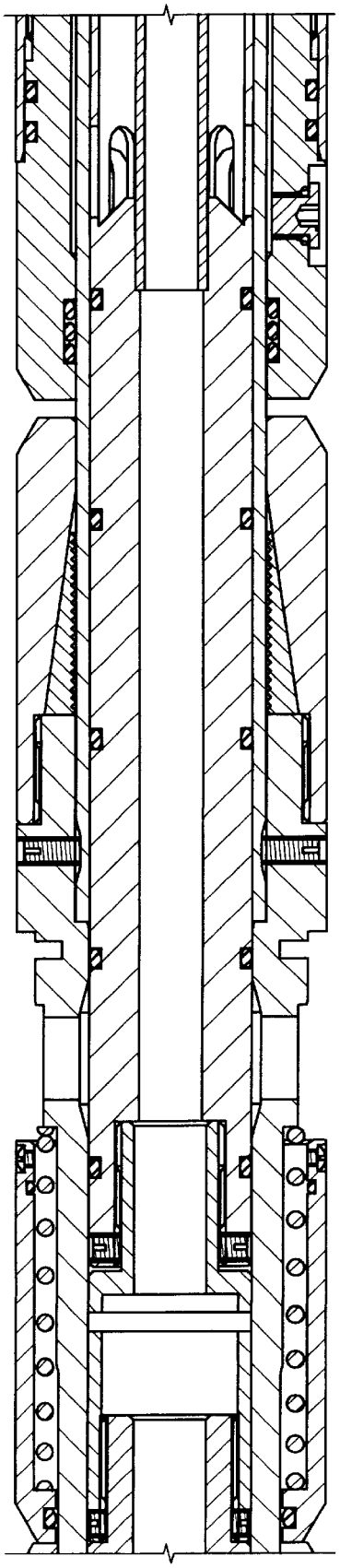
Figure 6J:
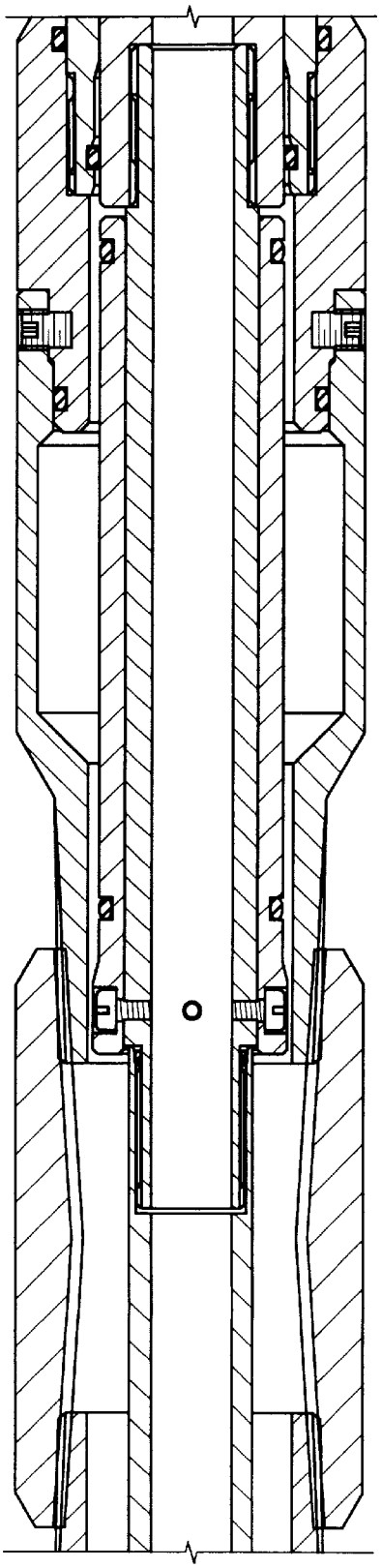
Figure 6K:
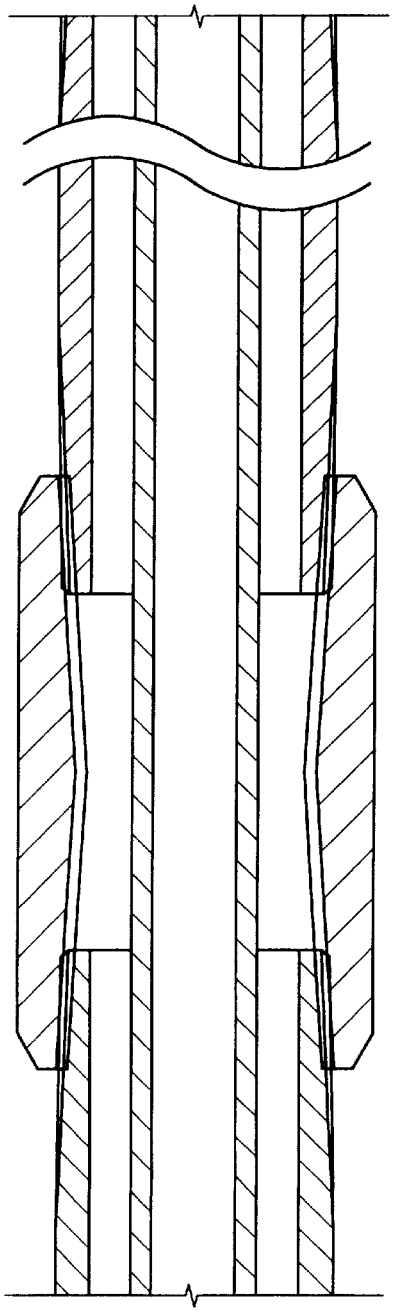
Figure 6L:
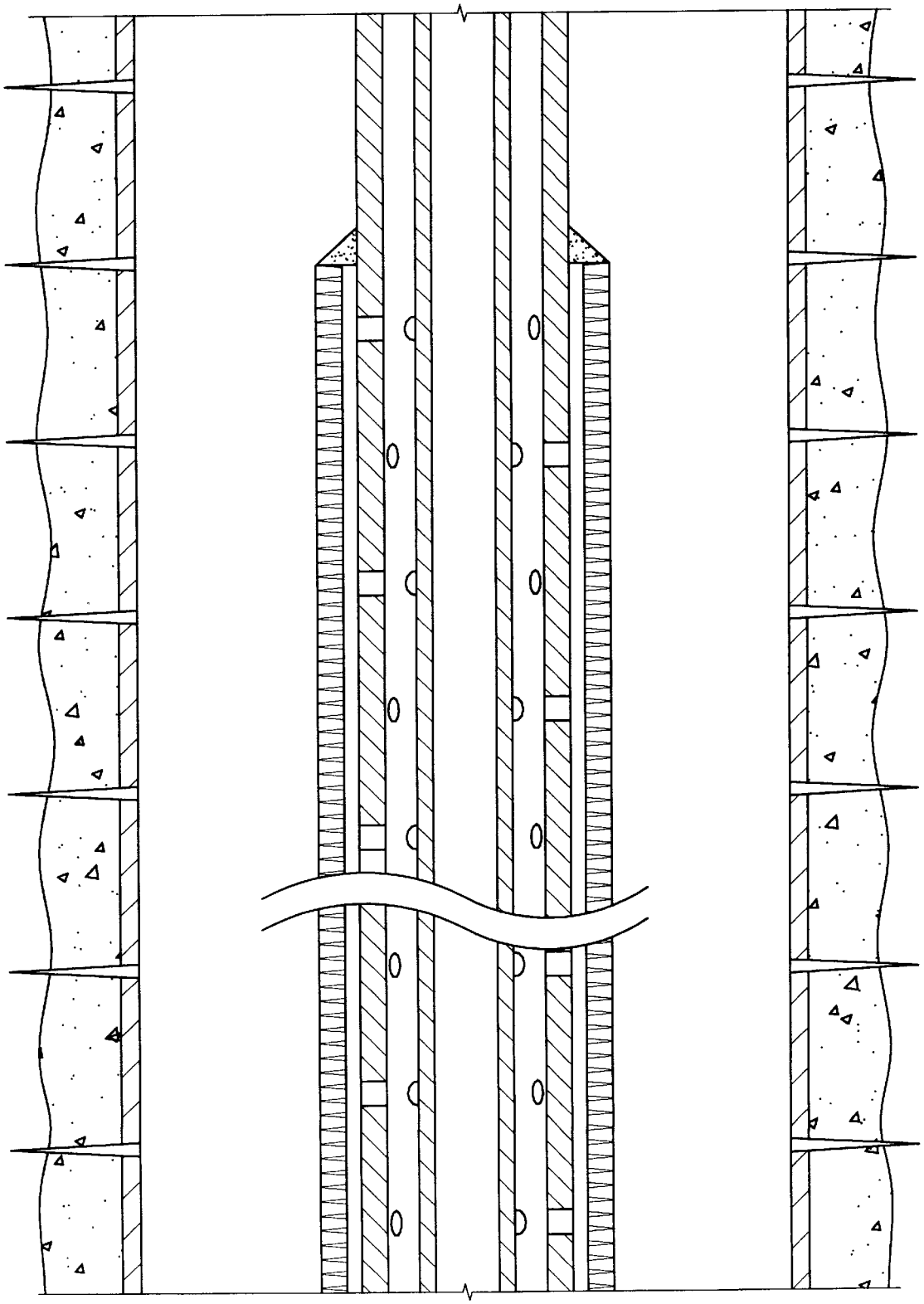
Figure 6M:
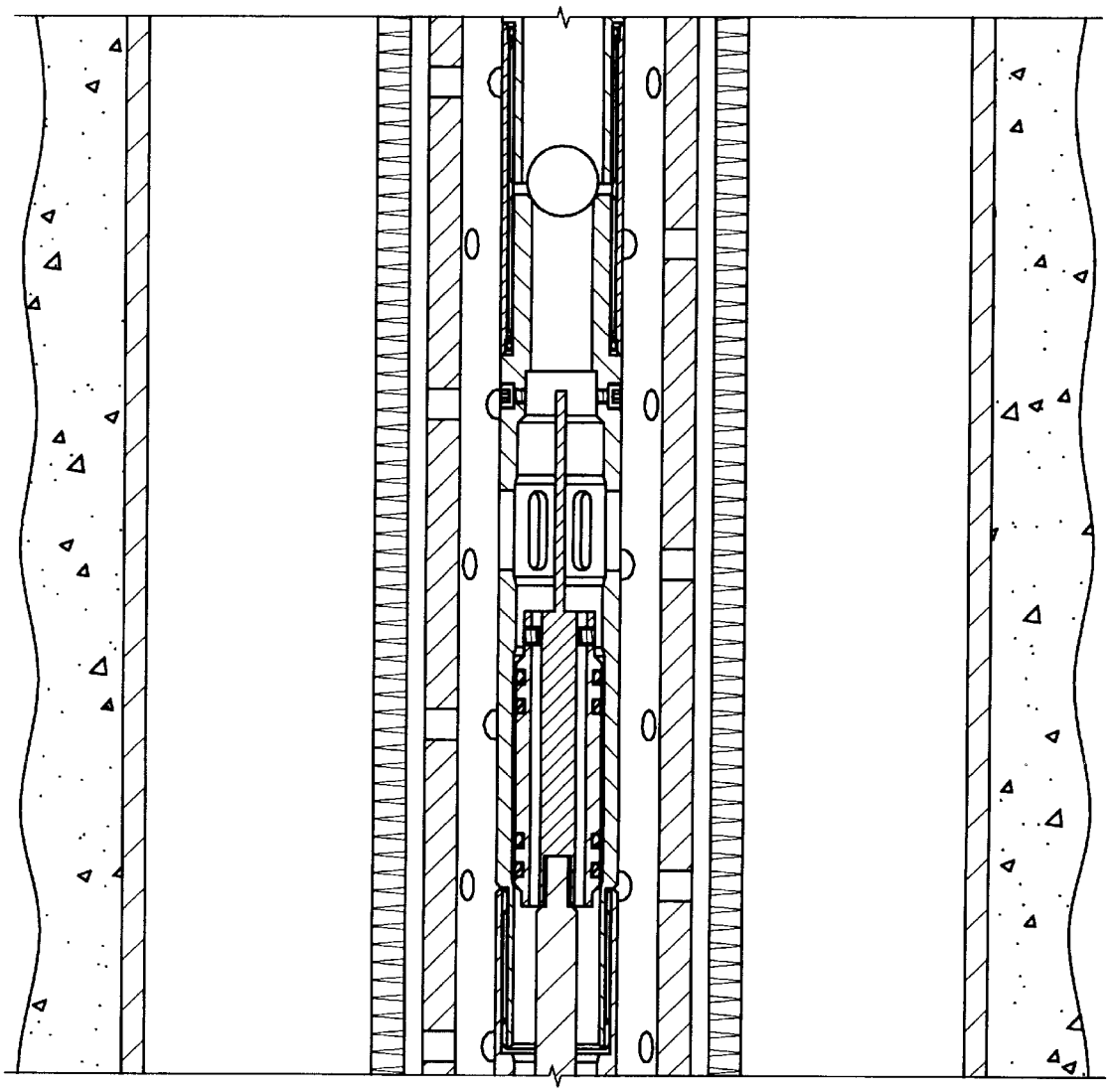
Figure 6N:
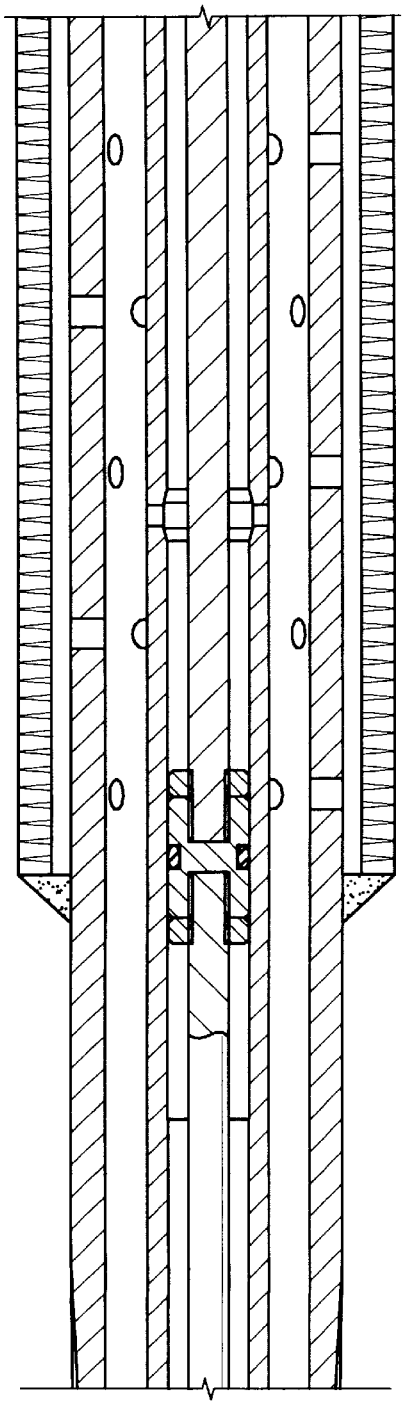
Figure 6O:
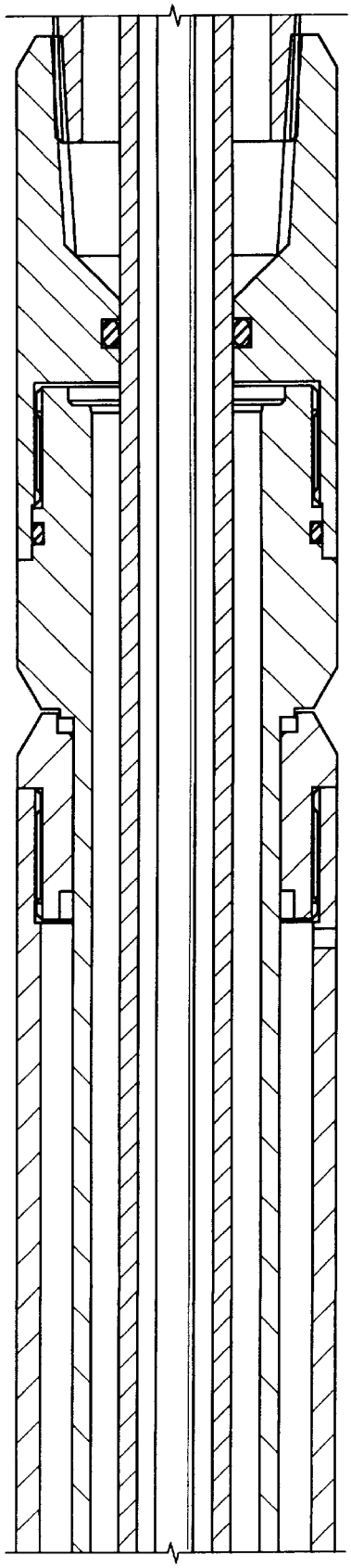
Figure 6P:
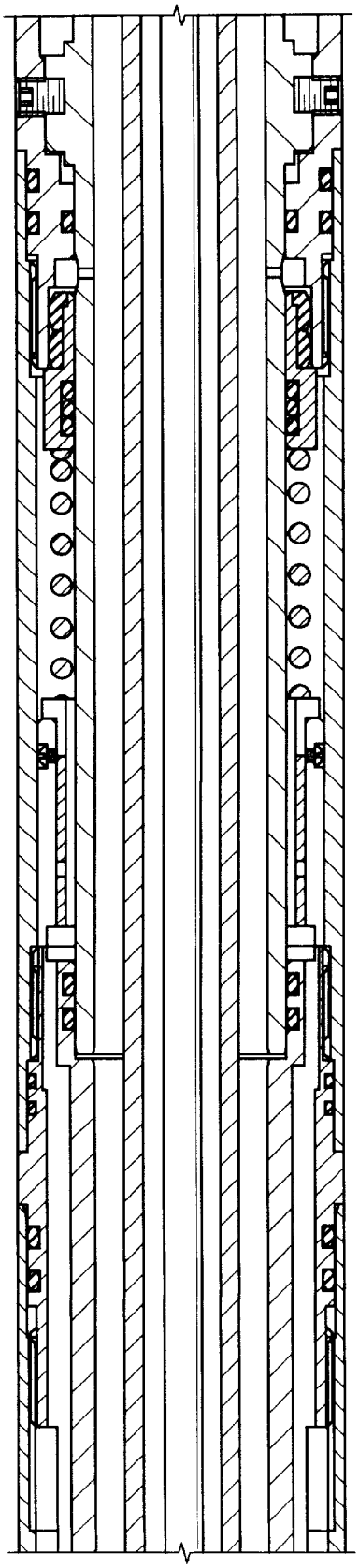
Figure 6Q:
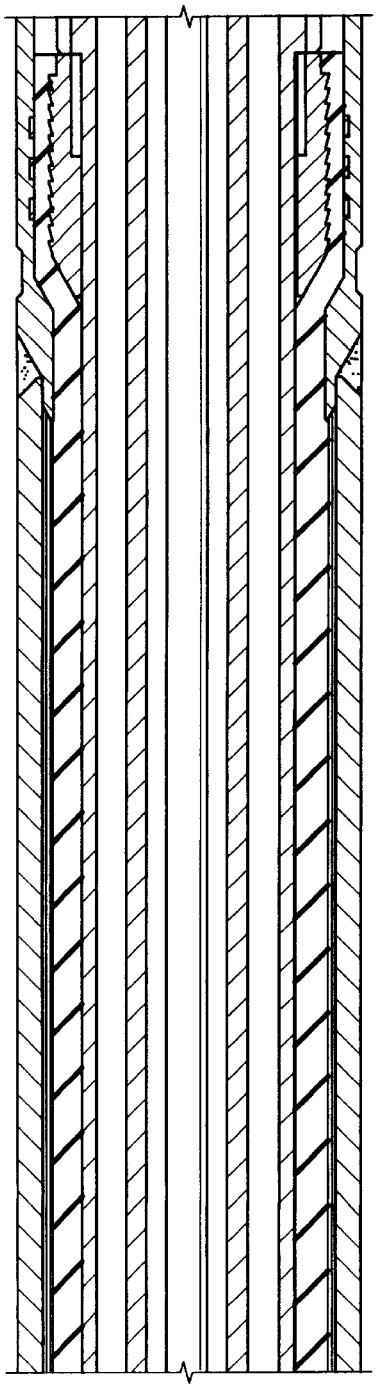
Figure 6R:
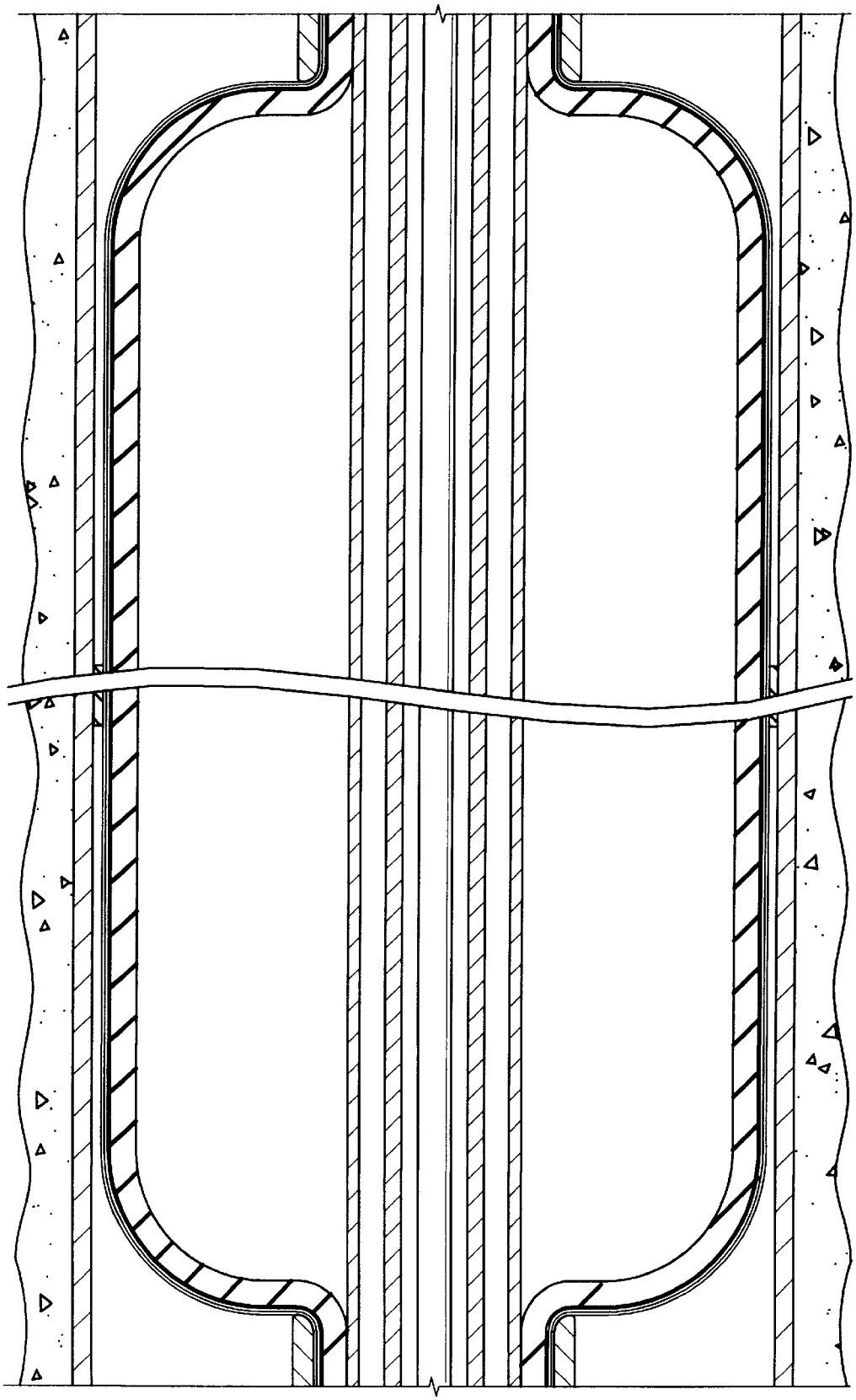
Figure 6S:
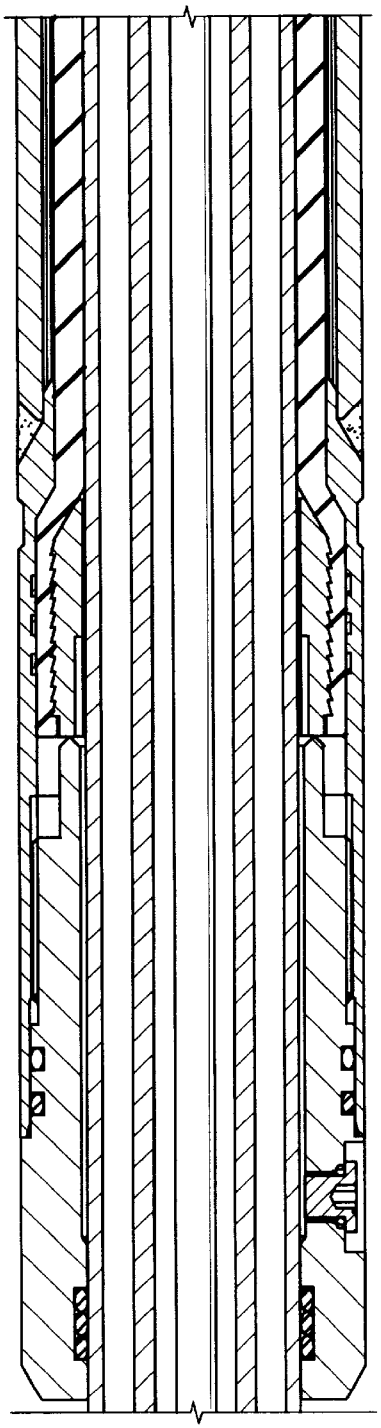
Figure 6T:
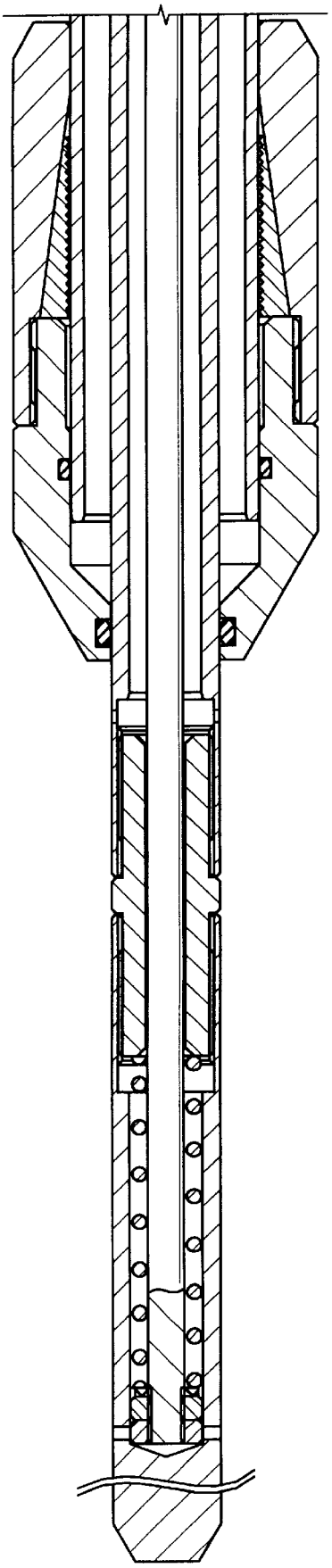

Now referring to FIGS. 6A–6T, when it is desired to reverse circulate to clean the interior of coiled tubing CT, the coiled tubing CT is picked up to telescopically move the control mandrel 104 expandingly relative to the outer cylindrical housing 101 to a second telescopically expanded position to align the ports 110 and 109. In such position, fluid flow will be prevented within the passageways 114 and 115 within the flow control cross-over assembly CX by the positioning of the O-ring seal element 112A in sealing disposition on the smooth interior bore provided therefore within the outer cylindrical housing 101. Thereafter, a cleaning fluid may be pumped through the production tubing PT, out the distal end DE thereof, and circulated in the annular area above the gravel pack packer GPP between the outer cylindrical housing 101 and the inner wall of the well W defined by the casing C for circulation through the aligned ports 111 and 109, thence interiorly through the apparatus 100 through the interior of the control mandrel 104, the coiled tubing CT to the top surface of the well W, in order to reverse out excess sand and other particulate debris resulting from the gravel packing operation described above.

It will be appreciated that subsequent to reverse circulation cleanout of the coiled tubing CT, pumping may be abated and the coiled tubing CT may be slacked off and pumping reinitiated to clean out any sand below the reversing ports 110. By so slacking off on the coiled tubing CT and moving the apparatus 100 to the circulating position and then commencing pumping down the coiled tubing CT, any sand that is located in the cross-over assembly CX below the ports 110 will go out of the ports 110. The coiled tubing CT can again be picked up to move the apparatus 100 to the reverse circulation position to continue reversing out of the hole for further cleaning.

Figure 7A:
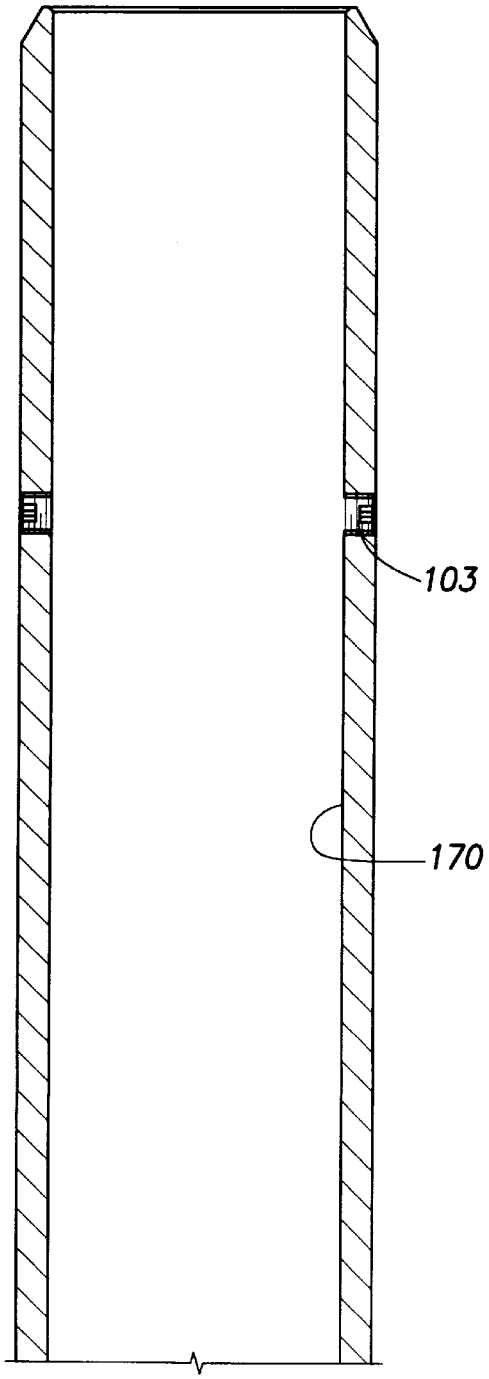
FIGS. 7A–7Q illustrate the position of the relative components when the control mandrel, the cross-over tool and the washpipe are retrieved from the top of the well for leaving the balance of the components in the well for production purposes and detail the view of FIG. 2.
Figure 7B:
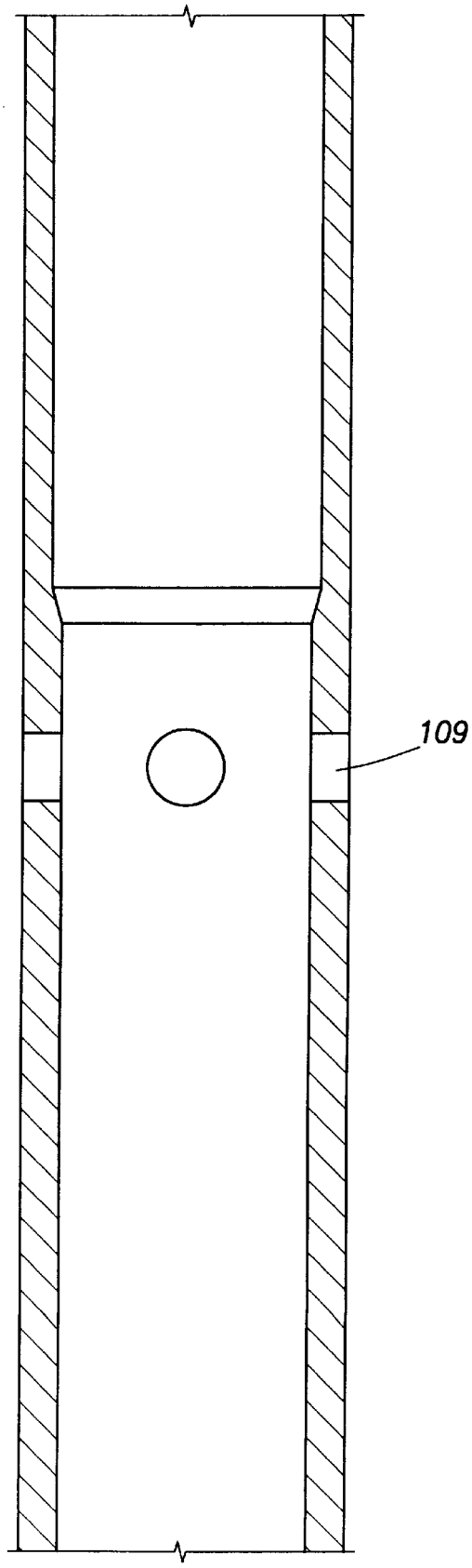
Figure 7C:
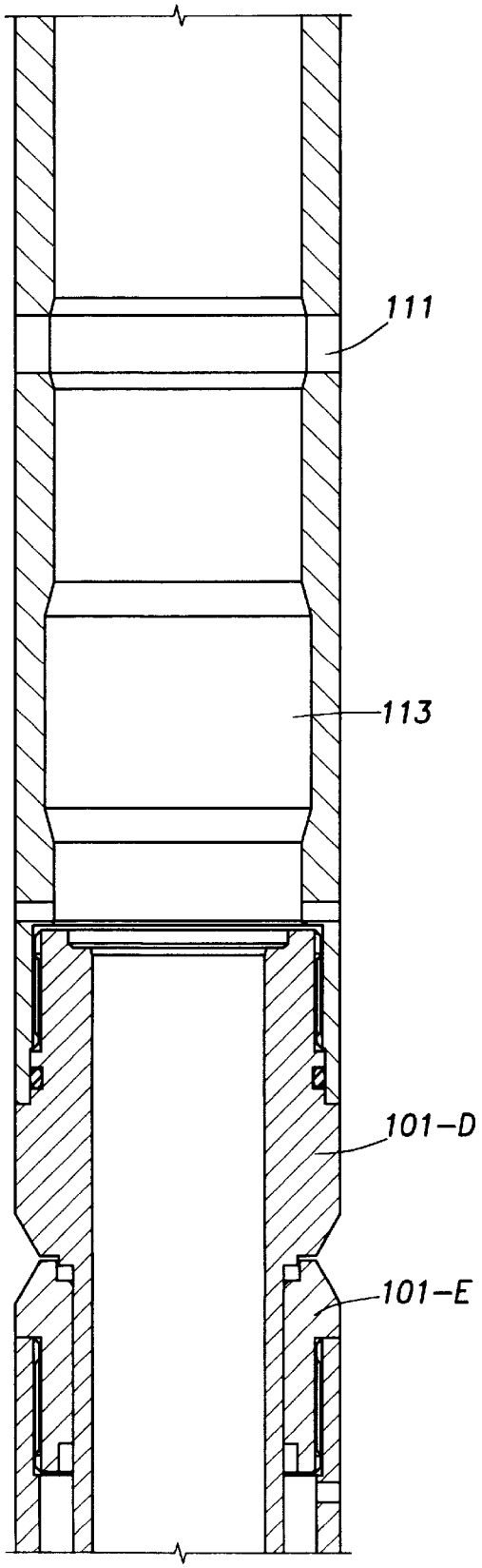
Figure 7D:
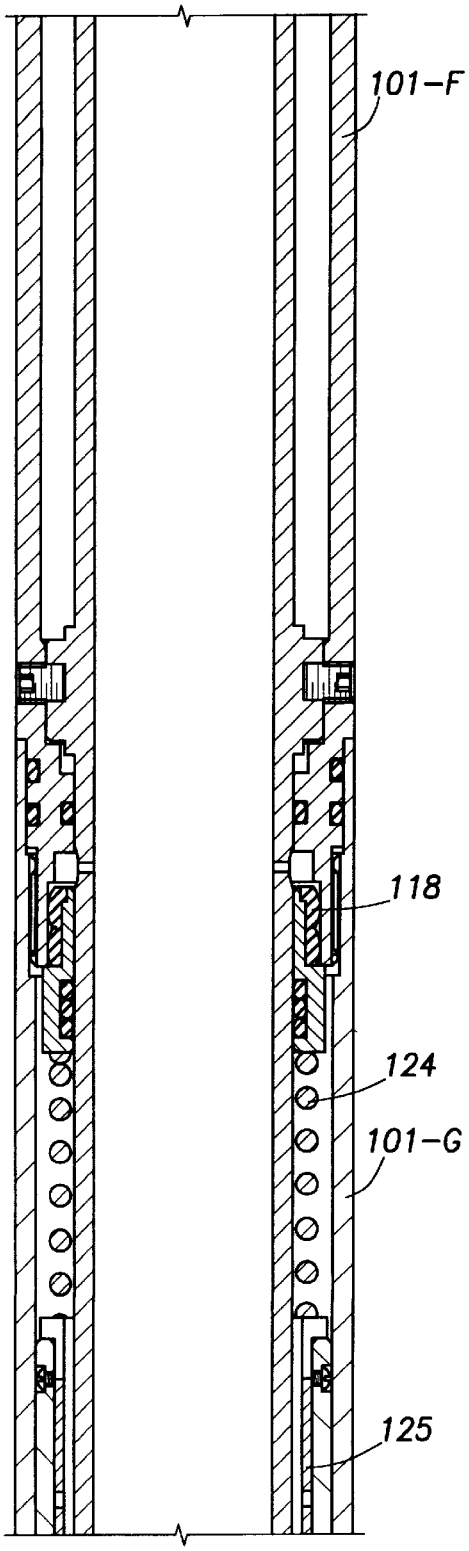
Figure 7E:
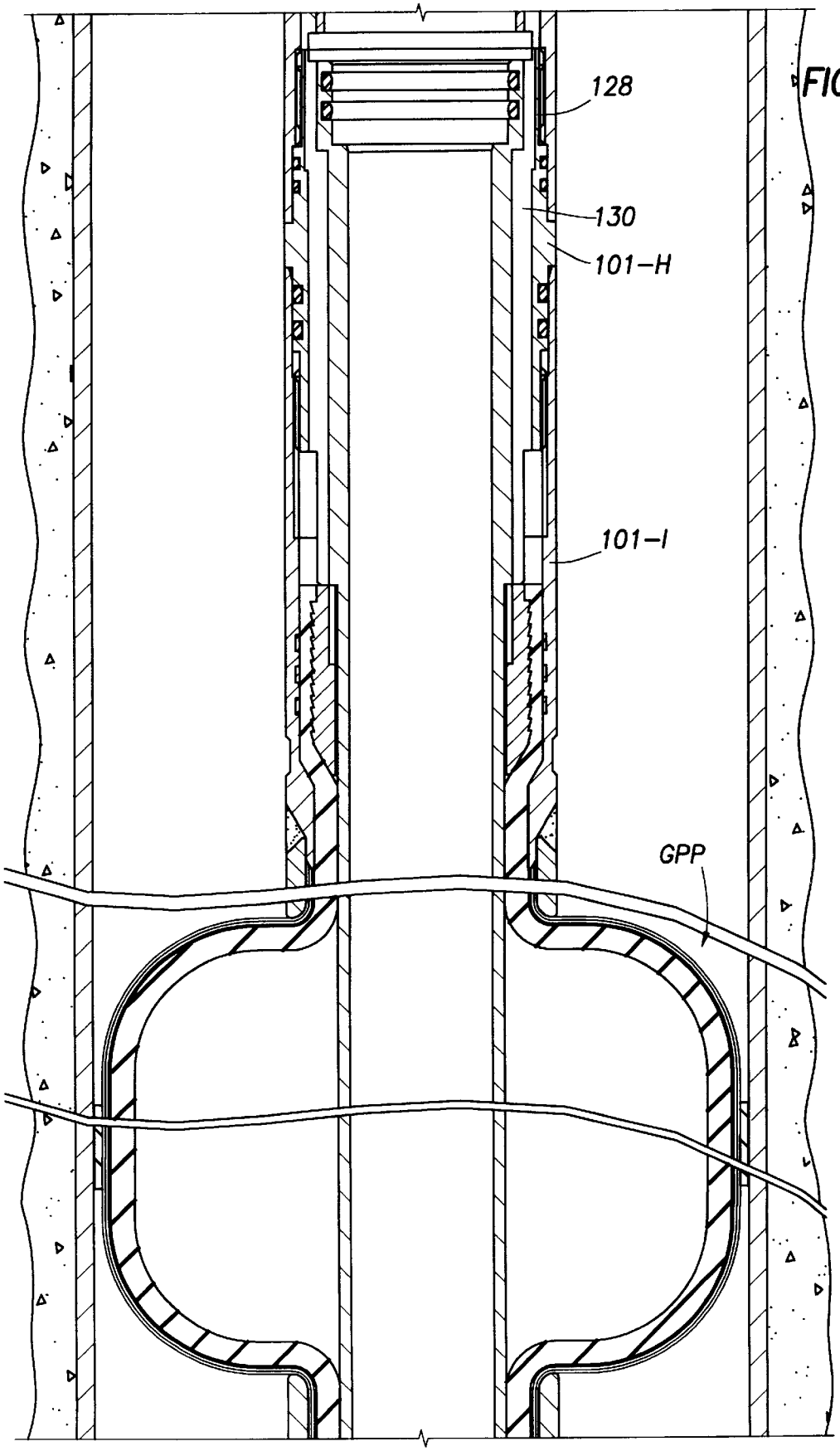
Figure 7F:
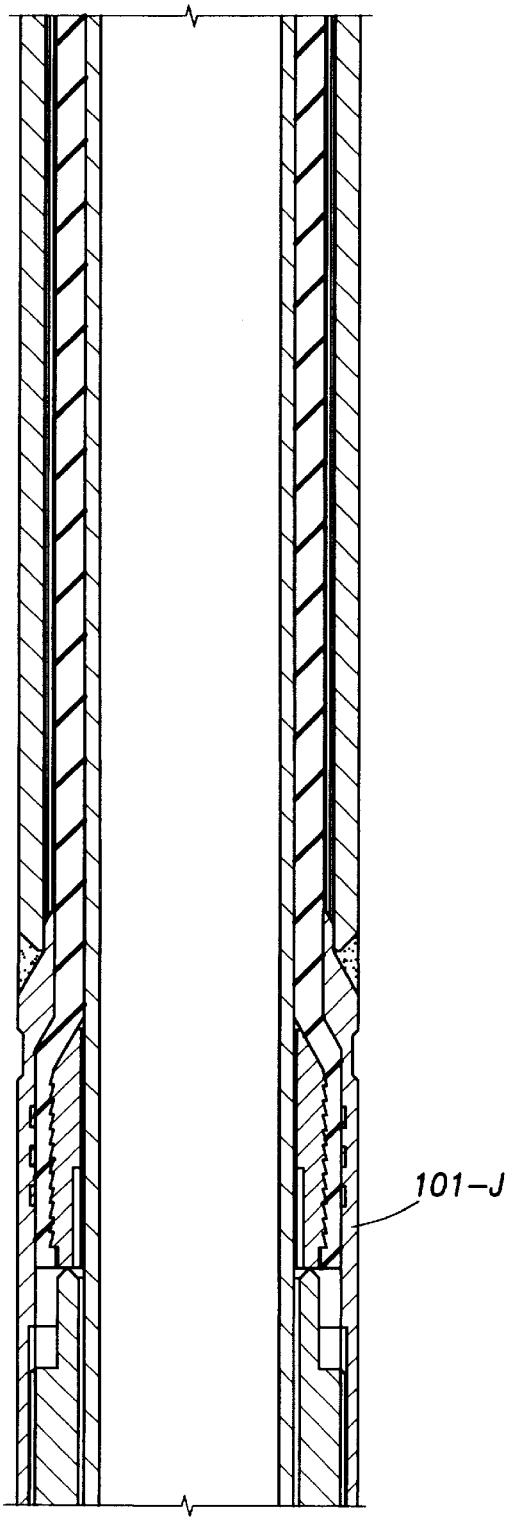
Figure 7G:
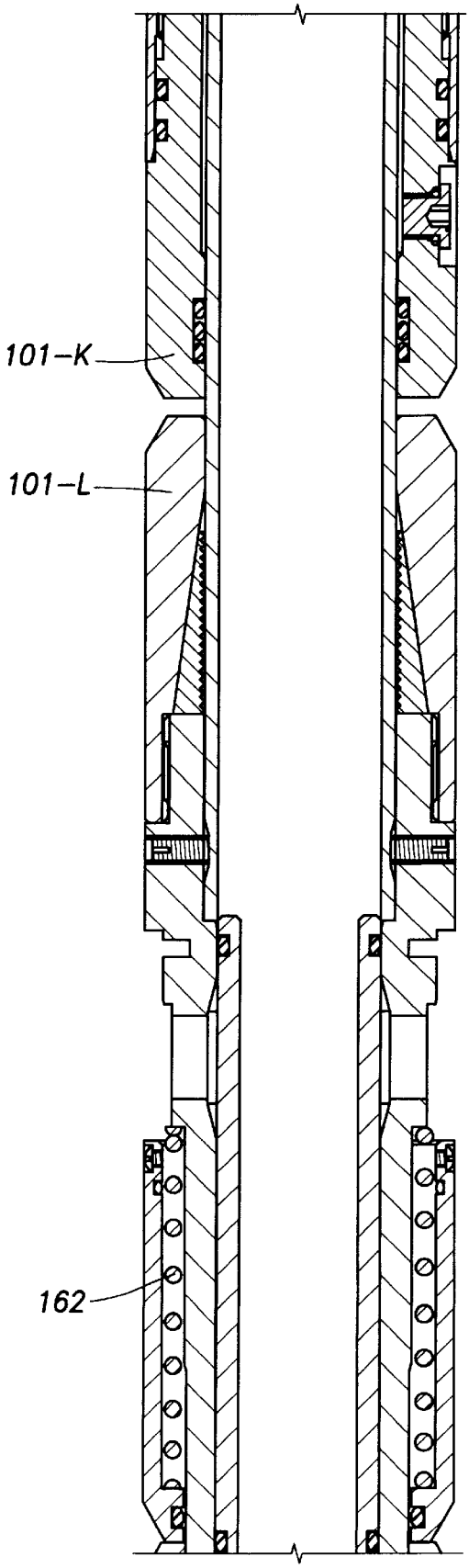
Figure 7H:
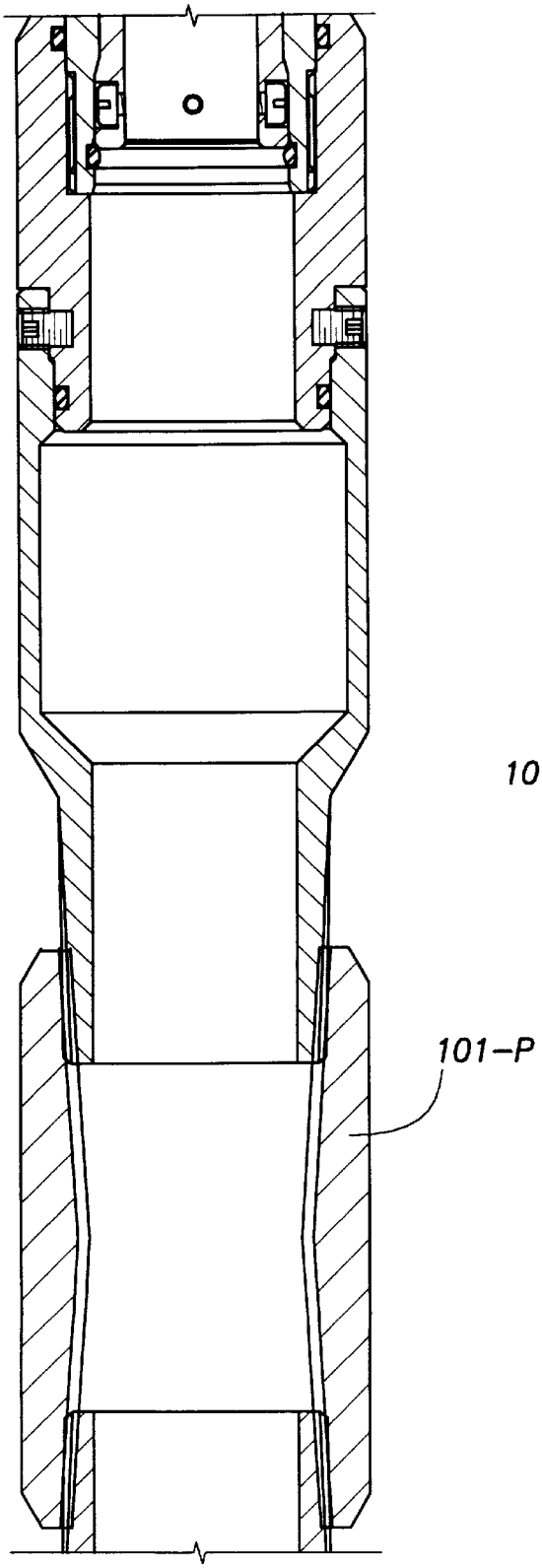
Figure 7I:
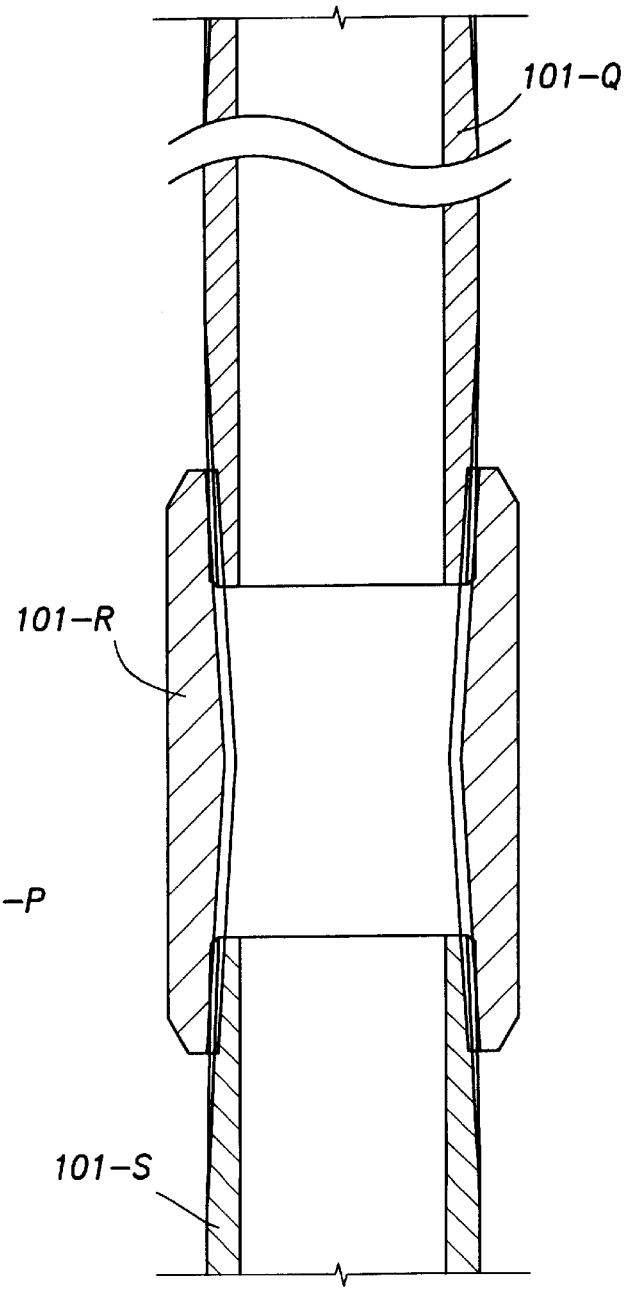
Figure 7J:
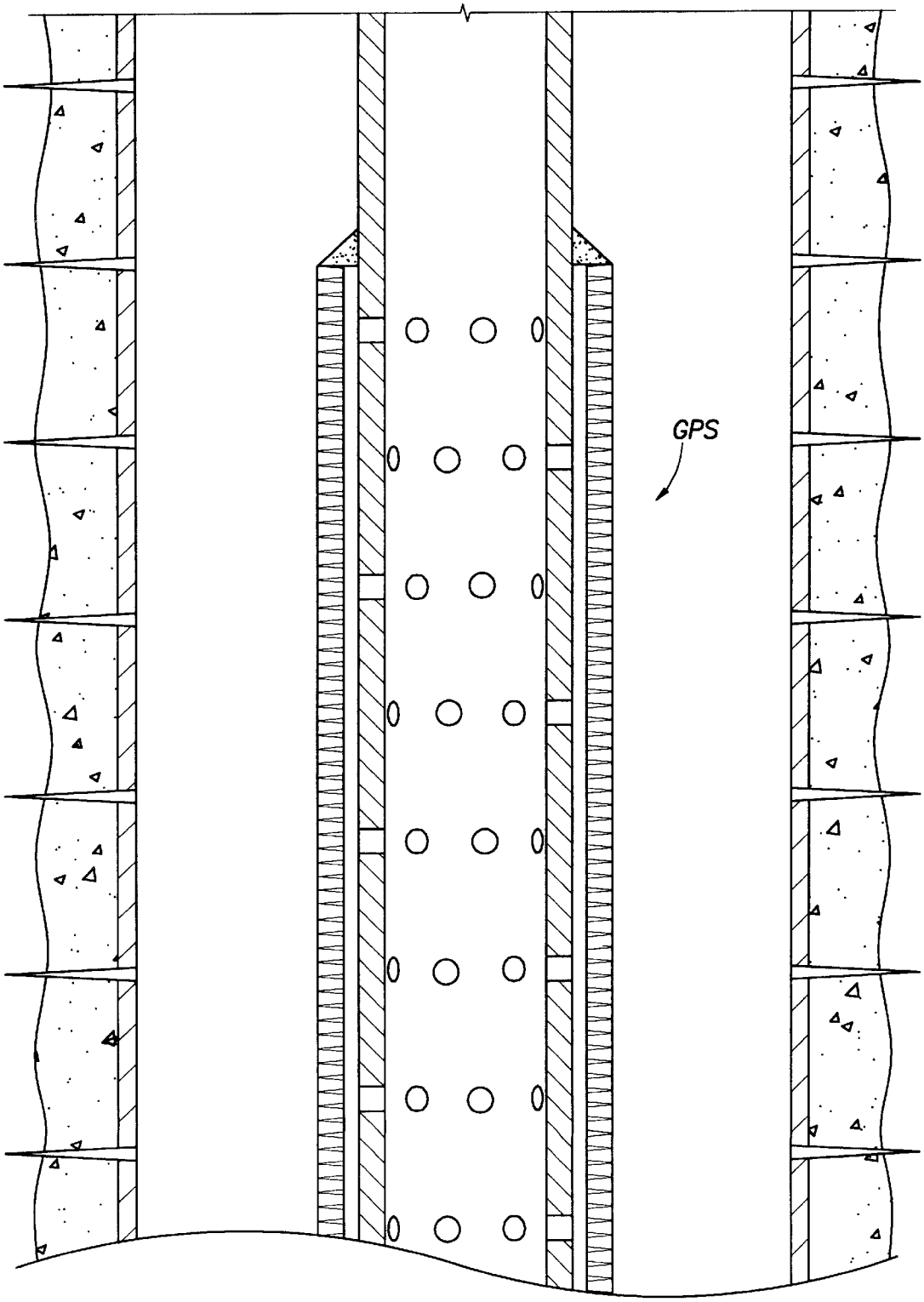
Figure 7K:
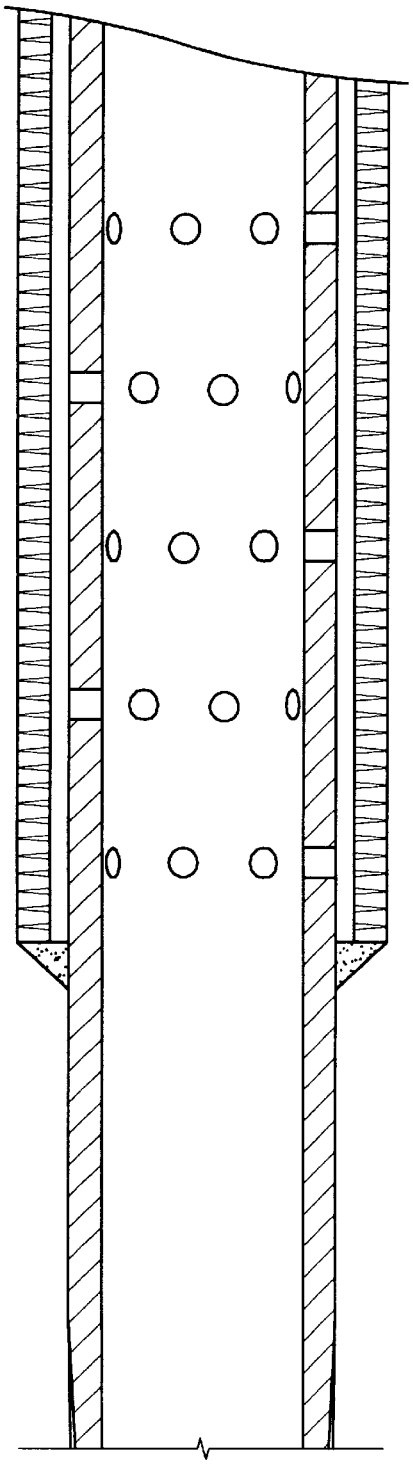
Figure 7L:
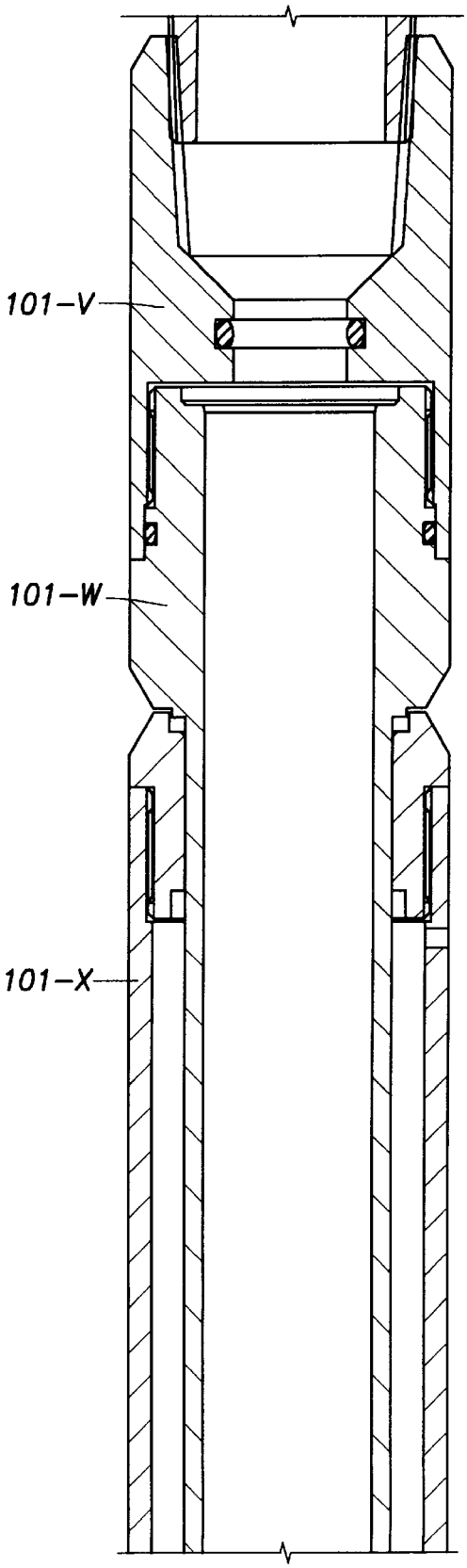
Figure 7M:
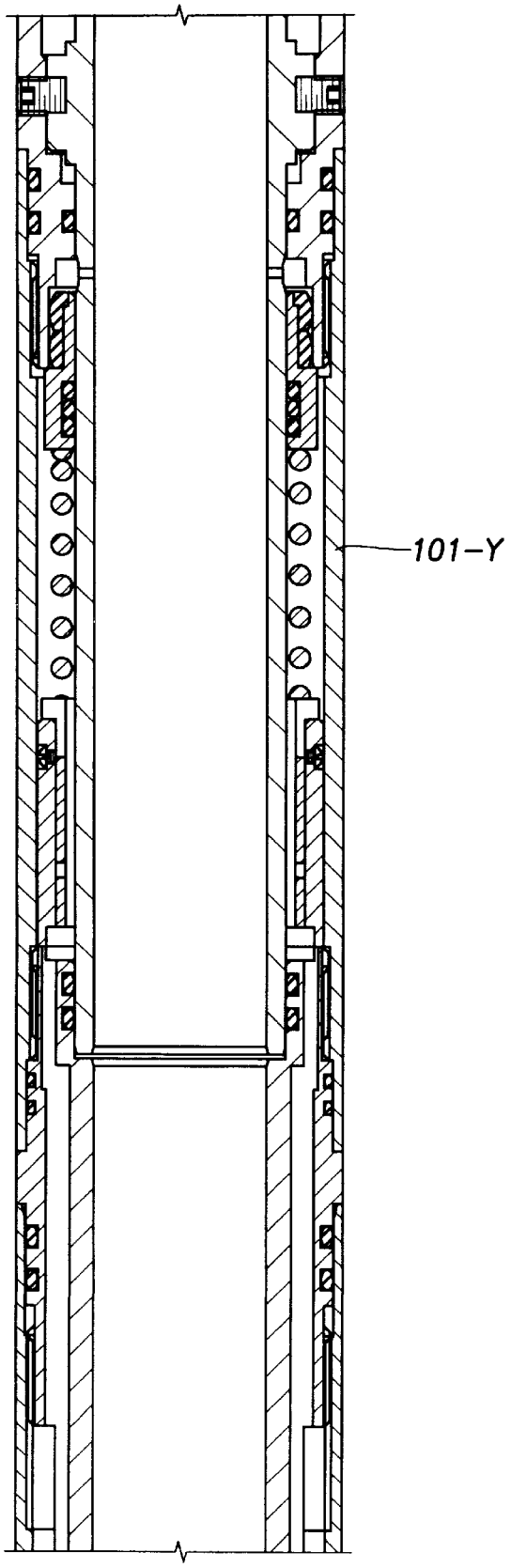
Figure 7N:
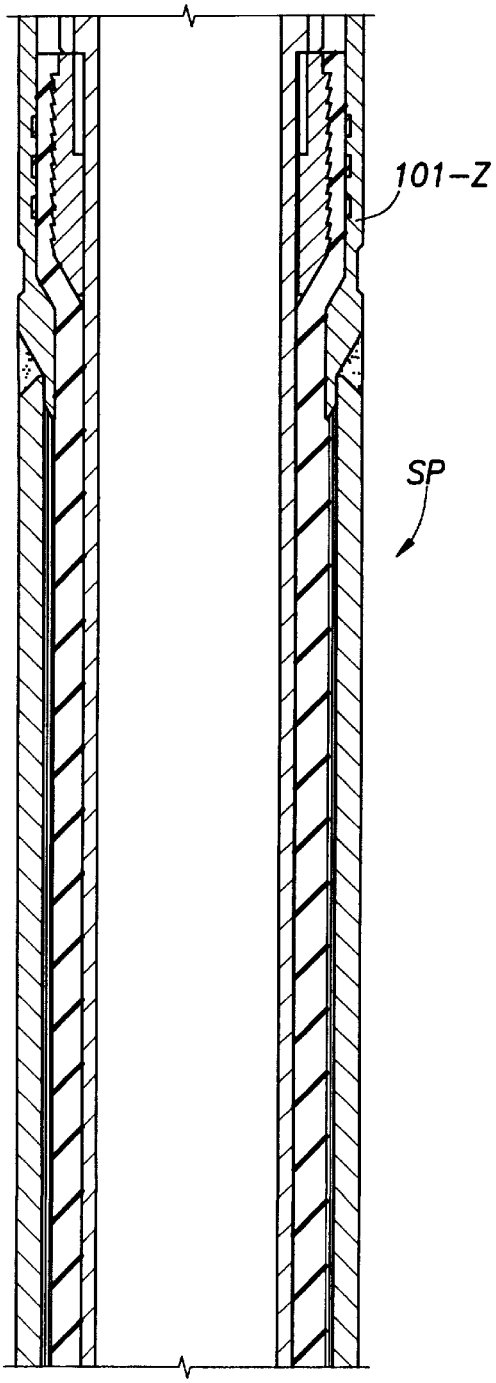
Figure 70:
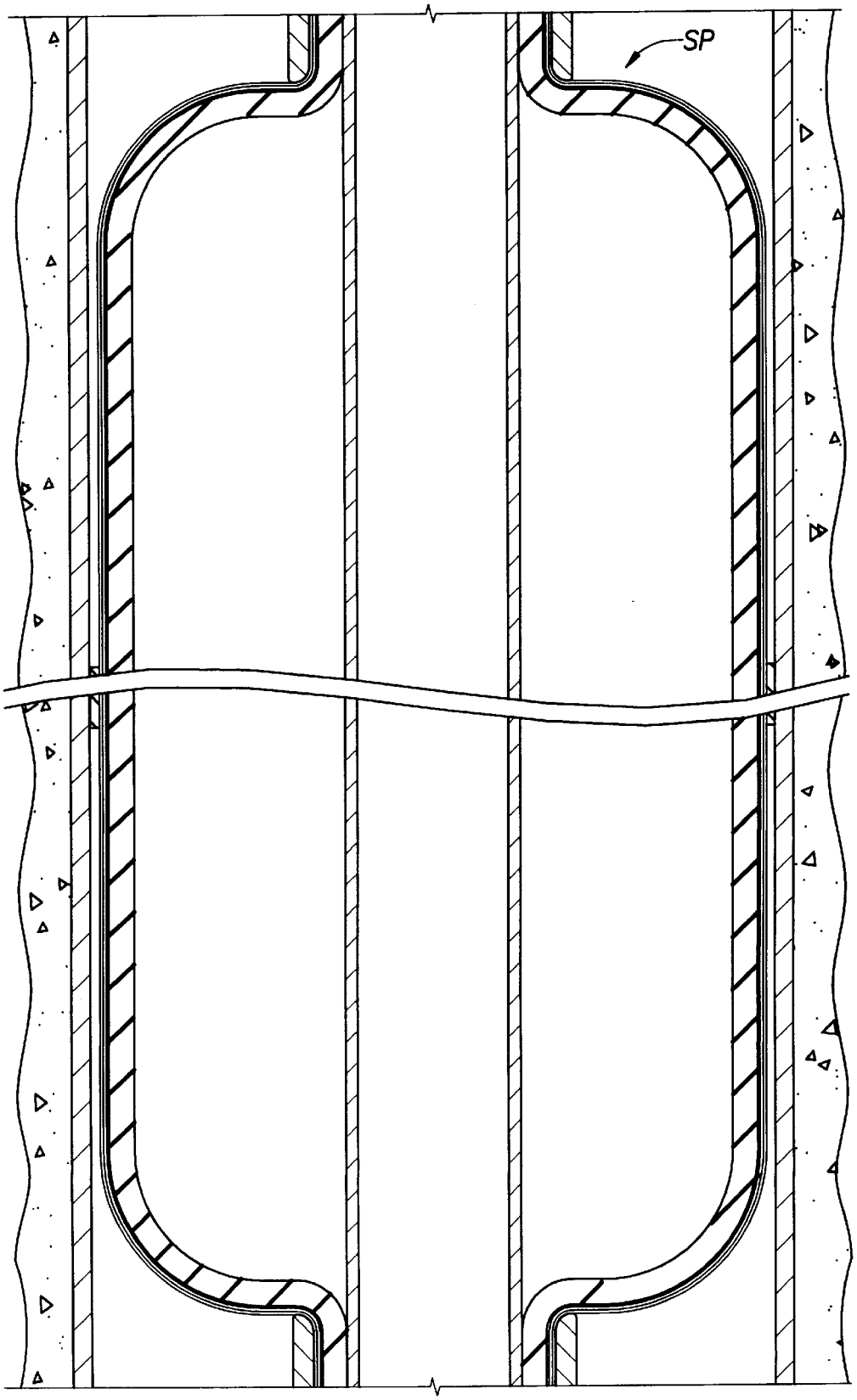
Figure 7P:
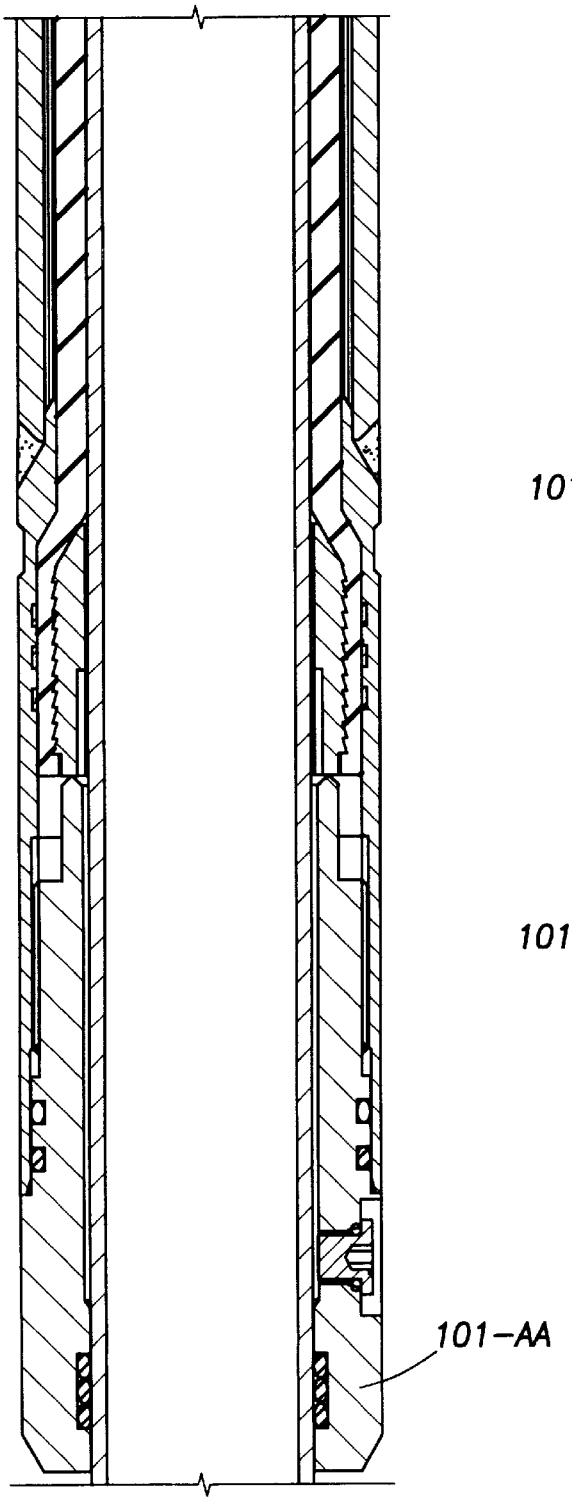
Figure 7Q:
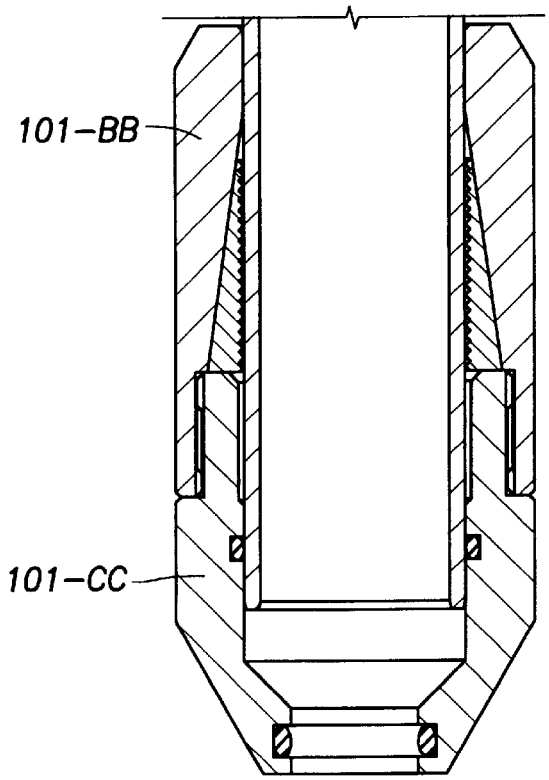

Retrieval of the Coiled Tubing and the Control Mandrel Subsequent to the Gravel Packing Operation FIGS. 7A–7Q constitute a continuous schematic cross-sectional elevational view of the apparatus 100 of the present invention subsequent to the completion of the gravel packing operation and withdrawal of the tubular conduit, the coiled tubing CT, out of the well W through the production tubing PT and the passageway within the Christmas tree assembly CTA. After the reverse circulation procedure, as shown in FIGS. 6A–6T or, in the event that reverse circulation is not necessary, after the gravel packing operation positioning of the apparatus 100 as shown in FIGS. 5A–5S, the coiled tubing CT is picked up such that the shear pins 103 disposed between the outer cylindrical housing 101 and the control mandrel 104 are sheared. This enables the control mandrel 101, the flow control cross-over assembly CX attached thereto and the washpipe to be retrieved out of the well. The isolation sleeve 200 is activated, as previously described, to bridge and close the gravel packing port 157 in the outer housing 101. The piston rod assembly 133 which is secured to the washpipe is moved out of the assembly or outer housing 101 with the control mandrel 104.

The portions of the apparatus 100 now remaining in the well are as shown in FIGS. 7A–7Q and production fluids may be produced through the screen members to the interior of the outer cylindrical housing 101, thence out the upper most end of the outer cylindrical housing 101 and through the production tubing PT at its distal end DE thereof through the Christmas tree CT and into the flow line FL. This operation is illustrated schematically in FIG. 2.

It will be appreciated that when the apparatus 100 is retrieved from the well with the remaining portions as shown in FIGS. 7A–7Q, a rat hole RH is provided so that when fines FS are produced, they will pass into the gravel pack screen GPS and go downwardly due to lack of sufficient lift velocity for the production fluids and continue to down and out into rat hole RH without accumulation and sanding up of the gravel pack in the annular area around the gravel pack screen GPS and tail tell screen TTS. The sump packer SP has a through bore tail pipe TP at its lower end which communicates to the rat hole RH within the well W, as shown.

One Trip Gravel Pack Circulating System Without Necessity of Washpipe

Figure 8A:
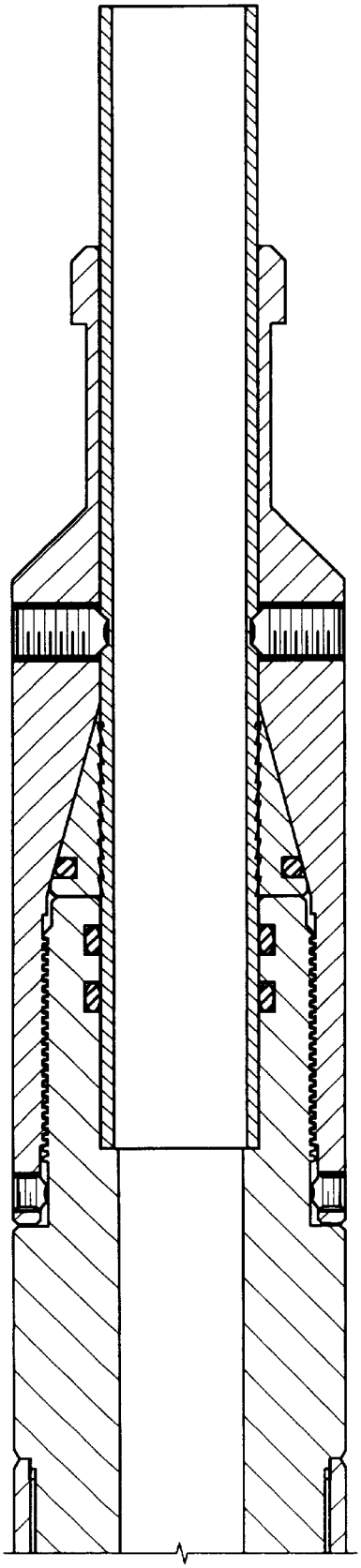
FIGS. 8A–8N are views similar to the FIGS. 4–6 sets, illustrating a modification to the present apparatus for one trip circulating without the utilization of the washpipe.
Figure 8B:
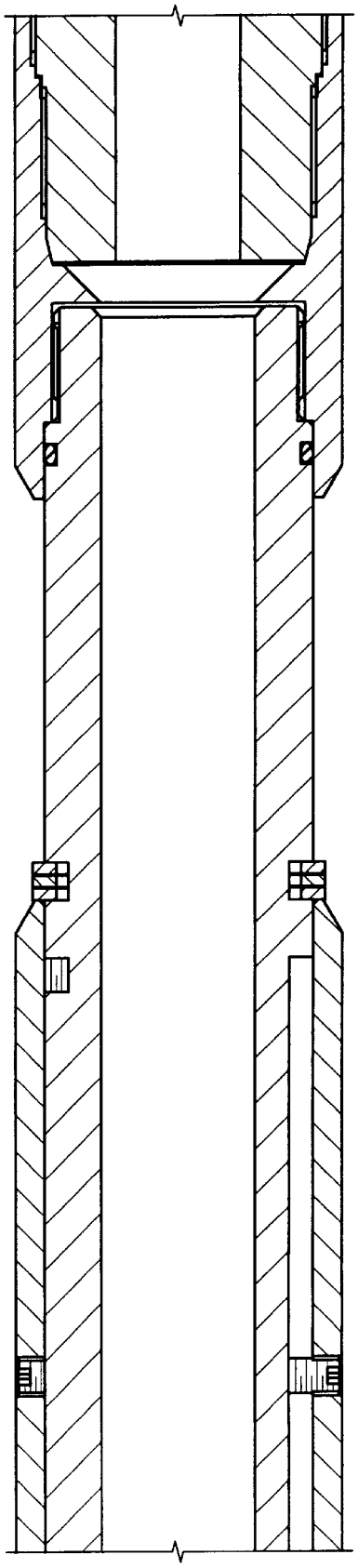
Figure 8C:
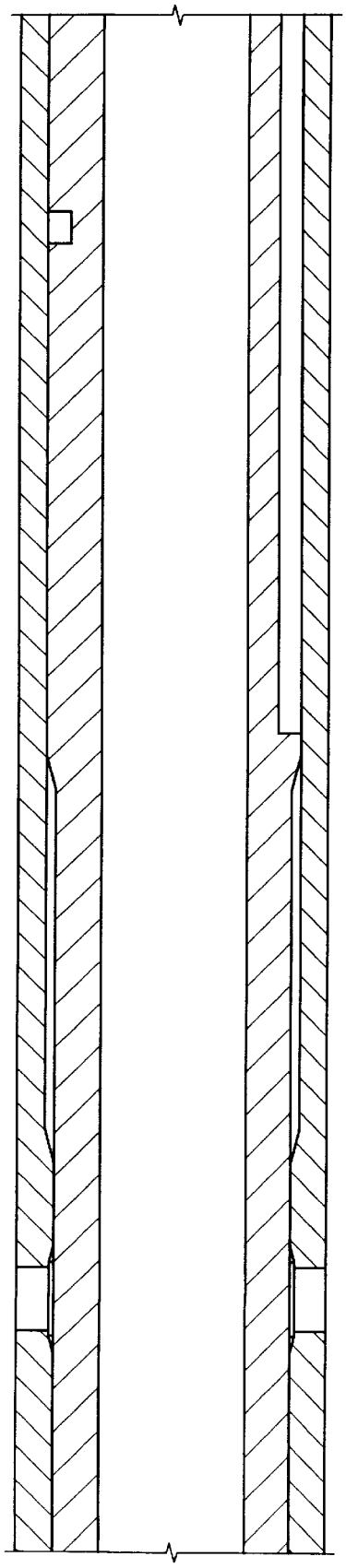
Figure 8D:
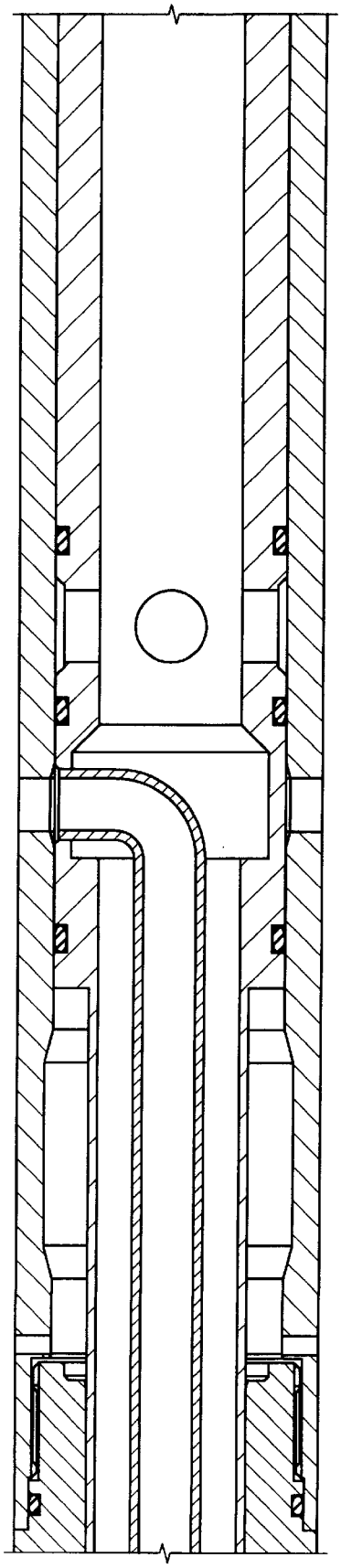
Figure 8E:
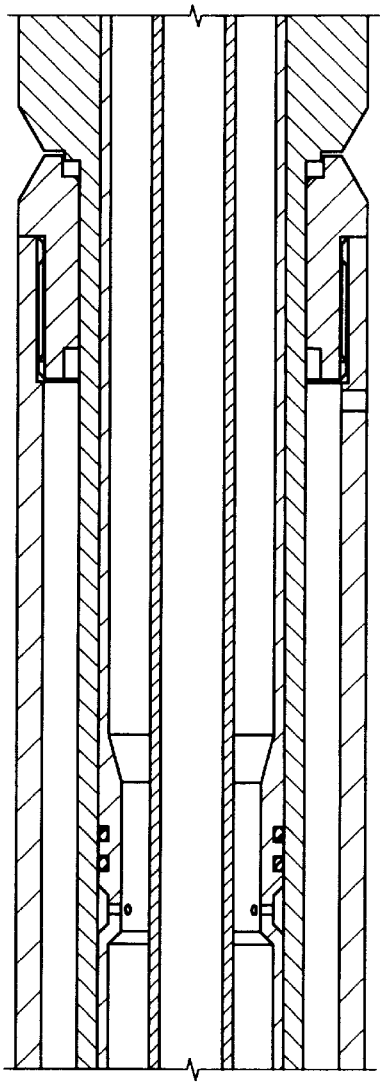
Figure 8F:
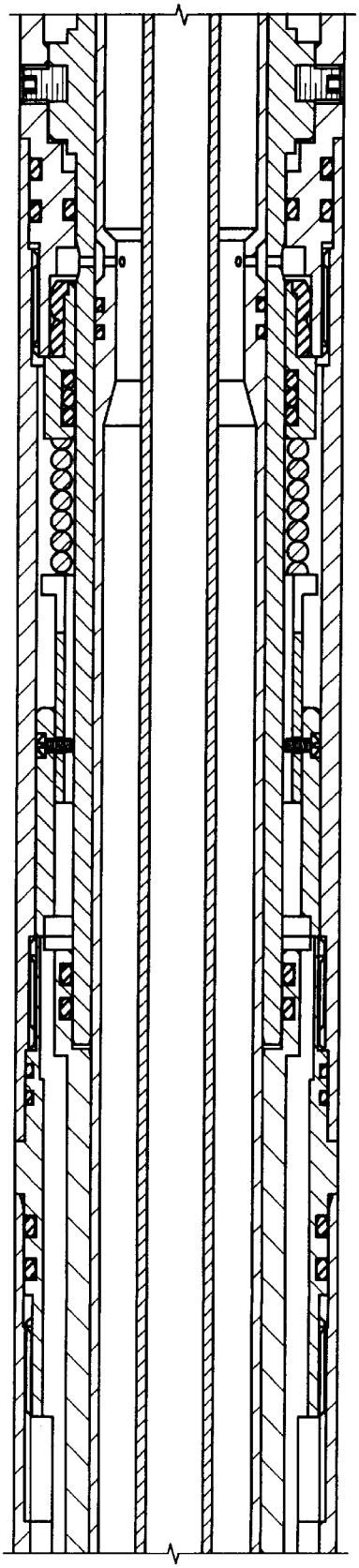
Figure 8G:
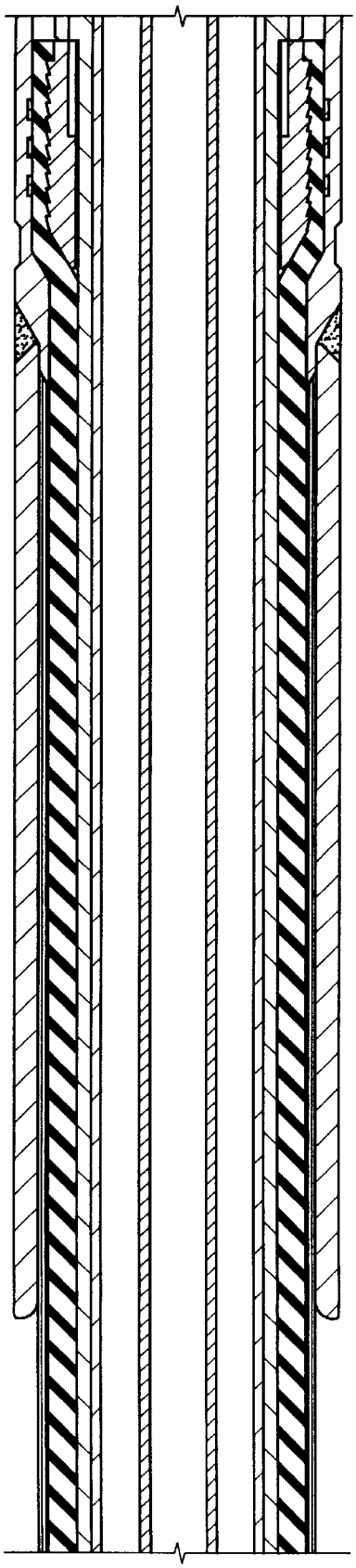
Figure 8H:
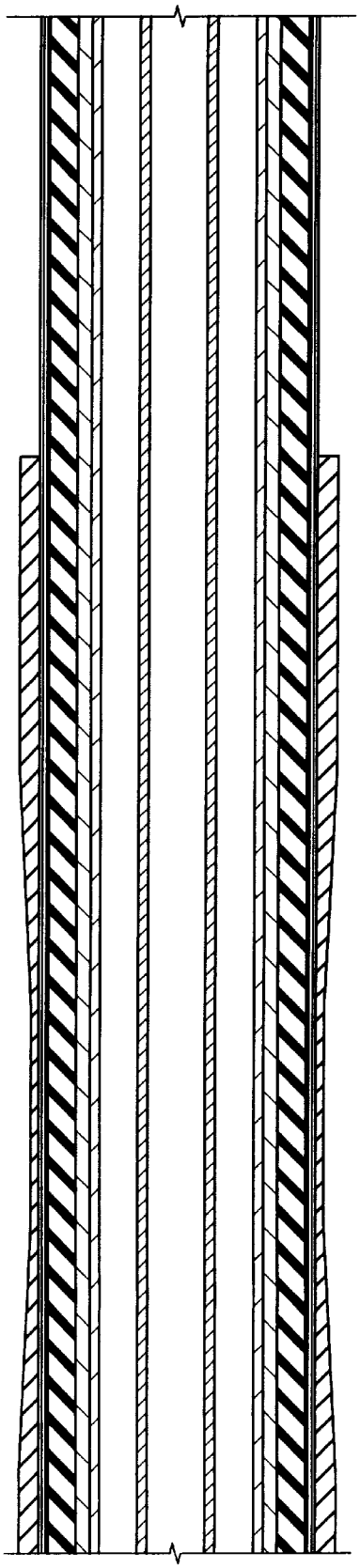
Figure 8I:
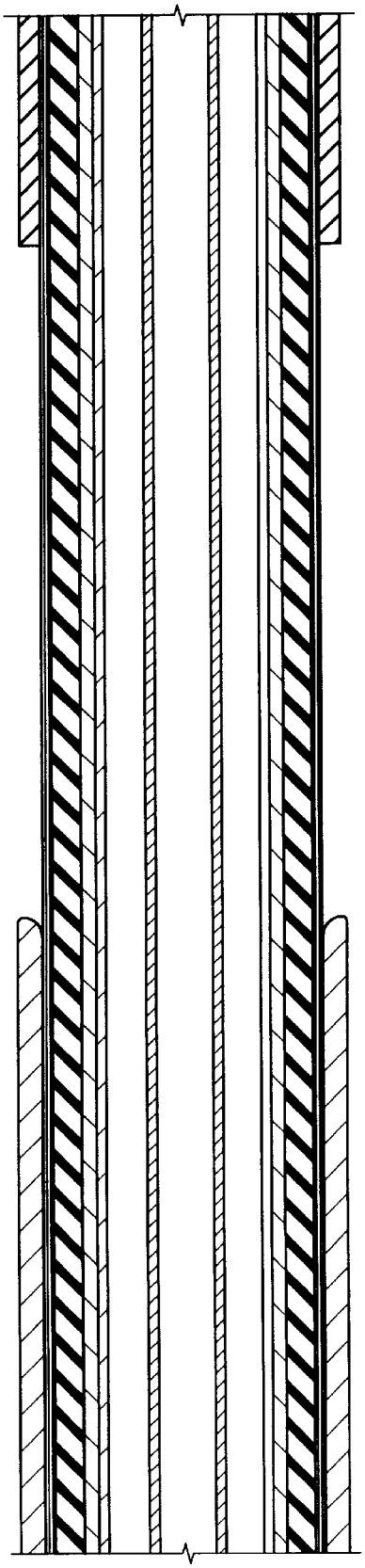
Figure 8J:
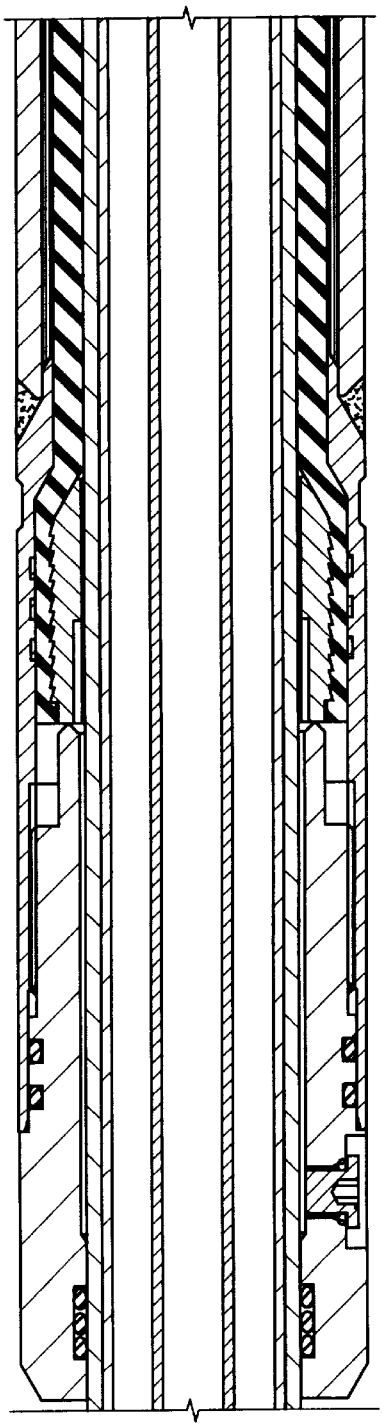
Figure 8K:
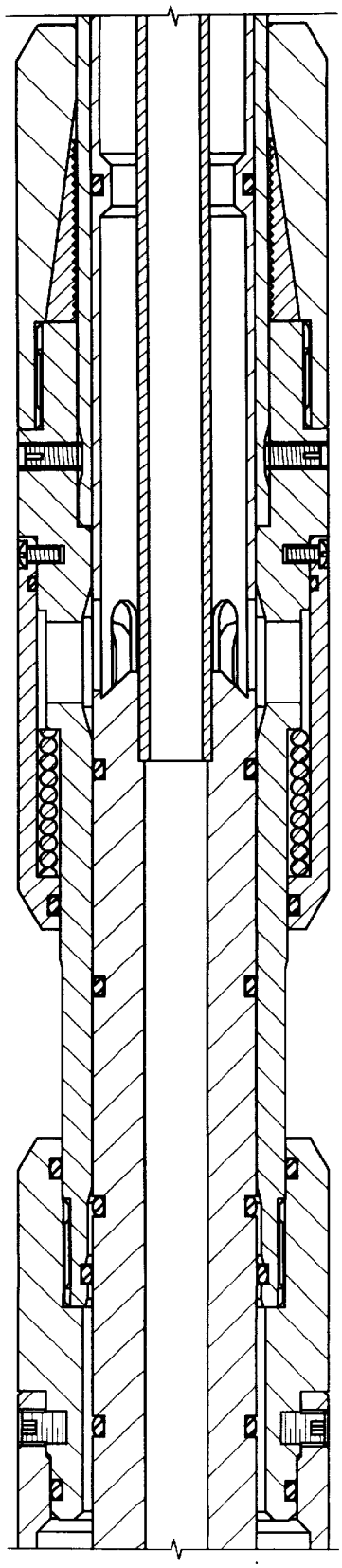
Figure 8L:
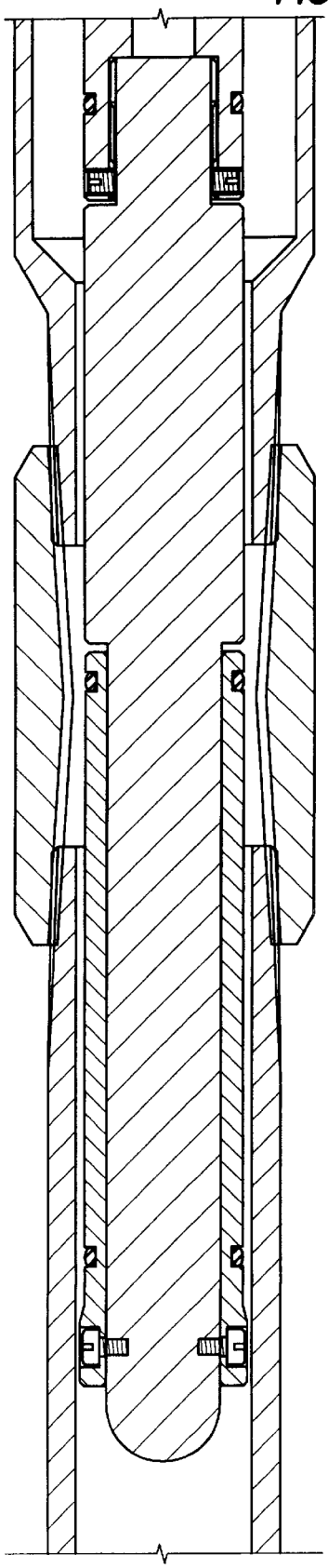
Figure 8M:
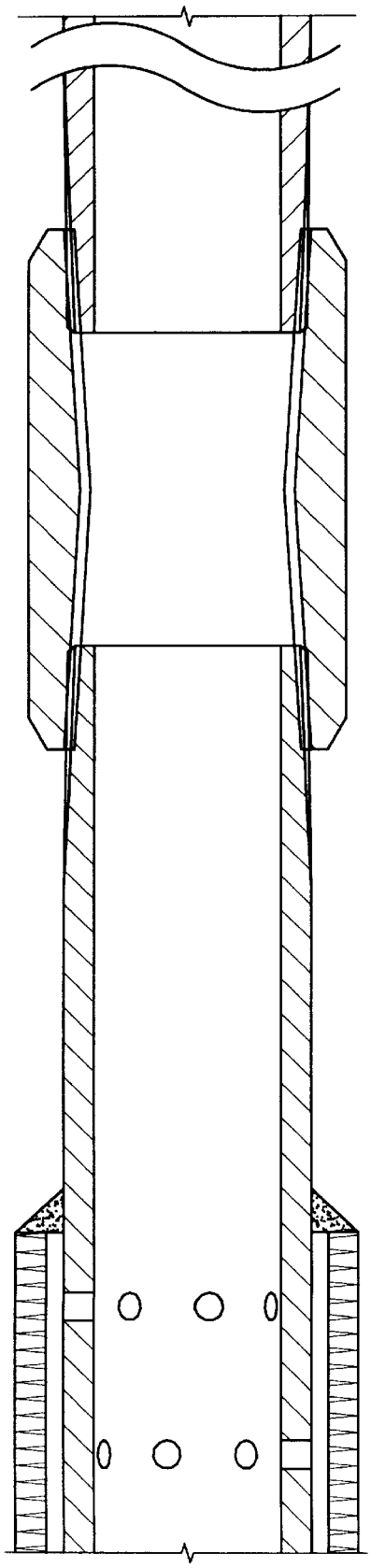
Figure 8N:
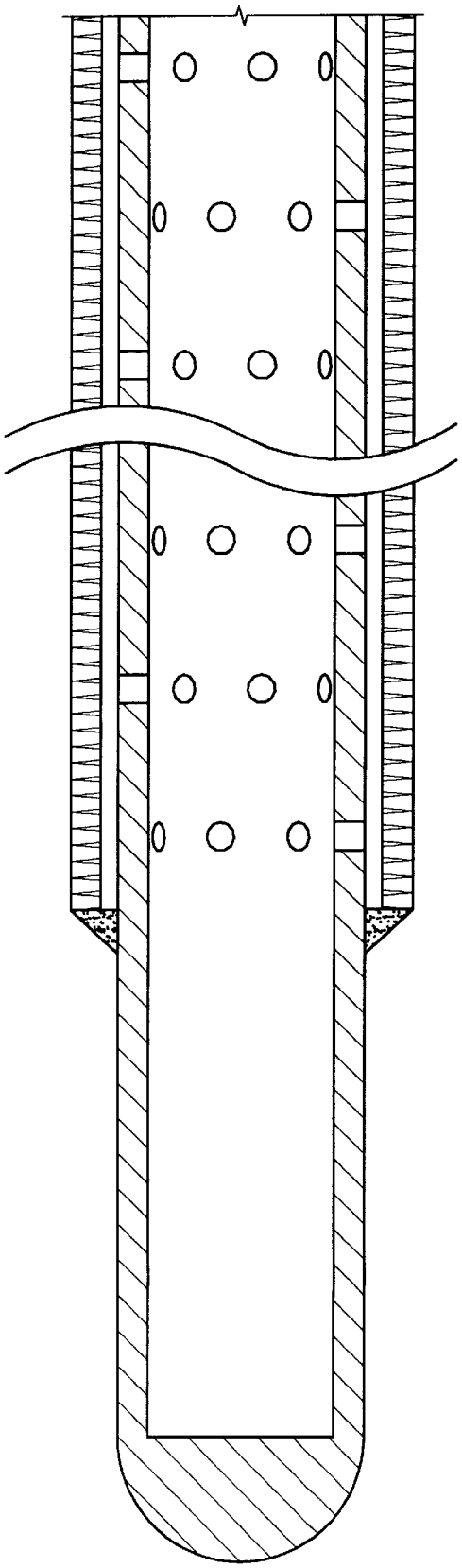

A feature of the present invention is the ability of the apparatus 100 to be easily converted and run such that gravel pack circulating may be done without necessity of a washpipe. The configuration of the apparatus 100 for such operation is shown as in FIGS. 8A–8N and the apparatus 100 is made up at the surface of the well and pinned in the run-in position and run into the well such that the outer housing 100 and the control mandrel 104 are shifted to a telescopically expanded position whereby the expansion retainer rings 101A are in expanded relationship to prevent telescopic contraction between the members 101 and 104. The apparatus of this configuration does include the incorporation of the flow control cross-over assembly CX and, when in the run-in position, the telescopic shifting of the cylindrical housing 101 relative to the control mandrel 104 positions the flow control cross-over assembly CX such that the inner concentric fluid flow passageway 115 is in direct communication with the port 111 in the outer cylindrical housing 101. The check ball 181 is placed into the apparatus to provide a terminated end to the flow passageway 115.

Since it is not necessary to utilize a washpipe with this configuration, the washpipe is replaced by a solid steel bridge plug assembly or platform 600 which is secured at the lowermost end of the cross-over assembly CX and threadly secured to the lowermost end of the diverter sleeve 190. The assembly 100 is lowered into the well on the coiled tubing 100, as described above.

When such conversion is made to the apparatus 100, it will be appreciated that only one packer may be utilized, and it will be the inflatable gravel pack packer GPP. A bridge plug or platform will have been previously placed into the well and otherwise actuated such as by wireline extending through the production tubing PT, electric line, or other operation of known means and ways. The gravel pack packer GPP is set, as described earlier. Accordingly, the flow passageway 114 through the cross-over tool CX is utilized to set the gravel pack packer GPP and to thereafter open the sliding sleeve 160 to deposit the carrier fluid with the gravel exterior of the apparatus 100. In this position, there is no return fluid flow path for the carrier fluid to the top of the well and the gravel may be squeezed into place by closing a valve in the Christmas tree, or the like, to close the production tubing PT and applying pressure through the conduit CT and through the apparatus 100. This configuration of the apparatus 100 may be shifted from the position shown in FIGS. 8A–8N to the position as shown in FIGS. 6A–6T for reverse circulation, such that the ports 110 within the control mandrel 104 are aligned with the ports 109 in the outer cylindrical housing 101 for reverse circulation, or normal circulation, for clean out purposes, as required.

Dedicated Circulating Squeeze Tool Configuration

Figure 9A:
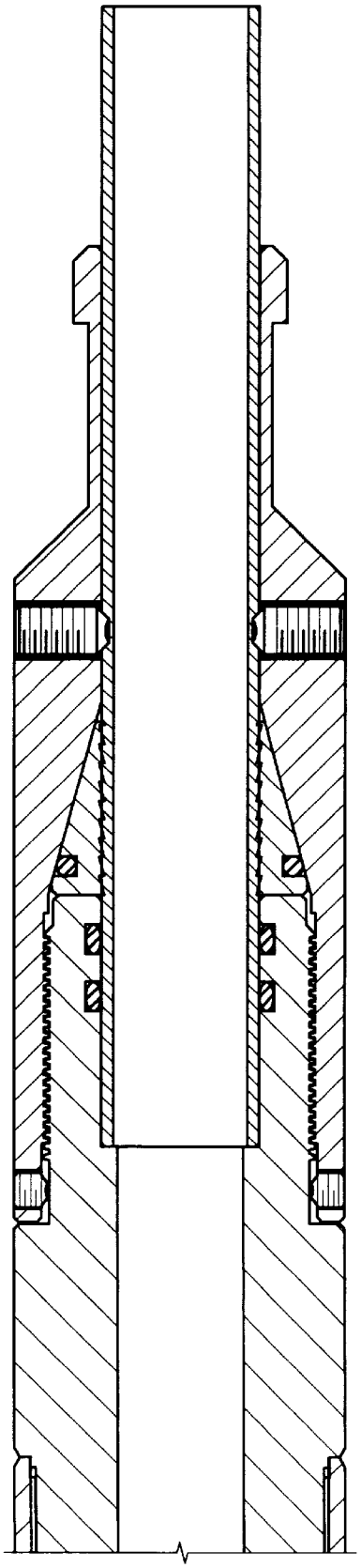
FIGS. 9A–9N constitute similar views of another configuration of the present invention, illustrating the components incorporated to provide a dedicated circulating squeeze tool, with the mandrel changed relative to the cross-over tool and the absence of the utilization of the washpipe.
Figure 9B:
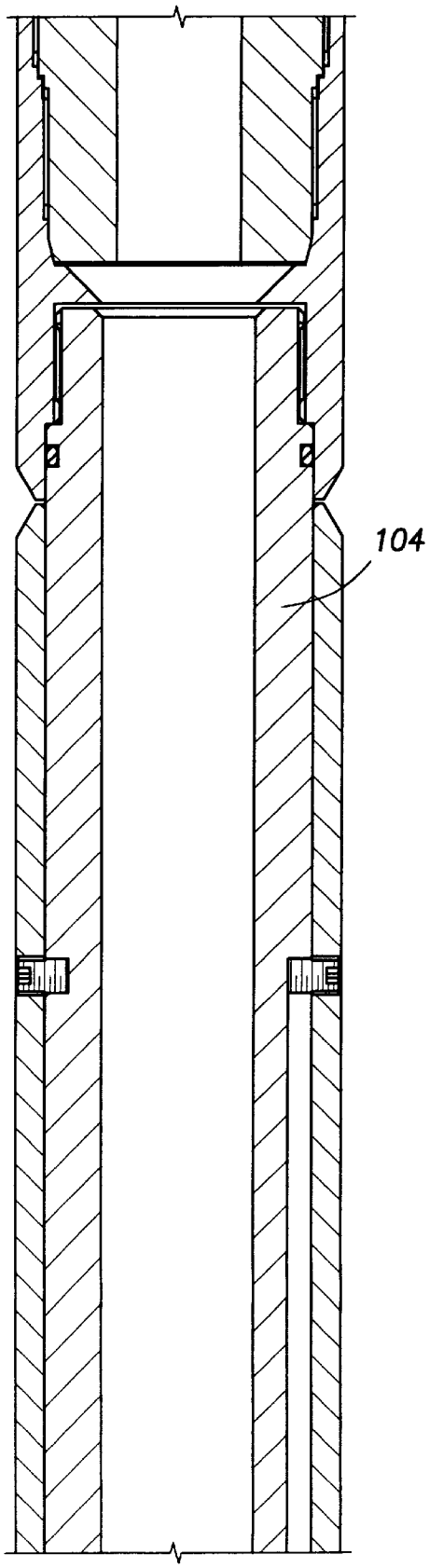
Figure 9C:
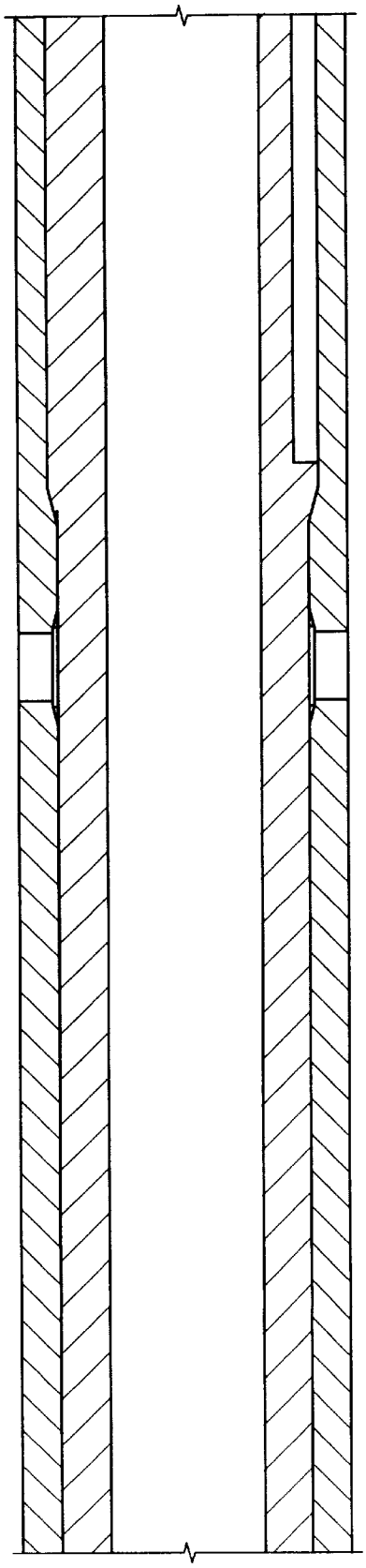
Figure 9D:
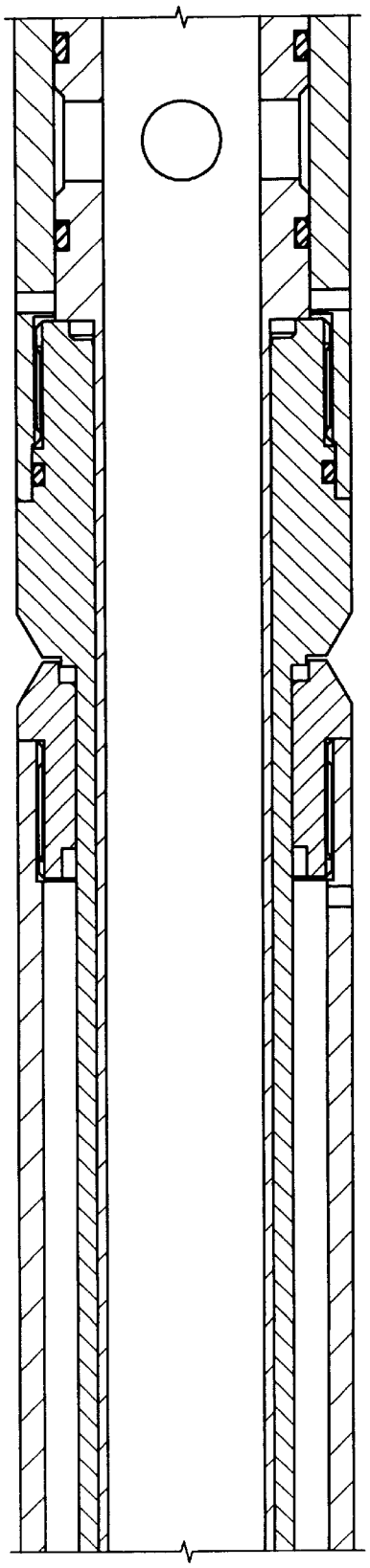
Figure 9E:
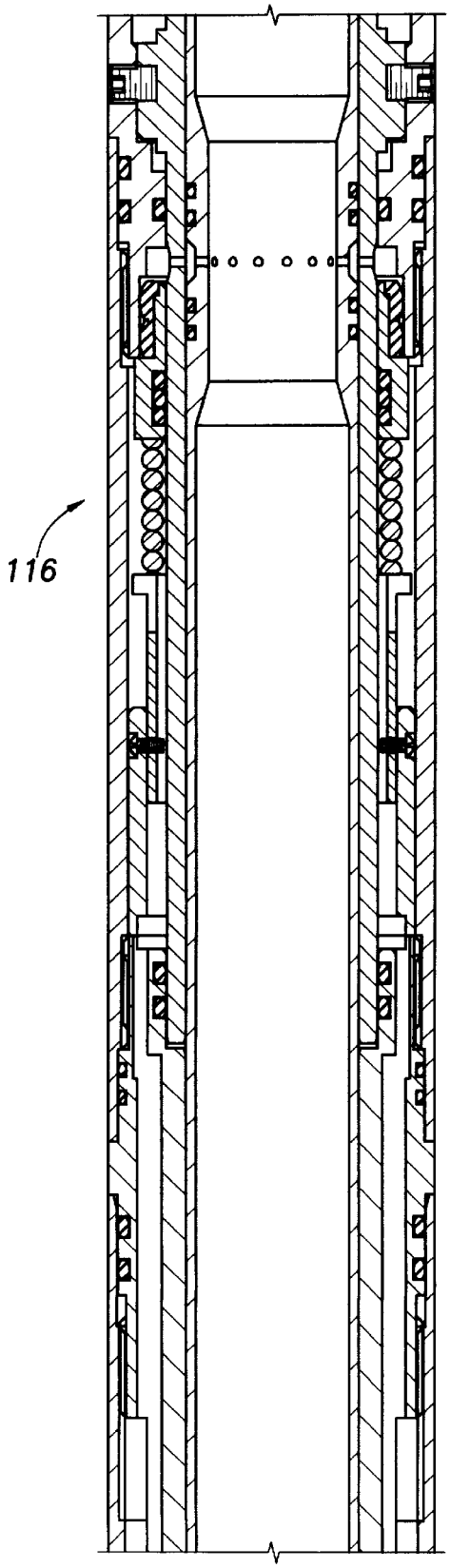
Figure 9F:
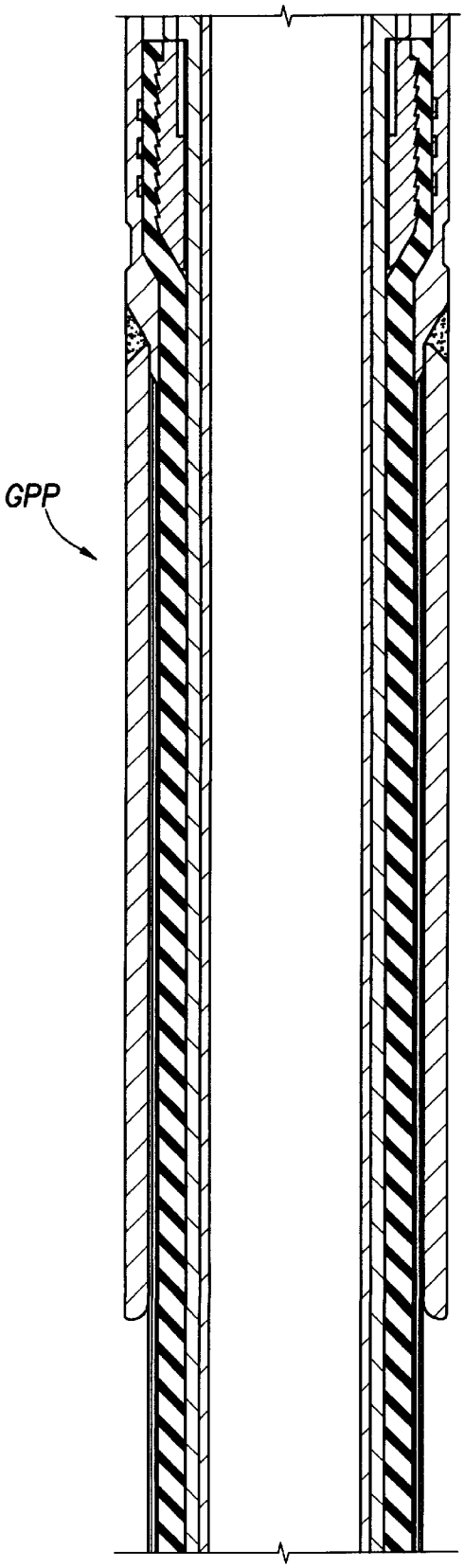
Figure 9G:
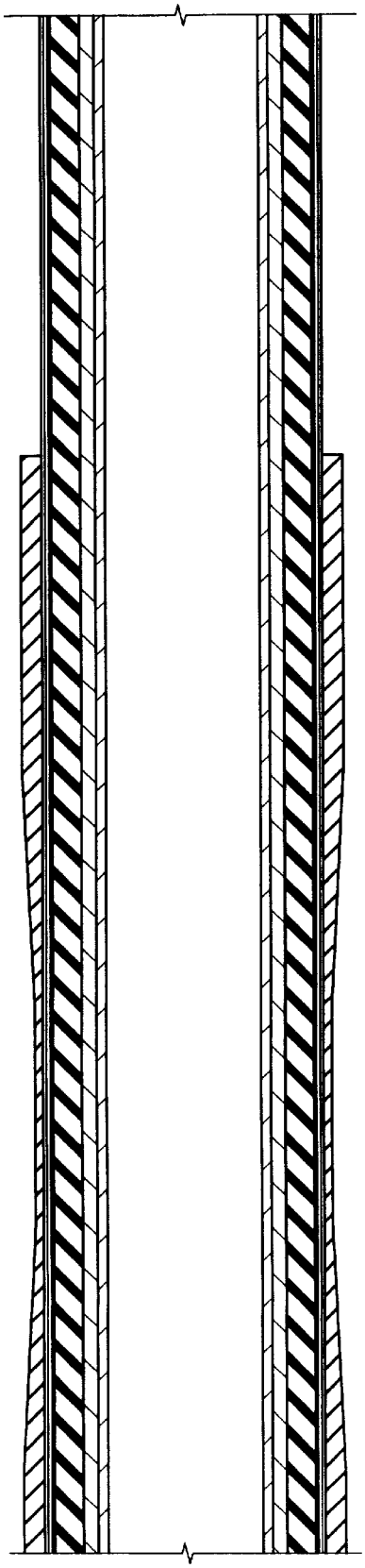
Figure 9H:
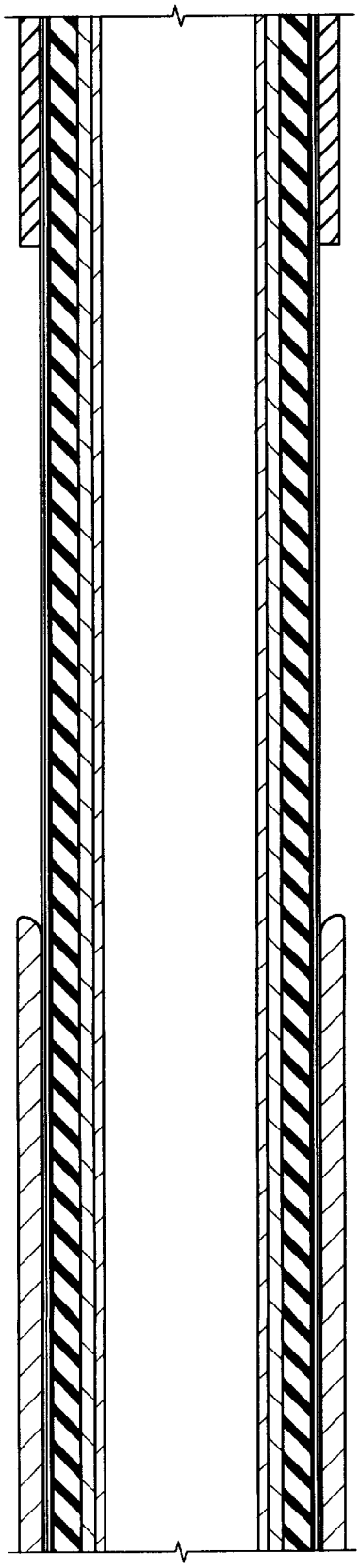
Figure 9I:
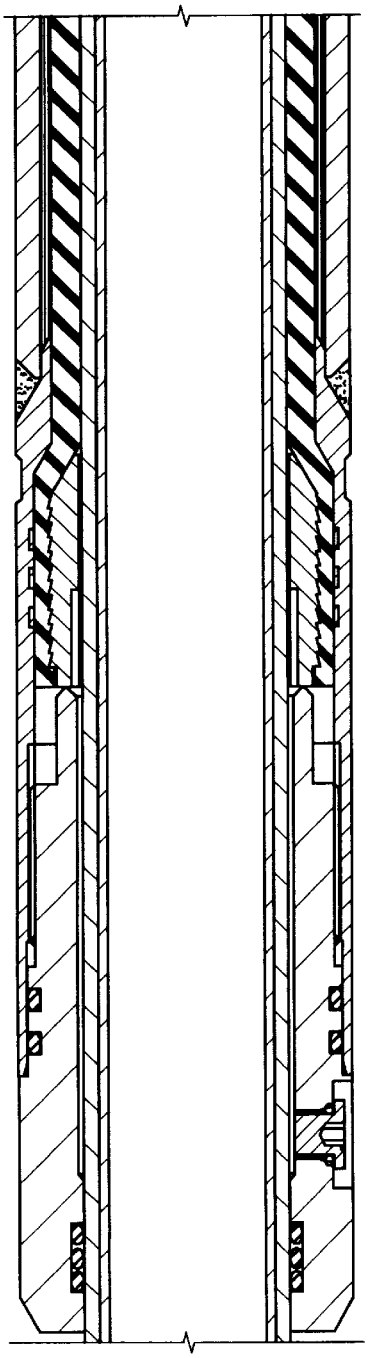
Figure 9J:
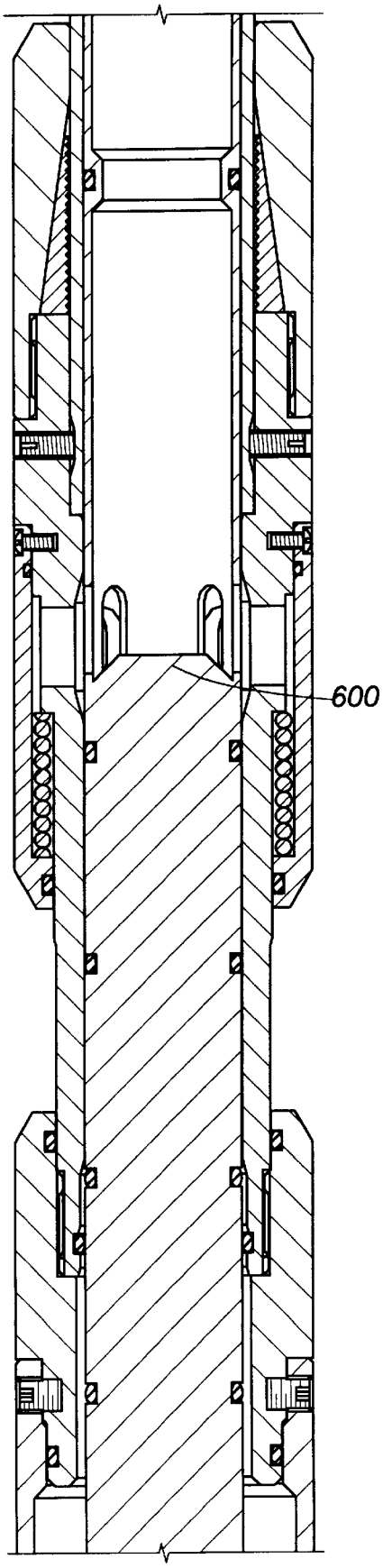
Figure 9K:
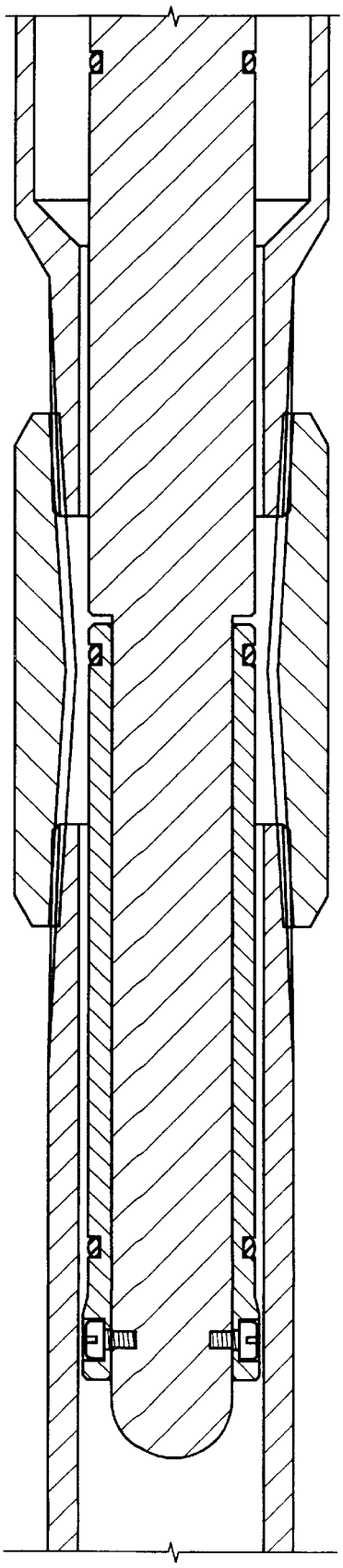
Figure 9L:
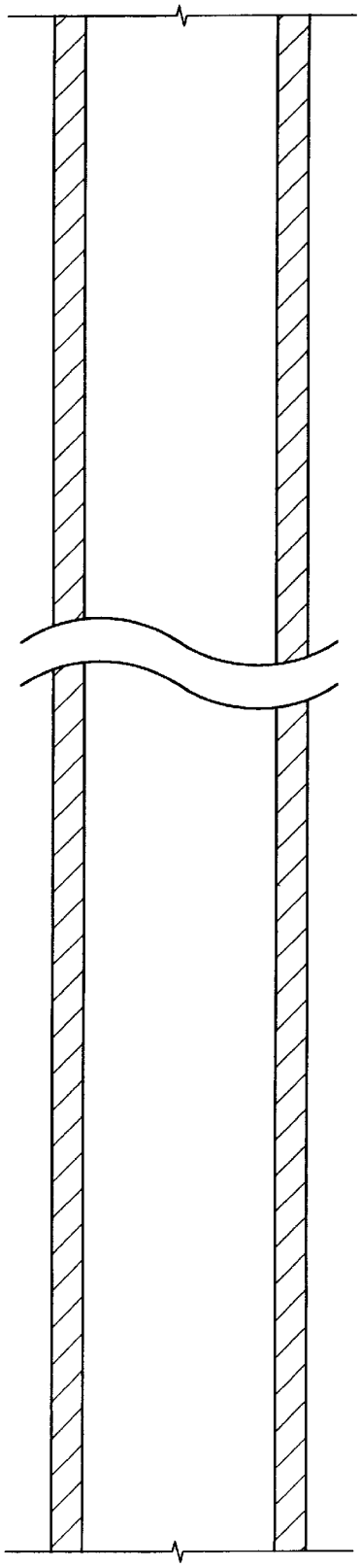
Figure 9M:
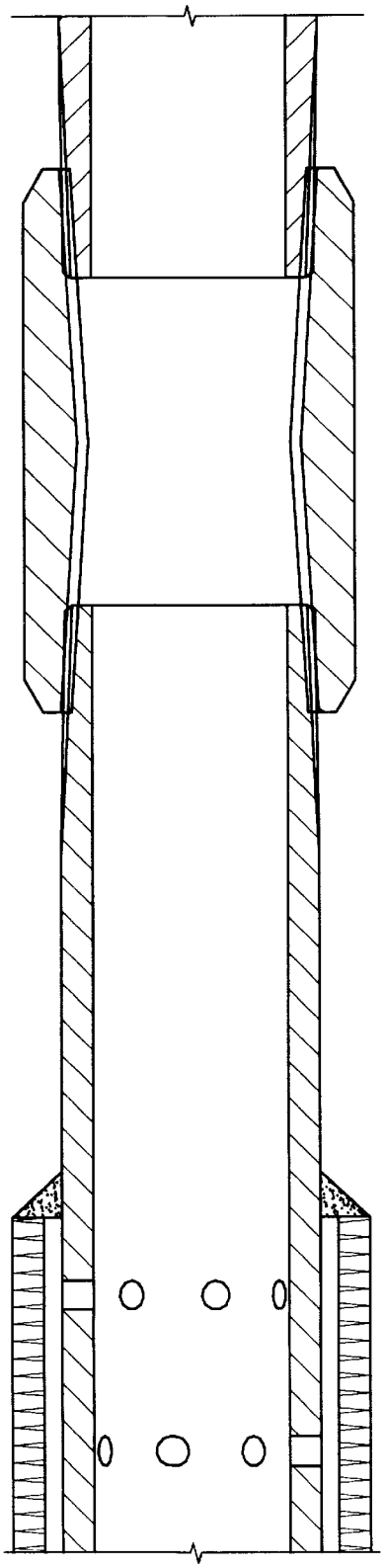
Figure 9N:
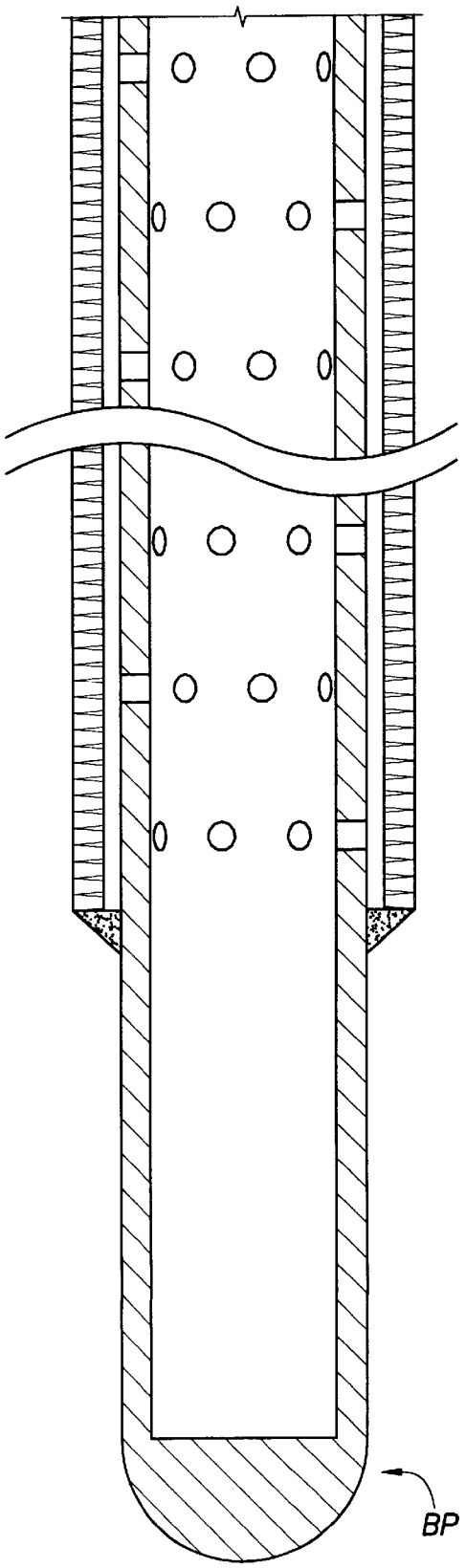

Now referring to FIGS. 9A–9N, there is shown still another alternative configuration of the apparatus 100 of the present invention. This configuration also contemplates the use of only one packer GPP, which is of the inflatable elastomeric construction as described above. The flow control cross-over assembly CX is not provided, but the control mandrel 104 does contain thereon the valving components which are utilized in association with the first valving means 116 for the setting of the gravel pack packer GPP which is, of course, carried on the outer housing 101, as in all configurations. The production or gravel pack screen GPS is provided at the lowermost end of the outer housing 101 and is isolated by the plug BP, or other terminating closed end or platform. The diverter assembly 600 is provided on the mandrel 104 in the place of the washpipe 181. The apparatus shown in FIGS. 9A–9N is secured to the coiled tubing and run into the well such that the outer cylindrical housing 101 and the control mandrel 104 are in telescopically retracted run-in position. This position is secured by pinning of the shear screws 103A as described above. The gravel pack packer GPP is inflated by pressure applied within the control mandrel 104 through the coil tubing CT and through the passageway 123 of the first valving means 116, as described above, to actuate the inflatable packer GPP to the completely expanded condition to seal against the inner wall C of the well W, as described earlier. Again, subsequent increase in pressure causes the shear screws 161 in the sliding sleeve 160 to shear, urging the spring 162 to bias the sleeve downwardly and open the port 157 to the interior of the outer housing 101. Now, the carrier fluid with the gravel may be transmitted through the coiled tubing CT and through the apparatus 100, as described, then to the well annulus below the set gravel pack packer GPP through the open port 157, to be deposited around the exterior of the production screen PS. Reverse circulation with this configuration may occur by picking up the coiled tubing CT, as described above, and moving the device to the position as shown in FIGS. 6A–6T.

Although the invention has been described in terms of specified embodiments which are set forth in detail, it should be understood that this is by illustration only and that the invention is not necessarily limited thereto, since alternative embodiments and operating techniques will be come apparent to those skilled in the art in view of the disclosure. Accordingly, modifications are contemplated which can be made without departing from the spirit of the described invention.

What is claimed and desired to be secured by Letters Patent is:

1. An apparatus selectively securable to a tubular conduit for gravel packing a production zone having an annular area within a subterranean well including an inner wall, said well further having a production conduit with an inner diameter defining a fluid passageway therethrough and terminating at a distal end within said well, said production conduit extending through a Christmas tree assembly having a controlled passageway through which said apparatus and said tubular conduit may be introduced and withdrawn through said production conduit, said apparatus comprising:

(1) means for selectively securing said apparatus to said tubular conduit;

(2) tubular means having a flow passageway disposed therethrough and extending to said selective securing means;

(3) a first expandable elastomeric inflatable element means having an outer wall movable from an initial retracted and running condition wherein the outer diameter of said outer wall is less than the inner diameter of said production conduit and the passageway through the Christmas tree assembly, and so movable by pressure applied thereto and within said tubular conduit above said Christmas tree assembly, to increase the diameter of said outer wall to at least twice the diameter of said outer wall when said inflatable element means is in said initial running condition, to expanded condition to seal the outer wall of the inflatable element means against the inner wall of the well exterior of and below the distal end of said production conduit; and (4) means for introducing gravel in a carrier fluid through said tubular conduit and through said inflatable element means after expansion to expanded condition and thence around the exterior of said apparatus and below said elastomeric inflatable means and within said annular area.

2. The apparatus of claim 1 further including particle isolation means defining a flowway therein and further exteriorally defining said annular area in said wellbore below the seal of the expanded elastomeric inflatable element means within which gravel in the carrier fluid may be deposited around the exterior thereof and for permitting receipt of the carrier fluid through said flowway for circulation within the apparatus and the tubular conduit and through the passageway in the Christmas tree assembly.

3. The apparatus of claim 1 or claim 2 further including means for selectively squeezing the gravel in the carrier fluid within the annular area in the production zone by application of pressure within the tubular means through the apparatus.

4. The apparatus of claim 1 further comprising particle isolation means for blocking the travel of sized particulate matter within the annular area into said apparatus and for permitting entry therethrough of the carrier or production fluid without the sized particulate matter; and well sealing means for bridging the annular area of the production zone below the particle isolation means.

5. The apparatus of claim 4 wherein said well sealing means is disposed in said well through said passageway through said Christmas tree assembly and positioned within said annular area below said production zone prior to activation of said expandable elastomeric inflatable element means.

6. The apparatus of claim 1 further comprising a second expandable elastomeric inflatable element means disposed on said tubular conduit; said first expandable elastomeric inflatable element means being placeable in sealed position within said well above said production zone and said second expandable inflatable element means being placeable in sealed position within said well below the production zone; means for activating expansion of said first expandable elastomeric inflatable element means through fluid pressure applied through said tubular conduit; and means for activating expansion of said second expandable elastomeric inflatable element means prior to activation of said means for activation of expansion of said first elastomeric inflatable element means.

7. The apparatus of claim 1 or claim 6 further including first valving means on said tubular means disposed between said Christmas tree assembly and said first expandable elastomeric inflatable element means for selectively isolating and communicating the well annulus area above said first expandable elastomeric inflatable element means after said element means is moved to its fully expanded and sealed position with the flow passageway within the tubular conduit, said valving means being shiftable to a communicating position permitting circulation of gravel packing carrier fluid above the said expandable inflatable element means between the annular area of the well thereabove and within the tubular conduit and through the passageway in the Christmas tree assembly to the top of the well.

8. The apparatus of claim 1 or claim 6 further including valving means on said tubular means for selectively isolating and communicating the well annulus area below said first expandable elastomeric inflatable element means after said element means is moved to its fully expanded and sealed position with a flow passageway within the tubular conduit, said valving means being shiftable to a communicating position permitting circulation of gravel contained in a gravel packing carrier fluid from within the flow passageway within the tubular conduit, through the apparatus and the opened valving means to the exterior of said apparatus within the well annulus therearound for depositing the gravel contained within the carrier fluid exterior of said apparatus.

9. The apparatus of claim 1 further comprising means for selectively communicating said fluid flow passageway in said tubular conduit with said well annular area immediate said production zone, said selective communicating means being normally biased to a first position preventing such communication and shiftable to the communicating position by application of fluid pressure in said passageway in excess of an amount required to move said expandable inflatable element means to fully expanded condition, whereby, when said selective communicating means is in the communicating position, the carrier fluid and gravel may be transmitted through the tubular means, through the selective communicating means and then to the annular area of the production zone exterior of the apparatus.

10. The apparatus of claim 9, said selective communicating means further including an isolation sleeve element shiftable from a first position to a second position by mechanical manipulation of said tubular means to block fluid communication through said selective communication means after gravel packing of the production zone.

11. A method of gravel packing a subterranean well, comprising the steps:

(a) assembling on a tubular conduit at the top surface of said well, a gravel pack apparatus including at least one inflatable packer, a fluid flow cross-over means having first and second concentric fluid flow passageways therein, and a gravel pack screen assembly;

(b) running said apparatus into said well on said tubular conduit;

(c) setting said at least one inflatable packer by introducing pressured fluid through said conduit and through said first concentric fluid flow passageway in said cross-over means and into said inflatable packer to move said packer to said set condition; and (d) pumping gravel in a carrier fluid into said tubular conduit and through said first concentric fluid flow passageway to deposit the gravel around the exterior of said gravel pack screen assembly.

12. The method of claim 11 further comprising the step of: circulating said gravel pack fluid without said gravel through said second fluid flow passageway and to the top of said well.

13. The method of gravel packing a subterranean well, comprising the steps of:

(a) assembling on a tubular conduit at the top surface of said well a gravel pack apparatus including an inflatable packer, a fluid flow cross-over means having first and second concentric fluid flow passageways therein, and a gravel pack screen assembly;

(b) running said apparatus into said well on said tubular conduit;

(c) setting said inflatable packer by introducing pressured fluid through said conduit and through said first concentric fluid flow passageway in said cross-over means and into said inflatable packer to move said packer to set condition;

(d) varying the pressure of said fluid to open a fluid flow pathway between the exterior of said well around said gravel pack screen and each of the first and second fluid flow passageways; and (e) pumping gravel in a carrier fluid into said tubular conduit and through the fluid flow pathway to deposit the gravel around the exterior of the gravel pack screen assembly and to circulate the carrier fluid without the gravel through the second fluid flow passageway and to the top of the well.

14. The method of claim 13 further comprising the step of: (f) manipulating said tubular conduit to communicate said pathway with the annulus of said well above said packer and pumping said carrier fluid without said gravel through said annulus to the top of said well.

15. An apparatus selectively securable to a tubular conduit for gravel packing a production zone having an annular area within a subterranean well including an inner wall, said well further receiving a production conduit with an inner diameter defining a fluid passageway therethrough and terminating at a distal end within said well, said production conduit extending through a Christmas tree assembly having a controlled passageway through which said apparatus and said tubular conduit may be introduced and withdrawn through said production conduit, said apparatus comprising:

(1) means for securing said apparatus to said tubular conduit;

(2) tubular means having a flow passageway disposed therethrough and extending to said securing means;

(3) a first expandable elastomeric inflatable element means carried by said tubular means and having an outer wall movable from an initial retracted and running condition, wherein the outer diameter of said outer wall is less than the inner diameter of said production conduit and the passageway through the Christmas tree assembly, and so movable by pressure applied thereto and within said tubular conduit above said Christmas tree assembly to increase the diameter of said outer wall to at least twice the diameter of said outer wall when said inflatable element means is in said initial running condition, to expanded condition to seal the outer wall of the inflatable element means against the inner wall of the well exterior of and below said distal end of the production conduit;

(4) particle isolation means defining a flowway therein and further defining said annular area in said wellbore exteriorally below the seal of the expanded elastomeric inflatable element means within which gravel in the carrier fluid may be deposited around the exterior thereof and for permitting receipt of the carrier fluid without the gravel through said flowway for circulation within the apparatus and the tubular conduit and through the passageway in the Christmas tree assembly;

(5) first valving means for delivering fluid inflation pressure through said tubular conduit to said first inflatable element means to move said inflatable element means to expanded condition and further including members thereafter responsive to fluid pressure variation through the tubular conduit to retain the inflatable element means in expanded condition;

(6) second valving means manipulatable from closed to opened positions in response to an increase of pressure over said fluid inflation pressure through said tubular conduit to provide a fluid passageway from the well annulus exterior thereof into the particle isolation means and thence through at least one of the tubular and production conduits, and for selectively communicating to said first valving means pressure within said well annulus within said production zone after said inflatable element means is moved to expanded condition to shift said first valving means to closed initial position whereby said inflatable element means is thereafter retained in expanded condition; and (7) third valving means, in fluid pressure communication with each of the first and second valving means and selectively moveable to an open condition to thereby permit gravel within the carrier fluid to be transmitted from within the tubular conduit through the apparatus and into the well annulus below the first expandable inflatable element means and around the particle isolation means.

16. An apparatus selectively securable to a tubular conduit for gravel packing a production zone having an annular area within a subterranean well including an inner wall, said well further having a production conduit having an inner diameter defining a fluid passageway therethrough and terminating at a distal end within said well, said apparatus comprising:

(1) means for securing said apparatus to said tubular conduit;

(2) an outer elongated tubular housing;

(3) inflatable zone isolation means responsive to pressure transmitted thereto through said tubular conduit to isolate the production zone to be gravel packed;

(4) particle isolation means disposed on said housing;

(5) valving means for activating said zone isolation means and carried on said housing; and (6) a fluid flow cross-over assembly initially disposed in a first position and movable to another position and including a first concentric fluid passageway therethrough which, when said cross-over assembly is in said first position, fluid pressure within said tubular conduit and within said housing may be transmitted within the cross-over assembly through the first concentric passageway to the valving means to activate said inflatable zone isolation means.

17. The apparatus of claim 16 wherein said apparatus further comprises means for retaining said cross-over assembly in a second position in response to manipulation of said tubular conduit whereby when in said second position, gravel packing fluid may be pumped through said tubular conduit downwardly through said first concentric passageway and into said well exterior of said particle isolation means.

18. The apparatus of claim 16: the fluid flow cross-over assembly including a second concentric fluid passageway therethrough which, when said cross-over assembly is moved to another position, gravel packing fluid may be returned therethrough and within said production conduit to the top of the well.

19. An apparatus selectively securable to a tubular conduit for gravel packing a production zone having an annular area within a subterranean well including an inner wall, said well further having a production conduit having an inner diameter defining a fluid passageway therethrough and terminating at a distal end within said well, said apparatus comprising:

(1) means for securing said apparatus to said tubular conduit;

(2) an outer elongated tubular housing;

(3) inflatable zone isolation means responsive to pressure transmitted thereto through said tubular conduit to isolate the production zone;

(4) particle isolation means disposed on said housing;

(5) valving means disposed within said particle isolation means and retained in initial closed position but selectively hydraulically moveable to open position to communicate the exterior of the apparatus with the interior of the tubular conduit;

(6) valving means for activating said zone isolation means and carried on said housing; and (7) a fluid flow cross-over assembly initially disposed in a first position and including a first concentric fluid passageway therethrough which, when said cross-over assembly is in said first position, fluid pressure within said tubular conduit and said apparatus within said housing may be transmitted within the cross-over assembly through the first concentric passageway to the valving means to activate said inflatable zone isolation means, said fluid flow cross-over assembly further including a second concentric fluid flow passageway for communicating fluid through the particle isolation means to the top of the well when said valving means within said particle isolation means is manipulated to open position.

20. An apparatus selectively securable to a tubular conduit for gravel packing a production zone having an annular area within a subterranean well including an inner wall, said well further having a production conduit having an inner diameter defining a fluid passageway therethrough and terminating at a distal end within said well, said apparatus comprising:

(1) means for securing said apparatus to said tubular conduit;

(2) an outer elongated tubular housing;

(3) first and second inflatable zone isolation means responsive to pressure transmitted thereto through said tubular conduit to isolate the production zone;

(4) particle isolation means disposed on said housing;

(5) valving means for activating said zone isolation means and carried on said housing; and (6) a fluid flow cross-over assembly initially disposed in a first position and including a first and second concentric fluid flow passageways therethrough which, when said cross-over assembly is in said first position, fluid is transmitted through the tubular conduit and within the first concentric passageway to the first inflatable zone isolation means to activate same and fluid from the tubular conduit is transmitted within the second concentric fluid passageway to activate the second inflatable zone isolation means and, when said cross-over assembly is moved to a second position, fluid exterior of the apparatus may pass through the particle isolation means and into the cross-over assembly and upwardly through the tubular conduit.

21. An apparatus for gravel packing a subterranean well and carriable into said well on a tubular conduit disposed through a production conduit within said well, comprising:

(1) an elongated outer tubular housing including fluid return port means, and circulation port means disposed therethrough;

(2) an inner selectively telescoping control mandrel initially secured to said outer housing in telescopically retracted position;

(3) means for selectively securing said control mandrel to said tubular conduit in said telescopically retracted position;

(4) inflatable packer element means disposed on said outer tubular housing and selectively shiftable to expanded position to seal against the inner wall of the subterranean well within said production zone in response to fluid pressure through said tubular conduit and within said control mandrel;

(5) valving means defined on said housing and said control mandrel selectively moveable from closed position to open position in response to fluid pressure through said tubular conduit and within said control mandrel to manipulate said expandable inflatable element means to expanded condition and thereafter selectively shiftable to return to initial, closed position to retain said inflatable element means in expanded condition;

(6) a flow passageway disposed within said housing and including valving means initially disposed in closed position to isolate said passageway within said housing from the annular area of said well and thereafter shiftable to open position to permit a carrier fluid with gravel to be transmitted through the tubular conduit and within the control mandrel to the exterior of said apparatus below said inflatable packer element means;

(7) particle isolation means carried on said housing whereby gravel in the carrier fluid may be deposited around the exterior thereof and for permitting receipt of the carrier fluid through the interior thereof for circulation within the control mandrel through the apparatus and at least one of the tubular conduit and the production tubing;

(8) means activatable between said tubular housing and said control mandrel by manipulation of said control conduit for retaining said control mandrel and said elongated housing in first telescopically expanded position subsequent to expansion of said inflatable elastomeric expandable element means to expanded condition; and (9) a fluid flow cross-over assembly defined on said control mandrel and disposed within said housing and including first and second concentric fluid flow passageways therethrough, at least one of said concentric flow passageways therethrough communicating said valving means and said tubular conduit for transmitting fluid pressure to said valving means through said one concentric passageway and to manipulate said inflatable element means to expanded condition, when said mandrel is in initial retracted position, said cross-over assembly being shiftable into position when said mandrel is in first telescopically expanded position relative to said elongated housing whereby one of said concentric passageways therethrough permits fluid communication from the flowway in the particle isolation means through the control mandrel thence exterior of the housing to the top of the well through one of the production and tubular conduits, said cross-over assembly being moveable within said tubular housing when said mandrel is moved to a second telescopically expanded position relative to said elongated housing by manipulation of said tubular conduit whereby said fluid return ports on said housing are isolated from the interior of said cross-over assembly and a circulation port on said elongated housing is in communication with said cross-over port for circulation of fluid between the exterior of said apparatus and the interior of the control mandrel above said inflatable packer element means.

22. The apparatus of claim 21 further comprising: a cylindrical control rod assembly disposed on said mandrel and including valving means carried thereon movable between an initial closed position to a second, opened position in response to fluid pressure within said well subsequent to said inflatable element means being moved to expanded condition to communicate the interior of said cylindrical control rod mandrel with the interior of said particle isolation means and the well annulus within the production zone.

23. An apparatus selectively securable to a tubular conduit for gravel packing a production zone within a subterranean well including an inner wall, said well further having a production conduit defining a fluid passageway therethrough through which said apparatus and said tubular conduit may be introduced and withdrawn, said apparatus comprising:

(1) an outer elongated housing member;

(2) expandable elastomeric inflatable element means carried on said outer housing and having an outer wall moveable from an initial retracted and running condition wherein the outer diameter of said outer wall is less than the inner diameter of said production conduit and so moveable by pressure applied thereto and within said tubular conduit to increase the diameter of said outer wall to expanded condition to seal the outer wall of the inflatable element means against the inner wall of the well exterior of and below said distal end of the production conduit;

(3) particle isolation means disposed on said outer housing and within said production zone and defining a flowway therein and further defining said annular area in said well bore below the seal of the expanded elastomeric inflatable element means within which gravel in the carrier fluid may be deposited around the exterior thereof and for permitting receipt of the carrier fluid through said flowway for circulation within the apparatus and the tubular conduit;

(4) a control mandrel telescopically disposed relative to said housing and shiftable relative to said housing from a first position;

(5) concentrically disposed tubular fluid flow passageway means within and carried by said mandrel for transmitting pressured fluid within said tubular conduit through said mandrel and to said expandable elastomeric inflatable element means to move said inflatable element means to expanded condition when said mandrel is in said first position, and for transmitting said gravel and said carrier fluid when said mandrel is shifted from said first position; and (6) means for selectively retaining said mandrel in said first position.

24. The apparatus of claim 23: said expandable elastomeric inflatable element means comprising first and second inflatable element members carried by said housing, one of said fluid flow passageway means transmitting pressured fluid to move one of said inflatable element members to expanded condition and another of said fluid flow passageway means transmitting pressured fluid to the other of said inflatable element members to move said other of said members to expanded condition.

25. The apparatus of claim 23 or claim 24 wherein said mandrel and said housing each have flow ports disposed therethrough selectively communicable relative to one another when said mandrel is shifted from said first position to another position for circulation of fluid therethrough between said production conduit and said tubular conduit and, when in said another position, said tubular fluid flow passageway means further defining isolation means for preventing fluid flow therethrough.

26. A method for gravel packing a production zone having an annual area within a subterranean well including an inner wall, said well further having a production conduit with an inner diameter defining a fluid passageway therethrough and terminating at a distal end within said well, said production conduit extending through a Christmas tree assembly having a controlled passageway through which said apparatus may be introduced and withdrawn on a tubular conduit through said production conduit, said method comprising the steps of:

(a) introducing into said well through the controlled passageway within said Christmas tree and through said production conduit and on said tubular conduit a first expandable elastomeric inflatable element means having a outer wall moveable from an initial retracted and running condition wherein the outer diameter of said outer wall is less than the inner diameter of the production conduit and the passageway through the Christmas assembly and moveable by pressure applied thereto and within said tubular conduit above the Christmas tree assembly, and means for introducing gravel in a carrier fluid through the tubular conduit and through the inflatable element means after expansion of the inflatable element means to expanded condition;

(b) applying pressure through the first expandable elastomeric inflatable element means within the tubular conduit above the Christmas tree assembly to increase the diameter of the outer wall of the inflatable element means to at least twice the diameter of said outer wall when said inflatable element means is in said initial running condition to move said inflatable element means to expanded condition to seal the outer wall of the inflatable element means against the inner wall of the well exterior of and below the distal end of said production conduit; and (c) introducing gravel in a carrier fluid through the tubular conduit and below the inflatable element means after expansion to expanded condition and thence around the exterior of the apparatus and below the elastomeric inflatable means and within the annular area.

27. The method for gravel packing a production zone having an annular area within a subterranean well including an inner wall, said well further having a production conduit within an inner diameter defining a fluid passageway therethrough and terminating at a distal end within said well, said production conduit extending through a Christmas tree assembly having a controlled passageway through which said apparatus and said tubular conduit may be introduced and withdrawn through said production conduit, said method comprising the steps of:

(a) introducing a gravel packing apparatus into said well through said controlled passageway within said Christmas tree and through the production tubing to a position desired in said well, said apparatus including an inflatable elastomeric packer means and valving means for actuating same from running position to expanded condition, fluid flow cross-over means including first and second concentrically disposed fluid passageways therethrough, and a gravel packing screen around the exterior thereof and below the inflatable packer element means;

(b) setting the inflatable packer means by applying pressure from the top of the well through the controlled passageway through the Christmas tree and the tubular conduit through one of the concentric passageways in the cross-over assembly to the valving means for actuation of the inflatable packer means for transmitting fluid and pressure into the elastomeric packing element means; and (c) transmitting gravel in a carrier fluid through the cross-over assembly concentric member utilized to transmit fluid and pressure to set the inflatable packer means, through the apparatus and exteriorly thereof below the set packer, through the screen with the gravel deposited exterior of the screen and the carrier fluid being transmitted therethrough and within the cross-over assembly within the other of the concentric tubular passageways to the well annulus between the exterior of the apparatus and the interior of the well above the set inflatable packer means, to the top of the well.

28. The method of claim 27 further including the additional step of: manipulating the tubular conduit after setting of the inflatable packer means and prior to transmitting the carrier fluid with the gravel disposed therein into the tubular conduit and the apparatus to align the cross-over assembly for fluid transmission through the apparatus and the exterior thereof thence interior of the apparatus to the top of the well.

29. An apparatus selectively securable to a tubular conduit for gravel packing a production zone having an annular area within a subterranean well including an inner wall, said well further having a production conduit with an inner diameter defining a fluid passageway therethrough and terminating at a distal end within said well, said production conduit extending through a Christmas tree assembly having a controlled passageway through which said apparatus and said tubular conduit may be introduced and withdrawn through said production conduit, said apparatus comprising:

(1) means for selectively securing said apparatus to said tubular conduit;

(2) tubular means having a flow passageway disposed therethrough and extending to said selective securing means;

(3) a first expandable elastomeric inflatable element means having an outer wall movable from an initial retracted and running condition wherein the outer diameter of said outer wall is less than the inner diameter of said production conduit and the passageway through the Christmas tree assembly, and so movable by pressure applied thereto and within said tubular conduit above said Christmas tree assembly, to increase the diameter of said outer wall to at least twice the diameter of said outer wall when said inflatable element means is in said initial running condition, to expanded condition to seal the outer wall of the inflatable element means against the inner wall of the well exterior of and below the distal end of said production conduit;

(4) means for introducing gravel in a carrier fluid through said tubular conduit and through said inflatable element means after expansion to expanded condition and thence around the exterior of said apparatus and below said elastomeric inflatable means and within said annular area; and (5) a second expandable elastomeric inflatable element means disposed on said tubular conduit; said first expandable elastomeric inflatable element means being placeable in sealed position within said well above said production zone and said second expandable inflatable element means being placeable in sealed position within said well below the production zone; means for activating expansion of said first expandable elastomeric inflatable element means through fluid pressure applied through said tubular conduit; and means prior to activation of said means for activation of expansion of said first elastomeric inflatable element means, said second expandable inflatable element means including a tubular conduit member disposed therein and in communication with the tubular conduit and further including a tubular silt ejection conduit extending lowerly therefrom for transmission of silt, fines and debris which may be produced in the well through the apparatus and further including a distal opening therethrough for deposition of said silt, fines and debris into a rat hole portion of said well, whereby bridging across any portion of the tubular conduit and/or the apparatus during production is abated.

30. A method for gravel packing a subterranean well, comprising the steps of:

(a) assembling at the top of the well and introducing therein an apparatus comprising:

(1) an elongated outer tubular housing including fluid return port means, and circulation port means disposed therethrough;

(2) an inner selectively telescoping control mandrel initially secured to said outer housing in telescopically retracted position;

(3) means for selectively securing said control mandrel to said tubular conduit in said telescopically retracted position;

(4) inflatable packer element means disposed on said outer tubular housing and selectively shiftable to expanded position to seal against the inner wall of the subterranean well within said production zone in response to fluid pressure through said tubular conduit and within said control mandrel;

(5) valving means defined on said housing and said control mandrel selectively moveable from closed position to open position in response to fluid pressure through said tubular conduit and within said control mandrel to manipulate said expandable inflatable element means to expanded condition and thereafter selectively shiftable to return to initial, closed position to retain said inflatable element means in expanded condition;

(6) a flow passageway disposed within said housing and including valving means initially disposed in closed position to isolate said passageway within said housing from the annular area of said well and thereafter shiftable to open position to permit a carrier fluid with gravel to be transmitted through the tubular conduit and within the control mandrel to the exterior of said apparatus below said inflatable packer element means;

(7) particle isolation means carried on said housing whereby gravel in the carrier fluid may be deposited around the exterior thereof and for permitting receipt of the carrier fluid through the interior thereof for circulation within the control mandrel through the apparatus and at least one of the tubular conduit and the production tubing;

(8) means activatable between said tubular housing and said control mandrel for retaining said control mandrel and said elongated housing in first telescopically expanded position subsequent to expansion of said inflatable elastomeric expandable element means to expanded condition by manipulation of said control conduit; and (9) a fluid flow cross-over assembly defined on said control mandrel and including first and second concentric fluid flow passageways therethrough, at least one of said concentric flow passageways therethrough communicating said valving means and said tubular conduit for transmitting fluid pressure to said valving means through said one concentric passageway and to manipulate said inflatable element means to expanded condition, when said mandrel is in initial retracted position, said cross-over assembly being shiftable into position when said mandrel is in first telescopically expanded position relative to said elongated housing whereby one of said concentric passageways therethrough permits fluid communication from the flowway in the particle isolation means through the control mandrel thence exterior of the housing to the top of the well through one of the production and tubular conduits, said cross-over assembly being moveable within said tubular housing when said mandrel is moved to a second telescopically expanded position relative to said elongated housing by manipulation of said tubular conduit whereby said fluid return ports on said housing are isolated from the interior of said cross-over assembly and a circulation port on said elongated housing is in communication with said cross-over port for circulation of fluid between the exterior of said apparatus and the interior of the control mandrel;

(b) moving the inflatable packer element means to expanded position by transmitting fluid pressure within said tubular conduit through said flow passageway and at least one of the first and second concentric fluid flow passageways within the fluid flow cross-over assembly to manipulate the valving means to shift the inflatable packer element means to expanded position for sealing against the inner wall of the subterranean well;

(c) manipulating the tubular conduit to activate the means activatable between the tubular housing and the control mandrel to move said tubular housing and said mandrel in said first relative telescopically expanded position, whereby one of the concentric passageways through the fluid flow cross-over assembly permits fluid communication from the flowway in the particle isolation means through the control mandrel thence exterior of the housing to the top of the well through the one of the production and tubular conduits; and (d) manipulating the tubular conduit to reorient the control mandrel relative to the outer tubular housing whereby said fluid return ports on said housing are isolated from the interior of said cross-over assembly and a circulation port on said elongated housing is in communication with said cross-over port for circulation of fluid between the exterior of said apparatus and the interior of the control mandrel.

* * * * *